US005413725A

United States Patent [19]

Lal et al.

[11] Patent Number: 5,413,725

[45] Date of Patent: * May 9, 1995

[54] POUR POINT DEPRESSANTS FOR HIGH MONOUNSATURATED VEGETABLE OILS AND FOR HIGH MONOUNSATURATED VEGETABLE OILS/BIODEGRADABLE BASE AND FLUID MIXTURES

[75] Inventors: Kasturi Lal, Willoughby; Dennis M. Dishong, South Euclid; Jeffry G. Dietz, University Heights, all of Ohio

[73] Assignee: The Lubrizol Corporation, Wickliffe, Ohio

[ * ] Notice: The portion of the term of this patent subsequent to Mar. 21, 2012 has been disclaimed.

[21] Appl. No.: 165,777

[22] Filed: Dec. 10, 1993

Related U.S. Application Data

[63] Continuation-in-part of Ser. No. 993,178, Dec. 18, 1992, abandoned.

[51] Int. Cl.[6] ..... C10M 141/00

[52] U.S. Cl. ..... 252/18; 252/251.005 R; 252/51.005 A; 252/56 S; 252/56 R; 252/33.04; 252/25; 252/50; 252/32.007 E

[58] Field of Search ..... 252/51.5 A, 56 S, 56 R, 252/18, 25, 32.7 E, 33.4, 50

[56] References Cited

U.S. PATENT DOCUMENTS

| | | | |
|---|---|---|---|
| 3,598,736 | 8/1971 | Van der Meij et al. | 252/56 |
| 3,598,737 | 8/1971 | Vander Meij et al. | 252/56 |
| 3,640,860 | 2/1972 | Miller | 252/56 |
| 3,933,761 | 1/1976 | Coleman | 252/51.5 A |
| 4,073,737 | 2/1978 | Elliott | 252/51.5 |
| 4,073,738 | 2/1978 | Ladenberger et al. | 252/56 |
| 4,284,414 | 8/1981 | Bryant | 44/62 |
| 4,604,221 | 8/1986 | Bryant et al. | 252/51.5 |
| 4,683,069 | 7/1987 | Brewster et al. | 252/32.7 |
| 4,753,743 | 6/1988 | Seck | 252/56 S |
| 4,767,551 | 8/1988 | Hunt et al. | 252/32.7 |
| 4,783,274 | 11/1988 | Jokiner et al. | 252/56 S |
| 4,826,615 | 5/1989 | Rossi et al. | 252/56 |
| 4,857,214 | 8/1989 | Papay et al. | 252/32.5 |
| 4,885,104 | 12/1989 | Sturwold | 252/56 S |
| 4,921,624 | 5/1990 | Kammann, Jr. | 252/56 S |
| 4,938,881 | 7/1990 | Ripple et al. | 252/32.7 |
| 5,041,622 | 8/1991 | LeSuer | 560/190 |
| 5,064,546 | 11/1991 | Dasai | 252/32.5 |

*Primary Examiner*—Jacqueline V. Howard
*Attorney, Agent, or Firm*—James L. Cordek; Frederick D. Hunter, Sr.; Joseph P. Fischer

[57] ABSTRACT

An industrial lubricant composition is described that comprises (A) at least one vegetable or synthetic triglyceride oil of the formula

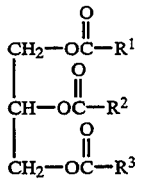

wherein $R^1$, $R^2$ and $R^3$ are aliphatic hydrocarbyl groups having at least 60 percent monounsaturated character and containing from about 6 to about 24 carbon atoms further wherein an oleic acid moiety:linoleic acid moiety is from about 2 up to about 90 and (B) at least one pour point depressant. Optionally, the composition may also contain (C) a performance additive and (D) an oil.

72 Claims, No Drawings

POUR POINT DEPRESSANTS FOR HIGH MONOUNSATURATED VEGETABLE OILS AND FOR HIGH MONOUNSATURATED VEGETABLE OILS/BIODEGRADABLE BASE AND FLUID MIXTURES

This is a continuation-in-part of application(s) Ser. No. 07/993,178 filed on 18 Dec. 1992, now abandoned.

FIELD OF THE INVENTION

The present invention relates to vegetable oils that possess at least 60 percent monounsaturation content and contain at least one pour point depressant. In addition to pour point depressants, the vegetable oil may also contain a performance additive designed to enhance the performance of the vegetable oil when used in hydraulic fluids, two-cycle (two stroke) internal combustion engines, gear oils, and passenger car motor oils.

BACKGROUND OF THE INVENTION

Successful use of vegetable oils as environmentally friendly, that is, biodegradable, base fluids in industrial applications is contingent upon improving their low temperature viscometries. For example, a sunflower oil containing an oleic acid content of 80 percent has a pour point of −12° C. and turns solid in the Brookfield viscosity measurement. Many of the industrial applications require a pour point of less than −25° C. and a Brookfield viscosity of 7500to 110,000 centi Poises (cP) at −25° C.

U.S. Pat. No. 3,598,736 (Van der Meij et al, Aug. 10, 1971 ) relates to soluble polyalkylmethacrylates which can be used in lubricating oil compositions to reduce the pour point. Within the polyalkylmethacrylate the alkyl group has from 10–20 carbon atoms and meets the following three requirements:

(1) The average number of carbon atoms of the alkyl chains in the methacrylates is between 13.8 and 14.8.

(2) The molar percentage of the alkyl methacrylates with branched alkyl chains is between 10 and 30.

(3) The molar percentage of the alkyl methacrylates with an odd number of carbon atoms in the alkyl chain is between 20 and 50.

These polymers are capable not only of considerably depressing the pour point of light lubricating oils, such a spindle oil and light machine oil, but show in addition a high activity as pour point depressants in heavy lubricating oils rich in residual components, such as heavy machine oil.

U.S. Pat. No. 3,702,300 (Coleman, Nov. 7, 1972) relates to a carboxy-containing interpolymer in which some of the carboxy radicals are esterified and the remaining carboxy radicals are neutralized by reaction with a polyamine compound having one primary or secondary amino group and is useful as an additive in lubricating compositions and fuels. The interpolymer is especially effective to impart desirable viscosity characteristics and anti-sludge properties to a lubricating oil.

U.S. Pat. No. 4,284,414 (Bryant, Aug. 18, 1981 ) relates to the use of mixed alkyl esters made by reacting two or more of certain monohydric alcohols with interpolymers which contain units derived from (i)$\alpha\beta$-unsaturated dicarboxylic acids, or derivatives thereof and (ii) vinyl aromatic monomers having up to 12 carbon atoms in crude oils. Minor amounts of the mixed alkyl esters are useful for modifying the fluidity and flow characteristics of crude oils, and more particularly, for improving the pipeline pumpability of crude oils.

U.S. Pat. No. 4,767,551 (Hunt et al, Aug. 30, 1988) relates to overbased copper-containing lubricant compositions with improved stability and antiwear and antirust properties wherein the overbased copper-containing composition inhibits the oxidation of the lubricant and preserves the antirust properties of the lubricant without significantly decreasing the antiwear properties of the zinc dialkyldithiophosphate antiwear additive during use of the lubricant in an operating engine. Further, this reference provides lubricating oil compositions containing a lubricating oil, a dispersant, a viscosity index improver dispersant, an antiwear agent and a dispersant/detergent, antioxidant and rust inhibitor comprising an overbased copper-containing composition which provides an improved lubricating oil formulation for high speed, high temperature gasoline and diesel engine operation.

U.S. Pat. No. 4,783,274 (Jokinen et al, Nov. 8, 1988) is concerned with an anhydrous oily lubricant, which is based on vegetable oils, which is substituted for mineral lubricant oils, and which, as its main component, contains triglycerides that are esters of saturated and/or unsaturated straight-chained $C_{10}$ to $C_{22}$ fatty acids and glycerol. The lubricant is characterized in that it contains at least 70 percent by weight of a triglyceride whose iodine number is at least 50 and no more than 125 and whose viscosity index is at least 190. As its basic component, instead of or along with the said triglyceride, the lubricant oil may also contain a polymer prepared by hot-polymerization out of the said triglyceride or out of a corresponding triglyceride. As additives, the lubricant oil may contain solvents, fatty acid derivatives, in particular, their metal salts, organic or inorganic, natural or synthetic polymers, and customary additives for lubricants.

SUMMARY OF THE INVENTION

A composition is disclosed which comprises (A) at least one vegetable or synthetic triglyceride oil of the formula

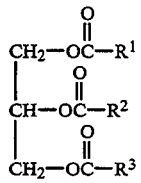

wherein $R^1$, $R^2$ and $R^3$ are aliphatic hydrocarbyl groups having at least 60 percent monounsaturated character and containing from about 6 to about 24 carbon atoms and (B) at least one pour point depressant.

In addition to components (A) and (B), the composition may also contain (C) a performance additive and/or (D) an additional oil with the proviso that said oil is not the triglyceride oil, component (A) that contains at least 60 percent monounsaturated character.

DETAILED DESCRIPTION OF THE INVENTION

(A) The Triglyceride Oil

In practicing this invention a triglyceride oil is employed which is a natural or synthetic oil of the formula

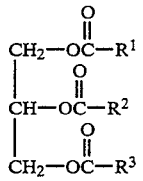

Within the triglyceride formula are aliphatic hydrocarbyl groups having at least 60 percent monounsaturated character and containing from about 6 to about 24 carbon atoms. The term "hydrocarbyl group" as used herein denotes a radical having a carbon atom directly attached to the remainder of the molecule. The aliphatic hydrocarbyl groups include the following:

(1) Aliphatic hydrocarbon groups; that is, alkyl groups such as heptyl, nonyl, undecyl, tridecyl, heptadecyl; alkenyl groups containing a single double bond such as heptenyl, nonenyl, undecenyl, tridecenyl, heptadecenyl, heneicosenyl; alkenyl groups containing 2 or 3 double bonds such as 8,11-heptadecadienyl and 8,11,14-heptadecatrienyl. All isomers of these are included, but straight chain groups are preferred.

(2) Substituted aliphatic hydrocarbon groups; that is groups containing non-hydrocarbon substituents which, in the context of this invention, do not alter the predominantly hydrocarbon character of the group. Those skilled in the art will be aware of suitable substituents; examples are hydroxy, carbalkoxy, (especially lower carbalkoxy) and alkoxy (especially lower alkoxy), the term, "lower" denoting groups containing not more than 7 carbon atoms.

(3) Hetero groups; that is, groups which, while having predominantly aliphatic hydrocarbon character within the context of this invention, contain atoms other than carbon present in a chain or ring otherwise composed of aliphatic carbon atoms. Suitable hetero atoms will be apparent to those skilled in the art and include, for example, oxygen, nitrogen and sulfur.

Naturally occurring triglycerides are vegetable oil triglycerides. The synthetic triglycerides are those formed by the reaction of one mole of glycerol with three moles of a fatty acid or mixture of fatty acids. Preferred are vegetable oil triglycerides.

Regardless of the source of the triglyceride oil, the fatty acid moieties are such that the triglyceride has a monounsaturated character of at least 60 percent, preferably at least 70 percent and most preferably at least 80 percent. Naturally occurring triglycerides having utility in this invention are exemplified by vegetable oils that are genetically modified such that they contain a higher than normal oleic acid content. Normal sunflower oil has an oleic acid content of 25–30 percent. By genetically modifying the seeds of sunflowers, a sunflower oil can be obtained wherein the oleic content is from about 60 percent up to about 90 percent. That is, the $R^1$, $R^2$ and $R^3$ groups are heptadecenyl groups and the $R^1COO^-$, $R^2COO^-$ that are attached to the 1,2,3-propanetriyl group $-CH_2CHCH_2-$ are the residue of an oleic acid molecule. U.S. Pat. No. 4,627,192 and 4,743,402 are herein incorporated by reference for their disclosure to the preparation of high oleic sunflower oil.

For example, a triglyceride comprised exclusively of an oleic acid moiety has an oleic acid content of 100% and consequently a monounsaturated content of 100%. Where the triglyceride is made up of acid moieties that are 70% oleic acid, 10% stearic acid, 5% palmitic acid, 7% linoleic and 8% hexadecanoic acid, the monounsaturated content is 70%. The preferred triglyceride oils are high oleic (at least 60 percent) acid triglyceride oils. Typical high oleic vegetable oils employed within the instant invention are high oleic safflower oil, high oleic corn oil, high oleic rapeseed oil, high oleic sunflower oil, high oleic soybean oil, high oleic cottonseed oil, high oleic lesquerella oil, high oleic meadowfoam oil and high oleic palm olein. A preferred high oleic vegetable oil is high oleic sunflower oil obtained from Helianthus sp. This product is available from SVO Enterprises Eastlake, Ohio as Sunyl® high oleic sunflower oil. Sunyl 80 is a high oleic triglyceride wherein the acid moieties comprise 80 percent oleic acid. Another preferred high oleic vegetable oil is high oleic rapeseed oil obtained from Brassica campestris or Brassica napus, also available from SVO Enterprises as $RS^R$ high oleic rapeseed oil. RS80 signifies a rapeseed oil wherein the acid moieties comprise 80 percent oleic acid.

It is to be noted the olive oil is excluded as a vegetable oil in this invention. The oleic acid content of olive oil typically ranges from 65–85 percent. This content, however, is not achieved through genetic modification, but rather is naturally occurring.

It is further to be noted that genetically modified vegetable oils have high oleic acid contents at the expense of the di-and tri- unsaturated acids. A normal sunflower oil has from 20–40 percent oleic acid moieties and from 50–70 percent linoleic acid moieties. This gives a 90 percent content of mono- and di-unsaturated acid moieties (20+70) or (40+50). Genetically modifying vegetable oils generate a low di- or tri- unsaturated moiety vegetable oil. The genetically modified oils of this invention have an oleic acid moiety:linoleic acid moiety ratio of from about 2 up to about 90. A 60 percent oleic acid moiety content and 30 percent linoleic acid moiety content of a triglyceride oil gives a ratio of 2. A triglyceride oil made up of an 80 percent oleic acid moiety and 10 percent linoleic acid moiety gives a ratio of 8. A triglyceride oil made up of a 90 percent oleic acid moiety and 1 percent linoleic acid moiety gives a ratio of 90. The ratio for normal sunflower oil is 0.5 (30 percent oleic acid moiety and 60 percent linoleic acid moiety).

Non-genetically modified vegetable oils having utility in this invention are sunflower oil, safflower oil, corn oil, soybean oil, rapeseed oil, meadowfoam oil, lesquerella oil or castor oil.

(B) The Pour Point Depressant

A drawback of using high monounsaturated triglycerides is in the difficulty with congelation of the oil at low temperatures (less than −10° C.). This difficulty arises from a natural stiffening at low temperatures of the triglyceride analogous to the stiffening of honey or molasses at a reduced temperature. To maintain the "pour" or "flow" of the triglyceride oil, a pour point depressant is added to the oil.

Pour point depressants (PPD) having utility in this invention are carboxy containing interpolymers in which many of the carboxy groups are esterified and the remaining carboxy groups, if any, are neutralized by reaction with amino compounds; acrylate polymers, nitrogen containing acrylate polymers and methylene linked aromatic compounds.

Carboxy-Containing Interpolymers

This PPD is an ester of a carboxy-containing interpolymer, said interpolymer having a reduced specific viscosity of from about 0.05 to about 2, said ester being substantially free of titratable acidity, i.e., at least 90% esterification, and being characterized by the presence within its polymeric structure of pendant polar groups: (A) a relatively high molecular weight carboxylic ester group having at least 8 aliphatic carbon atoms in the ester radical, (B) a relatively low molecular weight carboxylic ester group having no more than 7 aliphatic carbon atoms in the ester radical, and optionally (C) a carbonylpolyamino group derived from a polyamino compound having one primary or secondary amino group, wherein the molar ratio of (A):(B) is (1–20):1, preferably (1–10):1 and wherein the molar ratio of (A):(B):(C) is (50–100):(5–50):(0.5)

An essential element of this ester is that the ester is a mixed ester, i.e., one in which there is the combined presence of both a high molecular weight ester group and a low molecular weight ester group, particularly in the ratio as stated above. Such combined presence is critical to the viscosity properties of the mixed ester, both from the standpoint of its viscosity modifying characteristics and from the standpoint of its thickening effect upon lubricating compositions in which it is used as an additive.

In reference to the size of the ester groups, it is pointed out that an ester radical is represented by the formula

—C(O)(OR)

and that the number of carbon atoms in an ester radical is the combined total of the carbon atoms of the carbonyl group and the carbon atoms of the ester group i.e., the (OR) group.

An optional element of this ester is the presence of a polyamino group derived from a particular amino compound, i.e., one in which there is one primary or secondary amino group and at least one mono-functional amino group. Such polyamino groups, when present in this mixed ester in the proportion stated above enhances the dispersability of such esters in lubricant compositions and additive concentrates for lubricant compositions.

Still another essential element of the mixed ester is the extent of esterification in relation to the extent of neutralization of the unesterified carboxy groups of the carboxy-containing interpolymer through the conversion thereof to the optional polyamino-containing groups. For convenience, the relative proportions of the high molecular weight ester group to the low molecular weight ester group and to the polyamino group are expressed in terms of molar ratios of (50–100):(5–50):(0.1–15), respectively. The preferred ratio is (70–85):(15–30):(3–4). It should be noted that the linkage described as the carbonyl-polyamino group may be imide, amide, or amidine and inasmuch as any such linkage is contemplated within the present invention, the term "carbonyl polyamino" is thought to be a convenient, generic expression useful for the purpose of defining the inventive concept. In a particularly advantageous embodiment of the invention such linkage is imide or predominantly imide.

Still another important element of the mixed ester is the molecular weight of the carboxy-containing interpolymer. For convenience, the molecular weight is expressed in terms of the "reduced specific viscosity" of the interpolymer which is a widely recognized means of expressing the molecular size of a polymeric substance. As used herein, the reduced specific viscosity (abbreviated as RSV) is the value obtained in accordance with the formula $$RSV = \frac{\text{Relative Viscosity} - 1}{\text{Concentration}}$$

wherein the relative viscosity is determined by measuring, by means of a dilution viscometer, the viscosity of a solution of one gram of the interpolymer in 10 mi. of acetone and the viscosity of acetone at 30°±0.02° C. For purpose of computation by the above formula, the concentration is adjusted to 0.4 gram of the interpolymer per 100 ml. of acetone. A more detailed discussion of the reduced specific viscosity, also known as the specific viscosity, as well as its relationship to the average molecular weight of an interpolymer, appears in Paul J. Flory, *Principles of Polymer Chemistry,* (1953 Edition)pages 308 et seq.

While interpolymers having reduced specific viscosity of from about 0.05 to about 2 are contemplated in the mixed ester, the preferred interpolymers are those having a reduced specific viscosity of from about 0.1 to about 1. In most instances, interpolymers having a reduced specific viscosity of from about 0.1 to about 0.8 are particularly preferred.

From the standpoint of utility, as well as for commercial and economical reasons, esters in which the high molecular weight ester group has from 8 to 24 aliphatic carbon atoms, the low molecular weight ester group has from 3 to 5 carbon atoms, and the carbonyl amino group is derived from a primary-aminoalkyl-substituted tertiary amine, particularly heterocyclic amines, are preferred. Specific examples of the high molecular weight carboxylic ester group, i.e., the (OR) group of the ester radical (i.e., -(O)(OR)) include heptyloxy, isooctyloxy, decyloxy, dodecyloxy, tridecyloxy, tetradecyloxy, pentadecyloxy, octadecyloxy, eicosyloxy, tricosyloxy, tetracosyloxy, etc. Specific examples of low molecular weight groups include methoxy, ethoxy, n-propyloxy, isopropyloxy, n-butyloxy, sec-butyloxy, iso-butyloxy, n-pentyloxy, neo-pentyloxy, n-hexyloxy, cyclohexyloxy, xyxlopentyloxy, 2-methyl-butyl-1-oxy,2,3-dimethyl-butyl-1-oxy, etc. In most instances, alkoxy groups of suitable size comprise the preferred high and low molecular weight ester groups. Polar substituents may be present in such ester groups. Examples of polar substituents are chloro, bromo, ether, nitro, etc.

Examples of the carbonyl polyamino group include those derived from polyamino compounds having one primary or secondary amino group and at least one mono-functional amino group such as tertiary-amino or heterocyclic amino group. Such compounds may thus be tertiary-amino substituted primary or secondary amines or other substituted primary or secondary amines in which the substituent is derived from pyrroles, pyrrolidones, caprolactams, oxazolidones, oxazoles, thiazoles, pyrazoles, pyrazolines, imidazoles, imidazolines, thiazines, oxazines, diazines, oxycarbamyl, thiocarbamyl, uracils, hydantoins, thiohydantoins, guanidines, ureas, sulfonamides, phosphoramides, phenothiaznes, amidines, etc. Examples of such polyamino compounds include dimethylaminoethylamine, dibutylamino-ethylamine, 3-dimethylamino-1-propylamine, 4-methylethylamino-1-butylamine, pyridylethylamine, N-morpholino-ethylamine, tetrahydropyridyl-ethylamine, bis-(dimethylamino)propyl-amine, bis(-diethylamino)ethylamine, N,N-dimethyl-p-phenylene diamine, piperidylethylamine, 1-aminoethyl pyrazole, 1-(methylamino)pyrazoline, 1-methyl-4-amino-octyl pyrazole, 1-aminobutyl imidazole, 4-aminoethyl thiazole, 2-aminoethyl pyridine, ortho-amino-ethyl-N,N-dimethylbenzenesulfamide, N-aminoethyl phenothiazine, N-aminoethylacetamidine, 1-aminophenyl-2-aminoethyl pyridine, N-methyl-N-aminoethyl-S-ethyldithiocarbamate, etc. Preferred polyamino compounds include the N-aminoalkyl-substituted morpholines such as aminopropyl morpholine. For the most part, the polyamino compounds are those which contain only one primary-amino or secondary-amino group and, preferably at least one tertiary-amino group. The tertiary amino group is preferably a heterocyclic amino group. In some instances polyamino compounds may contain up to about 6 amino groups although, in most instances, they contain one primary amino group and either one or two tertiary amino groups. The polyamino compounds may be aromatic or aliphatic amines and are preferably heterocyclic amines such as amino-alkyl-substituted morpholines, piperazines, pyridines, benzopyrroles, quinolines, pyrroles, etc. They are usually amines having from 4 to about 30 carbon atoms, preferably from 4 to about 12 carbon atoms. Polar substituents may likewise be present in the polyamines.

The carboxy-containing interpolymers include principally interpolymers of alpha, beta-unsaturated acids or anhydrides such as maleic anhydride or itaconic anhydride with olefins (aromatic or aliphatic) such as ethylene, propylene, isobutene or styrene, or substituted styrene wherein the substituent is a hydrocarbyl group containing from 1 up to about 18 carbon atoms. The styrene-maleic anhydride interpolymers are especially useful. They are obtained by polymerizing equal molar amounts of styrene and maleic anhydride, with or without one or more additional interpolymerizable comonomers. In lieu of styrene, an aliphatic olefin may be used, such as ethylene, propylene or isobutene. In lieu of maleic anhydride, acrylic acid or methacrylic acid or ester thereof may be used. Such interpolymers are know in the art and need not be described in detail here. Where an interpolymerizable comonomer is contemplated, it should be present in a relatively minor proportion, i.e., less that about 0.3 mole, usually less than about 0.15 mole, per mole of either the olefin (e.g. styrene) or the alpha, beta-unsaturated acid or anhydride (e.g. maleic anhydride). Various methods of interpolymerizing styrene and maleic anhydride are known in the art and need not be discussed in detail here. For purpose of illustration, the interpolymerizable comonomers include the vinyl monomers such as vinyl acetate, acrylonitrile, methylacrylate, methylmethacrylate, acrylic acid, vinyl methyl either, vinyl ethyl ether, vinyl chloride, isobutene or the like.

The nitrogen-containing esters of the mixed ester are most conveniently prepared by first 100 percent esterifying the carboxy-containing interpolymer with a relatively high molecular weight alcohol and a relatively low molecular weight alcohol. When the optional (C) is employed, the high molecular weight alcohol and low molecular weight alcohol are utilized to convert at least about 50% and no more than about 98% of the carboxy radicals of the interpolymer to ester radicals and then neutralizing the remaining carboxy radicals with a polyamino compound such as described above. To incorporate the appropriate amounts of the two alcohol groups into the interpolymer, the ratio of the high molecular weight alcohol to the low molecular weight alcohol used in the process should be within the range of from about 2:1 to about 9:1 on a molar basis. In most instances the ratio is from about 2.5:1 to about 5:1. More than one high molecular weight alcohol or low molecular weight alcohol may be used in the process; so also may be used commercial alcohol mixtures such as the so-called Oxoalcohols which comprise, for example mixtures of alcohols having from 8 to about 24 carbon atoms. A particularly useful class of alcohols are the commercial alcohols or alcohol mixtures comprising decylalcohol, dodecyl alcohol, tridecyl alcohol, tetradecyl alcohol, pentadecyl alcohol, hexadecyl alcohol, heptadecyl alcohol and octadecyl alcohol. Other alcohols useful in the process are illustrated by those which, upon esterification, yield the ester groups exemplified above.

The extent of esterification, as indicated previously, may range from about 50% to about 98% conversion of the carboxy radicals of the interpolymer to ester radicals. In a preferred embodiment, the degree of esterification ranges from about 75% to about 95%.

The esterification can be accomplished simply be heating the carboxy-containing interpolymer and the alcohol or alcohols under conditions typical for effecting esterification. Such conditions usually include, for example, a temperature of at least about 80° C., preferably from about 150° C. to about 350° C., provided that the temperature be below the decomposition point of the reaction mixture, and the removal of water of esterification as the reaction proceeds. Such conditions may optionally include the use of an excess of the alcohol reactant so as to facilitate esterification, the use of a solvent or diluent such as mineral oil, toluene, benzene, xylene or the like and a esterification catalyst such as toluene sulfonic acid, sulfuric acid, aluminum chloride, boron trifluoride-trimethylamine, hydrochloric acid, ammonium sulfate, phosphoric acid, sodium methoxide or the like. These conditions and variations thereof are well know in the art.

A particularly desirable method of effecting esterification involves first reacting the carboxy-containing interpolymer with the relatively high molecular weight alcohol and then reacting the partially esterified interpolymer with the relatively low molecular weight alcohol. A variation of this technique involves initiating the esterification with the relatively high molecular weight alcohol and before such esterification is complete, the relatively low molecular weight alcohol is introduced into the reaction mass so as to achieve a mixed esterification. In either event it has been discovered that a two-step esterification process whereby the carboxy-containing interpolymer is first esterified with the relatively high molecular weight alcohol so as to convert from about 50% to about 75% of the carboxy radicals to ester radicals and then with the relatively low molecular weight alcohol to achieve the finally desired degree of esterification results in products which have unusually beneficial viscosity properties.

The esterified interpolymer may optionally be treated with a polyamino compound in an amount so as to neutralize substantially all of the unesterified carboxy radicals of the interpolymer. The neutralization is preferably carried out at a temperature of at least about 80° C., often from about 120° C. to about 300° C., provided that the temperature does not exceed the decomposition point of the reaction mass. In most instances the neutralization temperature is between about 150° C. and 250° C. A slight excess of the stoichiometric amount of the amino compound is often desirable, so as to insure substantial completion of neutralization, i.e., no more than about 2% of the carboxy radicals initially present in the interpolymer remained unneutralized.

The following examples are illustrative of the preparation of the mixed ester of the present invention. Unless otherwise indicated all parts and percentages are by weight.

EXAMPLE (B-1)

A styrene-maleic interpolymer is obtained by preparing a solution of styrene (16.3 parts by weight) and maleic anhydride (12.9 parts) in a benzene-toluene solution (270 parts; weight ratio of benzene:toluene being 66.5:33.5) and contacting the solution at 86° C. in nitrogen atmosphere for 8 hours with a catalyst solution prepared by dissolving 70% benzoyl peroxide (0.42 part) in a similar 10 benzene-toluene mixture (2.7 parts). The resulting product is a thick slurry of the interpolymer in the solvent mixture. To the slurry there is added mineral oil (141 parts) while the solvent mixture is being distilled off at 150° C. and then at 150° C./200 mm. Hg. To 209 parts of the stripped mineral oil-interpolymer slurry (the interpolymer having a reduced specific viscosity of 0.72) there are added toluene (25.2 parts), n-butyl alcohol (4.8 parts), a commercial alcohol consisting essentially of primary alcohols having from 12 to 18 carbon atoms (56.6 parts) and a commercial alcohol consisting of primary alcohols having from 8 to 10 carbon atoms (10 parts) and to the resulting mixture there is added 96% sulfuric acid (2.3 parts). The mixture is then heated at 150°–160° C. for 20 hours whereupon water is distilled off. An additional amount of sulfuric acid (0.18 part) together with an additional amount of n-butyl alcohol (3 parts) is added and the esterification is continued until 95% of the carboxy radicals of the polymer has been esterified. To the esterified interpolymer, there is then added aminopropyl morpholine (3.71 parts; 10% in excess of the stoichiometric amount required to neutralize the remaining free carboxy radicals) and the resulting mixture is heated to 150°–160° C./10 min. Hg to distill off toluene and any other volatile components. The stripped product is mixed with an additional amount of mineral oil (12 parts) filtered. The filtrate is a mineral oil solution of the nitrogen-containing mixed ester having a nitrogen content of 0.16–0.17%.

EXAMPLE (B-2)

The procedure of Example (B-1) is followed except that the esterification is carried out in two steps, the first step being the esterification of the styrene-maleic interpolymer with the commercial alcohols having from 8 to 18 carbon atoms and the second step being the further esterification of the interpolymer with n-butyl alcohol.

EXAMPLE (B-3)

The procedure of Example (B-1 ) is followed except that the esterification is carried out by first esterifying the styrene-maleic interpolymer with the commercial alcohol having from 8 to 18 carbon atoms until 70% of the carboxyl radicals of the interpolymer have been converted to ester radicals and thereupon continuing the esterification with any yet-unreacted commercial alcohols and n-butyl alcohol until 95% of the carbonyl radicals of the interpolymer have been converted to ester radicals.

EXAMPLE (B-4)

The procedure of Example (B-1) is followed except that the interpolymer is prepared by polymerizing a solution consisting of styrene (416 parts), maleic anhydride (392 parts), benzene (2153 parts) and toluene (5025 parts) in the presence of benzoyl peroxide (1.2 parts) at 65°–106° C. (The resulting interpolymer has a reduced specific viscosity of 0.45).

EXAMPLE (B-5)

The procedure of Example (B-1) is followed except that the styrene-maleic anhydride is obtained by polymerizing a mixture of styrene (416 pans), maleic anhydride (392 parts), benzene (6101 parts) and toluene (23 10 parts) in the presence of benzoyl peroxide (1.2 parts) at 78°–92° C. (The resulting interpolymer has a reduced specific viscosity of 0.91 ).

EXAMPLE (B-6)

The procedure of Example (B-1) is followed except that the styrene-maleic anhydride is prepared by the following procedure: Maleic anhydride (392 parts) is dissolved in benzene (6870 parts). To this mixture there is added styrene (416 parts) at 76° C. whereupon benzoyl peroxide (1.2 pans) is added. The polymerization mixture is maintained at 80°–82° C. for about 5 hours. (The resulting interpolymer has a reduced specific viscosity of 1.24.)

EXAMPLE (B-7)

The procedure of Example (B-1) is followed except that acetone (1340 parts) is used in place of benzene as the polymerization solvent and that azobisisobutyronitrile (0.3 part) is used in place of benzoyl peroxide as a polymerization catalyst.

EXAMPLE (B-8)

An interpolymer (0.86 carboxyl equivalent) of styrene and maleic anhydride (prepared from an equal molar mixture of styrene and maleic anhydride and having a reduced specific viscosity of 0.69) is mixed with mineral oil to form a slurry, and then esterified with a commercial alcohol mixture (0.77 mole; comprising primary alcohols having from 8 to 18 carbon atoms) at 150°–160° C. in the presence of a catalytic amount of sulfuric acid until about 70% of the carboxyl radicals are converted to ester radicals. The partially esterified interpolymer is then further esterified with a n-butyl alcohol (0.31 mole) until 95% of the carboxyl radicals of the interpolymer are converted to the mixed ester radicals. The esterified interpolymer is then treated with aminopropyl morpholine (slight excess of the stoichiometric amount to neutralize the free carboxyl radicals of the interpolymer) at 150°–160° C. until the resulting product is substantially neutral (acid number of 1 to phenolphthalein indicator). The resulting product is mixed with mineral oil so as to form an oil solution containing 34% of the polymeric product.

Examples (B-1) through (B-8) are prepared using mineral oil as the diluent. All of the mineral oil or a portion thereof may be replaced with the triglyceride oil (A). The preferred triglyceride oil is the high oleic sunflower oil.

EXAMPLE (B-9)

Charged to a 12 liter 4 neck flask is 3621 parts of the interpolymer of Example (B-8) as a toluene slurry. The percent toluene is about 76 percent. Stirring is begun and 933 parts (4.3 equivalents) Alfol 1218 alcohol and 1370parts xylene are added. The contents are heated and toluene is removed by distillation. Additional xylene is added in increments of 500, 500, 300 and 300 parts while continuing to remove toluene, the object being to replace the lower boiling toluene with the higher boiling xylene. The removal of solvent is stopped when the temperature of 140° C. is reached. The flask is then fitted with an addition funnel and the condenser is set to reflux. At 140° C., 23.6 parts (0.17 equivalents) methanesulfonic acid in 432 parts (3 equivalents) Alfol 810 alcohol is added in about 20 minutes. The contents are stirred overnight at reflux while collecting water in a Dean Stark trap. Then added is 185 parts (2.5 equivalents) of n-butanol containing therein 3.0 parts (0.02 equivalents) of methanesulfonic acid. This addition occurs over a 60 minute time period. The contents are maintained at reflux for 8 hours and then an additional 60 parts (0.8 equivalents) n-butanol is added and the contents are permitted to reflux overnight. At 142° C. is added 49.5 parts (0.34 equivalents) aminopropylmorpholine in 60 minutes. After a 2 hour reflux 13.6 parts (equivalents) 50% aqueous sodium hydroxide is added over 60 minutes and after an additional 60 minutes of stirring there is added 17 parts of an alkylated phenol.

To a 1 liter flask is added 495 parts of the above esterified product. The contents are heated to 140° C. and 337 parts Sunyl ® 80 is added. Solvent is removed at 155° C. with nitrogen blowing at 1 cubic foot per hour. The final stripping conditions are 155° C. and 20 mm Hg. At 100° C. the contents are filtered using diatomaceous earth. The filtrate is a vegetable oil solution of the nitrogen-containing mixed ester having a nitrogen content of 0.14%.

Examples (B-10) and (B-11 ) employ an interpolymerizable monomer as part of the carboxy-containing interpolymer.

EXAMPLE (B-10)

One mole each of maleic anhydride and styrene and 0.05 moles methyl methacrylate are polymerized in toluene in the presence of benzoyl peroxide (1.5 parts) at 75°-95° C. The resulting interpolymer has a reduced specific viscosity of 0.13 and is a 12% slurry in toluene. Added to a 2 liter 4 neck flash is 868 parts (1 equivalent) of the polymer along with 68 parts (0.25 equivalents) oleyl alcohol, 55 parts (0.25 equivalents) Neodol 45, 55 parts (0.25 equivalents) Alfol 1218 and 36 parts (0.25 equivalents) Alfol 8-10. The contents are heated to 115° C. and added is 2 parts (0.02 moles) methanesulfonic acid. After a 2 hour reaction period, toluene is distilled off. With a neutralization number of 18.7 to phenolphthalein (indicating an 89% esterification), 15 parts (0.20 equivalents) n-butanol is added dropwise over 5 hours. The neutralization number/esterification level is 14.0/92.5%. Then added is 1.6 parts (0.02 moles) 50% aqueous sodium hydroxide to neutralize the catalyst. This is followed by the addition of 5.5 parts (0.038 equivalents) of aminopropylmorpholine and 400 parts Sunyl ®80. The contents are vacuum stripped to 15 millimeters mercury at 100° C. and filtered using a diatomaceous earth filter aid. The filtrate is the product containing 0.18 percent nitrogen and 54.9 percent Sunyl ®80.

The following example is similar to Example (B-10) but employs different alcohols and different levels in a different order of addition.

EXAMPLE (B-11)

Added to a 2 liter 4 neck flask is 868 parts (1 equivalent) of the polymer of Example (B-10), 9.25 parts (0.125 equivalents) isobutyl alcohol, 33.8 parts (0.125 equivalents) oleyl alcohol, 11 parts each (0.125 equivalents) of 2-methyl-1-butanol, 3-methyl-l-butanol and 1-pentanol, 23.4 parts (0.125 equivalents) hexyl alcohol, and 16.25 parts each (0.125 equivalents) 1-octanol and 2-octanol. At 110° C. 2 parts (0.02 moles) methanesulfonic acid is added. One hour later toluene is distilled off and when the distillation is complete, the neutralization number/esterification level is 62.5/70 percent. At 140° C. 31.2 parts (0.43 equivalents) n-butanol is added dropwise over 28 hours and the neutralization number/esterification level is 36.0/79.3 percent. At 120° C. 0.3 parts (0.03 moles) methanesulfonic acid is added followed by 20.4 parts (0.20 equivalents) hexyl alcohol. After esterification the neutralization number/esterification level is 10.5/95 percent. Then added is 1.9 parts (0.023 moles) of 50% sodium hydroxide followed by 5.9 parts (0.04 equivalents aminopropylmorpholine and 400 parts Sunyl ®80. The contents are filtered and the product has a nitrogen analysis of 0.18 percent.

Acrylate Polymers

In another aspect Component (B) is at least one hydrocarbon-soluble acrylate polymer of the formula

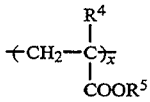

wherein $R^4$ is hydrogen or a lower alkyl group containing from 1 to about 4 carbon atoms, $R^5$ is a mixture of alkyl, cycloalkyl or aromatic groups containing from about 4 to about 24 carbon atoms, and x is an integer providing a weight average molecular weight (Mw) to the acrylate polymer of about 5000 to about 1,000,000.

Preferably $R^4$ is a methyl or ethyl group and more preferably, a methyl group. $R^5$ is primarily a mixture of alkyl groups containing from 4 to about 18 carbon atoms. In one embodiment, the weight average molecular weight of the acrylate polymer is from about 100,000 to about 1,000,000 and in other embodiments, the molecular weight of the polymer may be from 100,000 to about 700,000 and 300,000 to about 700,000.

Specific examples of the alkyl groups $R^5$ which may be included in the polymers of the present invention include, for example, n-butyl, octyl, decyl, dodecyl, tridecyl, octadecyl, hexadecyl, octadecyl. The mixture of alkyl groups can be varied so long as the resulting polymer is hydrocarbon-soluble.

The following examples are illustrative of the preparations of the acrylate polymers of the present invention. All parts and percentages are by weight unless indicated to the contrary.

EXAMPLE (B-12)

Added to a 2 liter 4 neck flask is 50.8 parts (0.20 moles) lauryl methacrylate, 44.4 parts (0.20) isobornyl methacrylate, 38.4 parts (0.20 moles) 2-phenoxy ethyl acrylate, 37.6 parts (0.20 moles) 2-ethylhexyl acrylate, 45.2 parts (0.20 moles) isodecyl methacrylate and 500 parts toluene. At 100° C. 1 parts Vazo® 67 (2,2'azobis(2-methylbutyronitrile)) in 20 parts toluene is added over 7 hours. The reaction is held at 100° C. for 16 hours after which the temperature is increased to 120° C. to remove toluene and added is 216 parts of Sunyl®80. Volatiles are removed by vacuum distillation at 20 millimeters mercury at 140° C. The contents are filtered to give the desired product.

EXAMPLE (B-13)

Added to a 2 liter 4 neck flask is 38.1 parts (0.15 moles) lauryl methacrylate, 48.6 pans (0.15 moles) stearyl acrylate, 28.2 parts (0.15 moles) 2-ethylhexyl methacrylate, 25.5 parts (0.15 moles) tetrahydrofurfuryl methacrylate, 33.9 parts (0.15 moles) isodecyl methacrylate and 500 parts toluene. At 100° C. 1 part Vazo® 67 in 20 parts toluene is added dropwise in 6 hours. After the addition is complete, the reaction mixture is held at 100° C. for 15.5 hours, toluene is distilled out and 174 parts Sunyl®80 is added. The contents are vacuum stripped at 140° C. at 20 millimeters of mercury and filtered to give the desired product.

An example of a commercially available methacrylate ester polymer which has been found to be useful in the present invention is sold under the tradename of "Acryloid 702" by Rohm and Haas, wherein $R^5$ is predominantly a mixture of n-butyl, tridecyl, and octadecyl groups. The weight average molecular weight (Mw) of the polymer is about 404,000 and the number average molecular weight (Mn) is about 118,000. Another commercially available methacrylate polymer useful in the present invention is available under the tradename of "Acryloid 954" by Rohm and Haas, wherein $R^5$ is predominantly a mixture of n-butyl, decyl, tridecyl, octadecyl, and tetradecyl groups. The weight average molecular weight of Acryloid 954 is found to be about 440,000 and the number average molecular weight is about 111,000. Each of these commercially available methacrylate polymers is sold in the form of a concentrate of about 40% by weight of the polymer in a light-colored mineral lubricating oil base. When the polymer is identified by the tradename, the amount of material added is intended to represent an amount of the commercially available Acryloid material including the oil.

Other commercially available polymethacrylates are available from Rohm and Haas Company as Acryloid 1253, Acryloid 1265, Acryloid 1263, Acryloid 1267, from Rohm GmbH as Viscoplex 0-410, Viscoplex 10-930, Viscoplex 5029, from Societe Francaise D'Organo-Synthese as Garbacryl T-84, Garbacryl T-78S, from Texaco as TLA 233, TLA 5010 and TC 10124. Some of these polymethacrylates may be PMA/OCP (olefin copolymer) type polymers.

Nitrogen-Containing Polyacrylate Esters

Component (B) may also be a nitrogen-containing polyacrylate ester prepared by reacting an acrylate ester of the formula

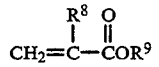

wherein $R^8$ is hydrogen or an alkyl group containing from 1 to about 4 carbon atoms and $R^9$ is an alkyl, cycloalkyl or aromatic group containing from 4 to about 24 carbon atoms with a nitrogen containing compound. For each mole of the acrylate ester from 0.001–1.0 moles of the nitrogen containing compound is employed. The reaction is carried out at a temperature of from 50° C. up to about 250° C. Non-limiting examples of nitrogen containing compounds are 4-vinylpyridine, 2-vinylpyridine, 2-n-morpholinoethyl methacrylate, N,N-dimethylaminoethyl methacrylate, and N,N-dimethylaminopropyl methacrylate.

The following example is illustrative of the preparation of the nitrogen-containing polymethacrylate. All parts and percentages are by weight unless indicated otherwise.

EXAMPLE (B-14)

Added to a 2 liter 4 neck flask is 50.8 parts (0.2 moles) lauryl methacrylate, 4.4 parts (0.20 moles) isobornyl methacrylate, 38.4 parts (0.20 moles) 2-phenoxyethyl acrylate, 37.6 parts (0.20 moles) 2-ethylhexyl acrylate, 45.2 parts (0.20 moles) isodecyl methacrylate, 21 parts (0.20 moles) 4-vinylpyridine and 500 parts toluene. At 100° C. 1 part Vazo 67 in 20 parts toluene is added dropwise in 8 hours. After maintaining the temperature at 100° C. for an additional 20 hours, an additional 0.5 parts Vazo 67 in 10 parts toluene is added in 3 hours. Toluene is then removed by distillation, 235 parts Sunyl®80 is added and the contents are vacuum stripped to 25 millimeters mercury at 140° C. The contents are filtered to give a product with 0.71 percent nitrogen.

A few companies that make nitrogen-containing polyacrylates are Rohm and Haas, Rohm GmbH, Texaco, Albright & Wilson, Societe Francaise and D'Organo-Synthese (SFOS).

Methylene Linked Aromatic Compounds

Another PPD having utility in this invention is a mixture of compounds having the general structural formula:

$$Ar—(R^6)—[—Ar^1R^7)]_nAr^n$$

wherein the Ar, Ar' and Ar'' are independently an aromatic moiety and each aromatic moiety is substituted with 0 to 3 substituents (the preferred aromatic precursor being naphthalene), $R^6$ and R 7 are independently straight or branch chain alkylenes containing 1 to 100 carbon atoms and n is 0 to 1000.

This PPD is characterized by the presence of compounds over a wide molecular weight range. The molecular weight of compounds in the composition of the invention could vary from that of a simple unsubstituted benzene to a polymer of 1000 monomers of trisubstituted naphthalenes linked by alkylenes containing as many as 100 carbon atoms with the substituents of the naphthalene containing 1 to 50 carbon atoms.

The substituents for the aromatic moieties are obtained from olefins and/or chlorinated hydrocarbons.

The useful olefins include 1-octene, 1-decene, and alpha-olefins of chain lengths $C_{12}$, $C_{14}$, $C_{16-18}$, $C_{15-20}$, $C_{20-24}$, $C_{24-28}$. More preferably the invention process is carried out with olefins which are mixtures of the above. A good example would be the $C_{15-20}$ cracked wax olefins, or a mixture of 1-octene and $C_{16-18}$ alpha olefin.

The chlorinated hydrocarbons might contain from 1–50 carbon atoms and from about 2 to about 84% chlorine by weight. Preferred chlorinated hydrocarbons are obtained by chlorinating slack waxes or paraffinic waxes of $C_{18-30}$ chain length so that they contain from 5–50% chlorine by weight. A particularly preferred chlorinated hydrocarbon, being one of about 24 carbons containing about 2.5 chlorines per 24 carbon atoms.

Although Ar, Ar′ and Ar″ may be any aromatic containing 1 to 3 aromatic rings, it is preferable if Ar, Ar′ and Ar″ are all the stone. Further, it is preferable if Ar, Ar′ and Ar″ are fused benzene rings, i.e., when two or three benzene rings are present, the adjoining rings share two carbon atoms. Most preferably, Ar, Ar′ and Ar″ are all derived from naphthalene.

Aromatics which might be precursors of Ar, Ar′ and Ar″ include benzene, biphenyl, diphenyhmethane, triphenyhmethane, aniline, diphenylamine, diphenylether, phenol, naphthalene, anthracene and phenanthrene. Naphthalene is particularly preferred.

Although the aromatic groups of the general formula above can contain 0 to 3 substituents, the composition will contain compounds with one or two substituents and will preferably include compounds with two substituents. The substituents may be derived from any olefin (preferably an alpha olefin containing 8 to 30 carbon atoms) or derived from a chlorinated hydrocarbon containing 8 to 50 carbon atoms (preferably a chlorinated hydrocarbon derived from a hydrocarbon wax containing 22–26 carbon atoms). In addition to or in place of forming the substituents, the olefin and/or chlorinated hydrocarbon may form the alkylene linking group ($R^6$ and $R^7$ group) of the general structural formula. Compositions of the invention might include compounds wherein each of the naphthalene groups is substituted with one alkyl group containing 16 to 18 carbon atoms and one derived from a chlorinated hydrocarbon containing about 24 carbon atoms with about 2.5 chlorine atoms present for each 24 carbon atoms.

The desired material is a mixture of products which include alkylated naphthalenes, coupled and bridged naphthalenes, oligomers and dehydrohalogenated waxes. The mw distribution of the final product is a more useful characterization of the final product. A useful mw range is from 300–2000. A more useful mw range is from 300 to 10,000. A preferred distribution is from 400 to 112,000. The most useful distribution is from about 300 to about 300,000.

The methylene linked aromatic compound PPD is produced according to the following general process:

(a) providing aromatic compounds containing 1 to 3 aromatic rings which compounds are substituted with 0 to 3 substituents, the compounds being precursors for aromatic moieties Ar, Ar′ and Ar″ in a reactor;

(b) adding a FRIEDEL-CRAFTS or Lewis Acid catalyst to the reactor;

(c) adding a chlorinated hydrocarbon to the reactor;

(d) adding an olefin to the reactor and (e) adding $CH_2Cl_2$ to the reactor wherein step (e) is carried out prior to or concurrently with at least one step of (a)-(d).

As indicated above, the aromatic compounds forming Ar, Ar′ and Ar″ groups in the compound of the general formula are preferably naphthalene. If the aromatic compound is substituted, it is substituted with an alkyl or alkenyl, either of which may be chlorine substituted, branched or straight chain. Accordingly, in accordance with one embodiment of the process of the present invention, naphthalene is mixed with methylene chloride in a reaction flask. At this point, the methylene chloride acts as a solvent. A FRIEDEL-CRAFTS or Lewis Acid catalyst is then added to the mixture. The catalyst is preferably in the form of $AlCl_3$. After adding the catalyst, a chlorinated hydrocarbon (most preferably one containing 22–26 carbons) is added to the reaction flask and a reaction occurs between the naphthalene and the chlorinated hydrocarbon wax such that the naphthalene is substituted with an alkyl group derived from the chlorinated hydrocarbon wax. Furthermore, linking will occur between naphthalene compounds via methylene group as shown within the general structural formula ($R^6$) or ($R^7$) is $CH_2$.

The mixture is then preferably cooled to a temperature in the range of 0° to 5° C. While continuing to cool the vessel, an olefin (preferably an alpha-olefin containing 8 to 30 carbon atoms) is added slowly so that the temperature is continually maintained in the range of 0° C. to 5° C. Alkylation of the naphthalene compounds occurs so that the naphthalenes are substituted with an alkyl group derived from said olefin. The catalyst is decomposed and is neutralized with a base such as lime after which stirring is continued while the temperature is raised first to 60° C. and then to 120° C. to remove the volatile components of the reaction mixture. The mixture is filtered and the desired product is isolated.

Chlorinated hydrocarbons which may form a substituent on one or more of the aromatic moieties may contain 1 to about 50 carbon atoms. If a chlorinated hydrocarbon containing 50 carbon atoms forms a substituent and is linked to another 50 carbon atom substituent on another aromatic moiety, the aromatic moieties will be linked by an alkylene containing 100 carbons, i.e., ($R^6$) or ($R^7$) is about 100 carbon atoms. However, the aromatic moieties Ar may be linked by a single $CH_2$, i.e., an alkylene containing a single carbon atom wherein ($R^6$) or ($R^7$) is $CH_2$.

The general process for producing this PPD can be carried out over a wide range of ratios of components. To describe the ratio of the components added in steps (a), (b), (c), (d) and (e) the components will be referred to respectively by the letters (a′), (b′), (c′), (d′) and (e′). All that is necessary is that (e′) be present in sufficient amount so that at least some methylene linking occurs between components (a′) and/or that (b′), (c′) and (d′) be present in sufficient amounts so that there is at least some substitution of (a′) by (c′) and (d′) as catalyzed by (b′). The components (a′), (b′), (c′), (d′) and (e′) might be present in weight ratios of (a′):(b′):(c′):(d′):(e′) in the ranges of about (1):(0.01–1):(0.5–6):(0.5–22):(1–40) and most preferably (1):(0.2):(3):(11):(20); all ratios are in parts by weight.

The process can be carded out over a wide range of temperatures above the freezing point and up to the boiling points of the reaction mixture present at any point in steps (a)-(e). The boiling point of (e′), i.e., methylene chloride is about 40° C., however, the maximum reaction temperature may be higher or lower than 40° C. at atmospheric pressure due to the presence of other reactants. The process has been carried out at subatmospheric or superatmospheric pressure.

EXAMPLE B-10

Naphthalene is mixed with seven parts of $CH_2Cl_2$ and 0.2 parts of $AlCl_3$. Chlorinated hydrocarbon (2.7 parts) is added slowly into the reaction mixture at 15° C. The reaction mixture is held for 5 hours at ambient temperature or until the release of HCl is complete. The mixture is then cooled to about 5° C. and 7.3 parts of an alpha olefin mixture is added over 2 hours while maintaining the temperature of the reaction mixture between 0° and 10° C.

The catalyst is decomposed by the careful addition of 0.8 parts 50% aqueous NaOH. The aqueous layer is separated and the organic layer is purged with $N_2$ and heated to 140° C. and 3 mm Hg to remove the volatiles. The residue is filtered to yield 97% of the theoretical yield weight of the product.

(C) The Performance Additive

In addition to components (A) and (B) the compositions of this invention may also include (C) a performance additive. The performance enhanced by these additives in the areas of anti-wear, oxidation inhibition, rust/corrosion inhibition, metal passivation, extreme pressure, friction modification, viscosity modification, foam inhibition, emulsification, demulsification, lubricity, dispersancy and detergency and the like.

The performance additive (C) is selected from the group consisting of (1) an alkyl phenol,
(2) a metal deactivator,
(3) a metal overbased composition,
(4) a carboxylic dispersant
(5) a nitrogen-containing organic composition,
(6) a zinc salt,
(7) a sulfurized composition,
(8) a viscosity index improver, and
(9) an aromatic amine.

(C-1) The Alkyl Phenol

Component (C-1) is an alkyl phenol of the formula

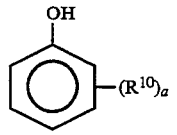

wherein $R^{10}$ is an alkyl group containing from 1 up to about 24 carbon atoms and a is an integer of from 1 up to 5. Preferably $R^{10}$ contains from 4 to 18 carbon atoms and most preferably from 4 to 12 carbon atoms. $R^{10}$ may be either straight chained or branched chained and branched chained is preferred. The preferred value for a is an integer of from 1 to 4 and most preferred is from 1 to 3. An especially preferred value for a is 2. When a is not 5, it is preferred that the position para to the OH group be open.

Mixtures of alkyl phenols may be employed. Preferably the phenol is a butyl substituted phenol containing 2 or 3 t-butyl groups. When a is 2, the t-butyl groups occupy the 2,6-position, that is, the phenol is sterically hindered:

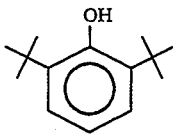

When a is 3, the t-butyl groups occupy the 2,4,6-position.

(C-2) The Metal Deactivator

The metal deactivator is selected from the group consisting of (a) a benzotriazole,
(b) a phosphatide,
(c) a carbamate,
(d) citric acid or its derivative,
(e) a coupled phosphorus-containing amide, or
(f) a methylacrylate derivative (C)(2)(a) The Benzotriazole A useful metal deactivator is benzotriazole compound of the formula

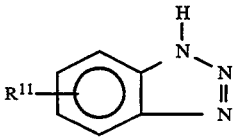

wherein $R^{11}$ is hydrogen a straight or branched-chain alkyl group containing from up to about 24 carbon atoms, preferably 1 to 12 carbon atoms and most preferably 1 carbon atom. When $R^{11}$ is 1 carbon atom the benzotriazole compound is tolyltriazole of the formula

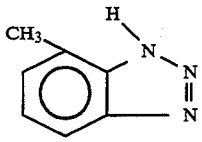

Tolyltriazole is available under the trade name Cobratec TT-100 from Sherwin-Williams Chemical.

CC)(2)(b) The phosphatide

Another metal deactivator are the phosphatides of the formula

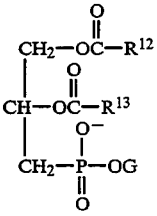

wherein $R^{12}$ and $R^{13}$ are aliphatic hydrocarbyl groups containing from 8 to about 24 carbon atoms and G is selected from the group consisting of hydrogen, $CH_2CH_2\overset{+}{N}H_3$, $-CH_2CH_2\overset{+}{N}(CH_3)_3$ and -continued $$-CH_2\underset{\underset{+NH_3}{|}}{C}HCOOH. \text{ Preferably } -CH_2CH_2\overset{+}{N}(CH_3)_3$$

such that the phosphatide is lecithin. Particularly effective phosphatides are soybean lecithin, corn lecithin, peanut lecithin, sunflower lecithin, safflower lecithin and rapeseed lecithin.

(C)(2)(c) The Carbamate

A third useful metal deactivator are the carbamates of the formula $$R^{14}O\overset{O}{\overset{\|}{C}}NR^{15}R^{16}$$

wherein $R^{14}$ is an alkyl group containing from 1 to about 24 carbon atoms, phenyl or alkyl phenyl wherein the alkyl group contains from 1 to about 18 carbon atoms. Preferably $R^{14}$ is an alkyl group containing from 1 to 6 carbon atoms. The groups $R^{15}$ and $R^{16}$ are hydrogen or an alkyl group containing from 1 to about 6 carbon atoms, with the proviso that $R^{15}$ and $R^{16}$ are not both hydrogen.

(C)(2)(d) The Citric Acid and its Derivatives

A fourth useful metal deactivator is citric acid or derivatives of citric acid of the formula

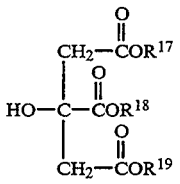

wherein $R^{17}$, $R^{18}$ and $R^{19}$ are independently hydrogen or aliphatic hydrocarbyl groups containing from 1 to about 12 carbon atoms, with the proviso that at least one of $R^{17}$, $R^{18}$ and $R^{19}$ is an aliphatic hydrocarbyl group and preferably contains from 1 to about 6 carbon atoms.

(C)(2)(e) The Coupled Phosphorus-Containing Amide

The fifth useful metal deactivator is a coupled phosphorus-containing amide that is a statistical mixture of compounds having the following formula

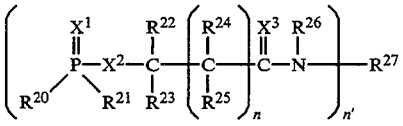

Considering $X^1$ and $X^2$, it independently is oxygen or sulfur and preferably is sulfur whereas $X^3$ is oxygen or sulfur and preferably oxygen. $R^{20}$ and $R^{21}$ each independently is a hydrocarbyl, a hydrocarbyl-based thio or preferably a hydrocarbyl-based oxy group wherein the hydrocarbyl portion contains 6 to 22 carbon atoms. The hydrocarbyl portion of $R^{20}$ and $R^{21}$ generally contains from 4 to about 34 carbon atoms. When $R^{26}$ is hydrogen and $R^{27}$ is methylene, $R^{20}$ and $R^{21}$ will contain 6 to 12 carbon atoms in order to provide for sufficient oil solubility. The hydrocarbyl portion of $R^{20}$ and $R^{21}$ independently can be alkyl or aromatic. Although the hydrocarbyl portion of both $R^{20}$ and $R^{21}$ can be the same type of hydrocarbyl group, that is both alkyl or both aromatic, often one such group can be alkyl and the remaining group can be aromatic. Different coupled phosphorus-containing amide compounds which are made by reacting a mixture of two or more different reactants each containing an alkyl hydrocarbyl group as well as an aromatic hydrocarbyl ($R^{20}$ and $R^{21}$) group therein. The same or different compounds are coupled via different coupling groups $R^{27}$ to form a statistical mixture of coupled compounds or are reacted with different compounds to provide different functional groups $R^{27}$ thereon.

The hydrocarbyl group of $R^{20}$ and $R^{21}$ is preferably an alkyl containing from 6 to 22 (more preferably 8–12) carbon atoms. Examples of such groups include hexyl, heptyl, octyl, nonyl, decyl, dodecyl, tetradecyl, octadecyl, behenyl, and the like, including all isomers thereof. Should the $R^{20}$ or $R^{21}$ hydrocarbyl be an aromatic, it can be phenyl or naphthyl. Often times it will have an alkyl substituent thereon. Thus, the alkyl-substituted aromatic can have an alkyl substituent containing from zero, that is phenyl, to about 28 carbon atoms, and preferably from about 7 to about 12 carbon atoms. Whenever a blend of the compounds of coupled phosphorus-containing amide is utilized containing significant or effective amounts of alkyl type $R^{20}$ or $R^{21}$ substituents, the aromatic substituent can contain preferably from about 6 to about 12 carbon atoms in the alkyl group thereof, that is, the alkyl-substituted aromatic. This is because although the solubility of phenyl or low alkyl-substituted aromatics may be somewhat low, the overall solubility in a lubricant composition is generally increased to a desirable level through the utilization of the $R^{20}$ and $R^{21}$ hydrocarbyl portions which are alkyl and/or through the use of $R^{26}$ and/or $R^{27}$ groups which have a large number of carbon atoms therein. The use of lower alkyls, e.g., less than 6 carbon atoms at $R^{20}$ and $R^{21}$ above with a methylene at $R^{27}$ is undesirable with respect to oil solubility.

Considering now the alkyl-substituted aromatic group, the aromatic preferably is phenyl while the alkyl can be the stone as set forth hereinabove. Specific examples of such alkyl groups on the aromatic nucleus include methyl, ethyl, propyl, butyl, pentyl, heptyl, octyl, decyl, behenyl, and the like including isomers thereof.

Accordingly, specific examples of mixed hydrocarbyl ($R^{20}$ and $R^{21}$)portions of substituents include tolyl and octyl, tolyl and hexyl, isobutylphenyl and amyl, phenyl and isooctyl, and the like. Mixed hydrocarbyl ($R^{20}$ and $R^{21}$) substituents are also assured when cresylic acids are utilized to form the phosphorus portion of the coupled phosphorus-containing amide compound. The sources, type and variety of cresylic acids are known to those skilled in the art. The number of different molecular entities in the mixture is further increased by the different coupling groups, $R^{27}$ as defined above for coupled phosphorus-containing amide when n′ is 2 or 3.

When $X^1$ and $X^2$ is sulfur and especially when $X^2$ is sulfur, the alkyl hydrocarbyl substituent ($R^{20}$ or $R^{21}$) contains 6 or more carbon atoms. However, when $X^1$ or $X^2$ is oxygen and especially when $X^2$ is oxygen, the alkyl hydrocarbyl substituent ($R^{20}$ or $R^{21}$) is 6 to 12 carbon atoms.

Considering $R^{22}$, $R^{23}$, $R^{24}$ and $R^{25}$, each independently can be hydrogen or a saturated hydrocarbyl having up to 22 carbon atoms. The saturated hydrocarbyl group can be an alkyl having from 1 to 22 carbon atoms, a cycloalkyl having from 4 to 22 carbon atoms, or an aromatic, an aromatic-substituted alkyl or an alkyl-substituted aromatic having from 6 to about 34 carbon atoms. Preferably, $R^{22}$, $R^{23}$, $R^{24}$ and $R^{25}$ is hydrogen or methyl with hydrogen being highly preferred. Examples of specific $R^{22}$, $R^{23}$, $R^{24}$ and $R^{25}$ alkyl groups include methyl, ethyl, propyl, butyl, pentyl, hexyl, heptyl, octyl, nonyl, decyl, dodecyl, tetradecyl, etc., as well as isomers thereof whereas examples of specific aromatic groups include phenyl, tolyl, naphthyl, heptylphenyl, nonylphenyl, dodecylphenyl, wax-substituted phenyl, and the like. With regard to the $R^{24}$-C-$R^{25}$ group, n can be zero or 1. Preferably n is 1.

Considering now the amide portion of the molecule, $R^{23}$ is hydrogen or an alkyl having from 1 to 22 carbon atoms with hydrogen being highly preferred. Examples os specific alkyl groups include methyl, ethyl, propyl, butyl, and so forth including the various isomers thereof.

A particularly preferred embodiment of (C)(2)(e) includes a statistical mixture (i.e., coupled and uncoupled compounds each with different substituent groups providing a variety of different compounds) of different phosphorus containing amide compounds bonded to or couple by different $R^{27}$groups with the proviso that in general coupled phosphorus-containing amide the mixture includes some compounds wherein n' is 1 and $R^{27}$ is —$CH_2OH$ and also where n' is 2, $R^{27}$ is

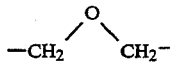

Any such statistical mixture is likely to include some coupled amide compounds of coupled phosphorus-containing amide wherein $R^{27}$ is methylene. When $R^{27}$ is methylene, $R^{20}$ and $R^{21}$ generally must contain more than 6 carbon atoms in order to maintain good oil solubility. When n' is 1, $R^{24}$ is selected from the group consisting of H, —ROH, —ROR, —RSR and $RN(R)_2$ and when n' is 2 or 3, $R^{27}$ is selected from the group consisting of

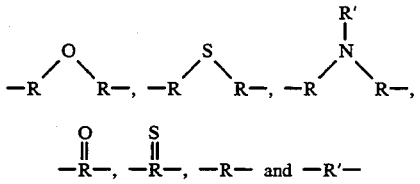

and when n' is 3, $R^{27}$ is

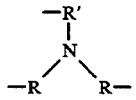

wherein R is independently hydrogen or an alkyl moiety, alkylene or alkylidene of 1 to 12 carbon atoms and R' is hydrogen or an alkyl or carboxy alkyl moiety, alkylene or alkylidene of containing 1 to 60 carbon atoms, R is preferably methylene and R' is preferably an alkyl moiety of 1 to 28 carbons. When R and R' are linking groups, they may be alkylene and/or alkylidene, i.e., the linkage may be vicinal and/or geminal.

The following illustrate the preparation of the coupled phosphorus-containing compounds. All parts and percentages are by weight unless otherwise indicated.

EXAMPLE (C)(2)(e)-1

To a mixture of 1775 parts (4.26 equivalents) of O,O-di-isooctyl phosphorodithioic acid and 980 parts of toluene under a nitrogen atmosphere are added 302 parts (4.26 equivalents) of acrylamide. The reaction mixture exotherms to about 56° C. and 77 parts (2.33 equivalents) of paraformaldehyde and 215 parts (0.11 equivalent) of p-toluenesulfonic acid hydrate are added. Heating is continued at reflux (92°–127° C.) while removing 48 parts of water. Upon cooling the mixture to 100° C., 9.2 parts (0.11 equivalent) of sodium bicarbonate is added and cooling continued to about 30° C. A vacuum is applied (15 mm. Hg) and toluene solvent removed while raising the temperature to 110° C. The residue is filtered through a filter aid and the filtrate is the desired product. The product contains 6.86% P (6.74% theory).

EXAMPLE (C)(2)(e)-2

To a mixture of 1494 parts (3.79 equivalents) of 0,0-di-isooctyl phosphorodithioic acid and 800 parts of toluene under a nitrogen atmosphere are added 537 parts (3.79 equivalents) of 50% aqueous acrylamide solution over a period of one hour. The reaction mixture exotherms to about 53° C. and 64 parts (1.93 equivalents) of paraformaldehyde and 18 parts (0.095 equivalent) of p-toluenesulfonic acid hydrate are added. Heating is continued at reflux (91°–126° C.) for 4 hours while collecting 305 parts of water. The mixture is cooled to about 90° C. and 7.6 parts (0.095 equivalent) of 50% aqueous sodium hydroxide solution are added. Cooling is continued to about 30° C. and a vacuum is applied (15 mm. Hg). Toluene solvent is removed while raising the temperature to 110° C. The residue is filtered through a filter aid and the filtrate is the desired product. The product contains 6.90% P (6.75% theory) and 2.92% N (2.97% theory).

EXAMPLE (C)(2)(e)-3

To a mixture of 984 parts (1.30 equivalents) of O,O-p-di-dodecylphenyl phosphorodithioic acid and 575 parts of toluene under a nitrogen atmosphere are added 100 parts (0.65 equivalent) of methylenebisacrylamide. The reaction mixture exotherms to about 40° C. and is heated at 80°–85° C. for 2 hours. After cooling the mixture to 30° C., a vacuum (15 mm. Hg) is applied and toluene solvent is removed while raising the temperature to 100° C. The residue is filtered through a filter aid and the filtrate is the desired product. The product contains 4.09% P (4.31% theory).

EXAMPLE (C)(2)(e)-4

A reaction vessel is charged with 820 parts of toluene and 930 parts (2.32 equivalents) of a O,O-di-alkyl phosphorodithioic acid prepared from a mixture of 20 mole percent isobutyl alcohol and 80 mole percent 2-ethylhexyl alcohol. To this mixture under a nitrogen atmosphere are added 178.6 parts ( 1.16 equivalents) of methylene-bisacrylamide. The mixture exotherms to about 65 ° C. and is heated at about 80–85° for 2 hours. Upon cooling to 50° C., a vacuum (30 mm. Hg) is applied. Toluene solvent is removed while raising the temperature to 115° C. The residue is filtered through a filter aid and the filtrate is the desired product. The product contains 7.30% P (7.28% theory).

EXAMPLE (C)(2)(e)-5

To a mixture of 305 parts of toluene and 611 parts (1.82 equivalents) of a O,O-di-alkyl-substituted phosphoro-dithioic acid prepared from a mixture of 20 mole percent phenol and 80 mole percent i-octyl alcohol, are added 258 parts (1.82 equivalents) of a 50% aqueous acrylamide solution over a 20-minute period under a nitrogen atmosphere. After an initial exotherm to 60° C., 32.1 parts (0.97 equivalent) of paraformaldehyde and 7.3 pans (0.038 equivalent) of p-toluenesulfonic acid hydrate are added. The mixture is heated at reflux (91°–127° C.) for 2 hours while removing 131 parts of water. The mixture is cooled to 80° C. and 3.1 parts (0.038 equivalent) of 50% aqueous sodium hydroxide solution is added. Cooling is continued to 50° C. and a vacuum (30 mm. Hg) is applied. Toluene solvent is removed while raising the temperature to 110° C. The residue is filtered through a filter aid and the filtrate is the desired product. The product contains 7.09% P (7.42% theory).

EXAMPLE (C)(2)(e)-6

To 1017 parts (3.0 equivalents) of O,O-di-4-methyl-2-pentyl phosphorodithioic acid under nitrogen is added 213 parts (3.0 equivalents) of acrylamide. The reaction exotherms to 65° C. and held for one to three hours at 65°–75° C. The product is filtered through a filter aid and the filtrate is the desired product. The product contains 7.65% P (7:82% theory), 3.51% N (3.50% theory), and 16.05% S ( 16.06% theory).

EXAMPLE (C)(2)(e)-7

To 614 parts (1.5 equivalents) of O,O-di-iso-octyl phosphorodithioic acid under nitrogen is added 213 parts (1.5 equivalents) of a 50% aqueous acrylamide solution. The reaction exotherms to 65° C. and held for two hours at 70° C. A vacuum is applied (20 mm. Hg) while raising temperature to 90° C. The residue is filtered through a filter aid and the filtrate is the desired product. The product contains 6.67% P (6.60% theory), 2.94% N (2.97% theory), and 14.50% S (13.60% theory).

EXAMPLE (C)(2)(e)-8

To 1340 parts (3.41 equivalents) of O,O-di-isooctyl phosphorodithioc acid under nitrogen is added 242 parts (3.41 equivalents) of acrylamide. The reaction exotherms to 60° C. and is held at 65°–70° C. for one hour. To this mixture are added 400 parts of toluene, 14 parts of potassium carbonate, and 307 parts (3.58 equivalents) of 35% aqueous formaldehyde. The mixture is heated under a nitrogen atmosphere at 35°–40° C. for 16 hours. To this mixture is added 18.2 parts of glacial acetic acid.

EXAMPLE (C)(2)(e)-9

From the product of Example (C)(2)(e)-8 water is removed using a Dean Stark trap at reflux for 6 hours. After 234 parts of water is collected (temperature is 120° C.), the mixture is cooled to 30° C. A vacuum is applied (30 mm. Hg) while raising temperature to 115° C. The mixture is filtered through a filter aid and the filtrate is the desired product. The product contains 6.71% phosphorus.

(C)(2)(f) The Methylacrylate Derivative

The last remaining metal deactivator is a methylacrylate derivative formed by the reaction of equal molar amounts of a phosphorus acid of the formula

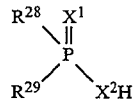

with methylacrylate wherein $X^1$ and $X^2$ are as defined above in (C)(2)(e) and $R^{28}$ and $R^{29}$ are each independently a hydrocarbyl, a hydrocarbyl-based thio or preferably a hydrocarbyl-based oxy group wherein the hydrocarbyl portion contains from 1 to about 30 carbon atoms. Preferably $R^{28}$ and $R^{29}$ are hydrocarbyl-based oxy groups wherein the hydrocarbyl group contains from 1 to 12 carbon atoms and $X^1$ and $X^2$ are sulfur. Since the reaction does not go to completion, the remaining acidity is neutralized with propylene oxide.

In preparing (C)(2)(f), methylacrylate is added to the phosphorus acid and at the end of this addition, propylene oxide is added. Generally one mole of propylene oxide is employed for every 20–25 moles of phosphorus acid.

The following illustrates the preparation of the methylacrylate derivative. All parts and percentages are by weight unless otherwise indicated.

EXAMPLE (C)(2)(f)-1

To 2652 parts (9.04 equivalents) of a O,O-di-alkyl-phosphorodithioic acid prepared from a mixture of 65 mole percent iso-butyl alcohol and 35 mole percent iso-amyl alcohol is added 776 parts (9.04 equivalents) of methyl acrylate. The methyl acrylate addition is done dropwise and the temperature increases from 60° to 93° C. The contents are held at this temperature for 6 hours and then cooled to 35° C. at which 23 parts (0.04 equivalents) propylene oxide is added dropwise. The contents are filtered to give a product having a % phosphorus of 7.54 (8.12% theory).

(C-3) The Metal Overbased Composition

Overbased salts of organic acids are widely known to those of skill in the art and generally include metal salts wherein the amount of metal present in them exceeds the stoichiometric amount. Such salts are said to have conversion levels in excess of 100% (i.e., they comprise more than 100% of the theoretical amount of metal needed to convert the acid to its "normal" "neutral" salt). Such salts are often said to have metal ratios in excess of one (i.e., the ratio of equivalents of metal to equivalents of organic acid present in the salt is greater than that required to provide the normal or neutral salt which required only a stoichiometric ratio of 1:1). They are commonly referred to as overbased, hyperbased or superbased salts and are usually salts of organic sulfur acids, organic phosphorus acids, carboxylic acids, phenols or mixtures of two or more of any of these. As a skilled worker would realize, mixtures of such overbased salts can also be used.

The terminology "metal ratio" is used in the prior art and herein to designate the ratio of the total chemical equivalents of the metal in the overbased salt to the chemical equivalents of the metal in the salt which would be expected to result in the reaction between the organic acid to be overbased and the basically reacting metal compound according to the known chemical reactivity and stoichiometry of the two reactants. Thus, in a normal or neutral salt the metal ratio is one and in an overbased salt the metal ratio is greater than one.

The overbased salts used as (C-3) in this invention usually have metal ratios of at least about 3:1. Typically, they have ratios of at least about 12:1. Usually they have metal ratios not exceeding about 40: 1. Typically salts having ratios of about 12:1 to about 20:1 are used.

The basically reacting metal compounds used to make these overbased salts are usually an alkali or alkaline earth metal compound (i.e., the Group IA, IIA, and IIB metals excluding francium and radium and typically excluding rubidium, cesium and beryllium) although other basically reacting metal compounds can be used. Compounds of Ca, Ba, Mg, Na and Li, such as their hydroxides and alkoxides of lower alkanols are usually used as basic metal compounds in preparing these overbased salts but others can be used as shown by the prior art incorporated by reference herein. Overbased salts containing a mixture of ions of two or more of these metals can be used in the present invention.

These overbased salts can be of oil-soluble organic sulfur acids such as sulfonic, sulfamic, thiosulfonic, sulfinic, sulfonic, partial ester sulfuric, sulfurous and thiosulfuric acid. Generally they are salts of carbocylic or aliphatic sulfonic acids.

The carbocylic sulfonic acids include the mono- or poly-nuclear aromatic or cycloaliphatic compounds. The oil-soluble sulfonates can be represented for the most part by the following formulae:

$$[R_x—T—(SO_3)_y]_zM_b \quad (I)$$

$$[R^{52}(SO_3)_a]_dM_b \quad (II)$$

In the above formulae, M is either a metal cation as described hereinabove or hydrogen; T is a cyclic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, cyclohexane, petroleum naphthenes, decahydro-naphthalene, cyclopentane, etc.: R in Formula I is an aliphatic group such as alkyl, alkenyl, alkoxy, alkoxyalkyl, carboalkoxyalkyl, etc; x is at least 1, and $R_x$ +T contains a total of at least about 15 carbon atoms, $R^{52}$ in Formula II is an aliphatic radical containing at least about 15 carbon atoms and M is either a metal cation or hydrogen. Examples of type of the $R^{52}$ radical are alkyl, alkenyl, alkoxyalkyl, carboalkoxyalkyl, etc. Specific examples of $R^{52}$ are groups derived from petrolatum, saturated and unsaturated paraffin wax, and polyolefins, including polymerized $C_2$, $C_3$, $C_4$, $C_5$, $C_6$, etc., olefins containing from about 15 to 7000 or more carbon atoms. The groups T, R, and $R^{52}$ in the above formulae can also contain other inorganic or organic substituents in addition to those enumerated above such as, for example, hydroxy, mercapto, halogen, nitro, amino, nitroso, sulfide, disulfide, etc. In Formula I, x, y, z and b are at least 1, and likewise in Formula II, a, b and d are at least 1.

Specific examples of sulfonic acids useful in this invention are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax substituted sulfonic and polysulfonic acids of, e.g., benzene, naphthalene, phenol, diphenyl ether, napthalene disulfide, diphenylamine, thiophene, alpha-chloronaphthalene, etc.; other substituted sulfonic acids such as alkyl benzene sulfonic acids (where the alkyl group has at least 8 carbons), cetylphenol mono-sulfide sulfonic acids, dicetyl thianthrene disulfonic acids, dilauryl beta naphthyl sulfonic acid, dicapryl nitronaphthalene sulfonic acids, and alkaryl sulfonic acids such as dodecyl benzene "bottoms" sulfonic acids.

The latter acids derived from benzene which has been alkylated with propylene tetramers or isobutene trimers to introduce 1,2,3, or more branched-chain $C_{12}$ substituents on the benzene ring. Dodecyl benzene bottoms, principally mixtures of mono-and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture-by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 at seq. published by John Wiley & Sons, N.Y. (1969).

Other descriptions of overbased sulfonate salts and techniques for making them can be found in the following U.S. Pat. Nos. 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,297; 2,315,514; 2,319,121; 2,321,022; 2,333,568; 2,333,788; 2,335,259; 2,337,552; 2,346,568; 2,366,027; 2,374, 193 ;2,383,319; 3,312,618; 3,471,403; 3,488,284; 3.595,790; and3,798,012. These are hereby incorporated by reference for their disclosures in this regard.

Also included are aliphatic sulfonic acids such as paraffin wax sulfonic acids, unsaturated paraffin wax sulfonic acids, hydroxy-substituted paraffin wax sulfonic acids, hexapropylene sulfonic acids, tetra-amylene sulfonic acids, polyisobutene sulfonic acids wherein the polyisobutene contains from 20 to 7000 or more carbon atoms, chloro-substituted paraffin wax sulfonic acids, nitroparaffin wax sulfonic acids, etc.; cycloaliphatic sulfonic acids such as petroleum naphthene sulfonic acids, cetyl cyclopentyl sulfonic acids, lauryl cyclohexyl sulfonic acids, bis-(di-isobutyl) cyclohexyl sulfonic acids, etc.

With respect to the sulfonic acids or salts thereof described herein and in the appended claims, it is intended that the term "petroleum sulfonic acids" or "petroleum sulfonates" includes all sulfonic acids or the salts thereof derived from petroleum products. A particularly valuable group of petroleum sulfonic acids are the mahogany sulfonic acids (so called because of their reddish-brown color) obtained as a by-product from the manufacture of petroleum white oils by a sulfuric acid process.

Generally Group IA, IIA and IIB overbased salts of the above-described synthetic and petroleum sulfonic acids are typically useful in making (C-3) of this invention.

The carboxylic acids from which suitable overbased salts for use in this invention can be made include aliphatic, cycloaliphatic, and aromatic mono- and polybasic carboxylic acids such as the napthenic acids, alkyl- or alkenyl-substituted cyclopentanoic acids, alkyl-or alkenyl-substituted cyclohexanoic acids, alkyl- or alkenyl-substituted aromatic carboxylic acids. The aliphatic acids generally contain at least 8 carbon atoms and preferably at least 12 carbon atoms. Usually they have no more than about 400 carbon atoms. Generally, if the aliphatic carbon chain is branched, the acids are more oil-soluble for any given carbon atoms content. The cycloaliphatic and aliphatic carboxylic acids can be saturated or unsaturated. Specific examples include 2-ethylhexanoic acid, a-linolenic acid, propylene-tetramer-substituted maleic acid, behenic acid, isostearic acid, pelargonic acid, capric acid, palmitoleic acid, linoleic acid, lauric acid, oleic acid, ricinoleic acid, undecylic acid, dioctylcyclopentane carboxylic acid, myristic acid, dilauryldecahydronaphthalene carboxylic acid, stearyl-octahydroindene carboxylic acid, palmitic acid, commercially available mixtures of two or more carboxylic acids such as tall oil acids, rosin acids, and the like.

A typical group of oil-soluble carboxylic acids useful in preparing the salts used in the present invention are the oil-soluble aromatic carboxylic acids. These acids are represented by the general formula:

(III)

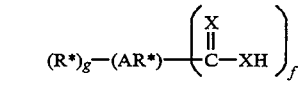

wherein R* is an aliphatic hydrocarbon-based group of at least 4 carbon atoms, and no more than about 400 aliphatic carbon atoms, g is an integer from one to four, Ar* is a polyvalent aromatic hydrocarbon nucleus of up to about 14 carbon atoms, each X is independently a sulfur or oxygen atom, and f is an integer of from one to four with the proviso that R* and g are such that there is an average of at least 8 aliphatic carbon atoms provided by the R* groups for each acid molecule represented by Formula III. Examples of aromatic nuclei represented by the variable Ar* are the polyvalent aromatic radicals derived from benzene, napthalene anthracene, phenanthrene, indene, fluorene, biphenyl, and the like. Generally, the radical represented by Ar* will be a polyvalent nucleus derived from benzene or naphthalene such as phenylenes and naphthylene, e.g., methyphenylenes, ethoxyphenylenes, nitrophenylenes, isopropylenes, hydroxyphenylenes, mercaptophenylenes, N,N-diethylaminophenylenes, chlorophenylenes, N,N-diethylaminophenylenes, chlorophenylenes, dipropoxynaphthylenes, triethylnaphthylenes, and similar tri-, tetra-, pentavalent nuclei thereof, etc.

The R* groups are usually hydrocarbyl groups, preferably groups such as alkyl or alkenyl radicals. However, the R* groups can contain small number substituents such as phenyl, cycloalkyl (e.g., cyclohexyl, cyclopentyl, etc.) and nonhydrocarbon groups such as nitro, amino, halo (e.g., chloro, bromo, etc.),lower alkoxy, lower alkyl mercapto, oxo substituents (i.e., =O), thio groups (i.e., =S), interrupting groups such as —NH—, —O—, —S—, and the like provided the essentially hydrocarbon character of the R* group is retained. The hydrocarbon character is retained for purposes of this invention so long as any non-carbon atoms present in the R* groups do not account for more than about 10% of the total weight of the R* groups.

Examples of R* groups include butyl, isobutyl, pentyl, octyl, nonyl, dodecyl, docosyl, tetracontyl, 5-chlorohexyl, 4-ethoxypentyl, 4-hexenyl, 3-cyclhexyloctyl, 4-(p-chlorophenyl)-octyl, 2,3,5-trimethylheptyl, 4-ethyl-5-methyloctyl, and substituents derived from polymerized olefins such as polychloroprenes, polyethylenes, polypropylenes, polyisobutylenes, ethylenepropylene copolymers, chlorinated olefin polymers, oxidized ethylene-propylene copolymers, and the like. Likewise, the group Ar* may contain non-hydrocarbon substituents, for example, such diverse substituents as lower alkoxy, lower alkyl mercapto, nitro, halo, alkyl or alkenyl groups of less than 4 carbon atoms, hydroxy, mercapto, and the like.

Another group of useful carboxylic acids are those of the formula:

(IV)

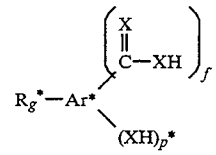

wherein R*, X, Ar*, f and g are as defined in Formula III and p is an integer of 1 to 4, usually 1 or 2. Within this group, an especially preferred class of oil-soluble carboxylic acids are those of the formula:

(V)

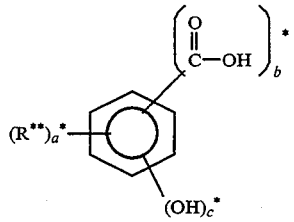

wherein R** in Formula V is an aliphatic hydrocarbon group containing at least 4 to about 400 carbon atoms, a* is an integer of from 1 to 3, b * is 1 or 2, c* is zero, 1, or 2 and preferably 1 with the proviso that R** and a* are such that the acid molecules contain at least an average of about 12 aliphatic carbon atoms in the aliphatic hydrocarbon substituents per acid molecule. And within this latter group of oil-soluble carboxylic acids, the aliphatic-hydrocarbon substituted salicyclic acids wherein each aliphatic hydrocarbon substituent contains an average of at least about 16 carbon atoms per substituent and 1 to 3 substituents per molecule are particularly useful. Salts prepared from such salicyclic acids wherein the aliphatic hydrocarbon substituents are derived from polymerized olefins, particularly polymerized lower 1-mono-olefins such as polyethylene, polypropylene, polyisobutylene, ethylene/propylene copolymers and the like and having average carbon contents of about 30 to about 400 carbon atoms.

The carboxylic acids corresponding to Formulae IV-V above are well known or can be prepared according to procedures known in the art. Carboxylic acids of the type illustrated by the above formulae and processes for preparing their overbased metal salts are well known and disclosed, for example, in such U.S. Pat. Nos. as 2,197,832; 2,197,835; 2,252,662; 2,252,664; 2,714,092; 3,410,798 and 3,595,791 which are incorporated by reference herein for their disclosures of acids and methods of preparing overbased salts.

Another type of overbased carboxylate salt used in making (C-3) of this invention are those derived from alkenyl succinates of the general formula:

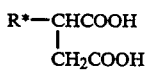

(VI)

wherein R* is as defined above in Formula IV. Such salts and means for making them are set forth in U.S. Pat. Nos. 3,271,130, 3,567,637 and 3,632,510, which are hereby incorporated by reference in this regard.

Other patents specifically describing techniques for making overbased salts of the hereinabove-described sulfonic acids, carboxylic acids, and mixtures of any two or more of these include U.S. Pat. Nos. 2,501,731; 2,616,904; 2,616,905; 2,616,906; 2,616,911; 2,616,924; 2,616,925; 2,617,049; 2,777,874; 3,027,325; 3,256,186; 3,282,835; 3,384,585; 3,373,108; 3,365,296; 3,342,733; 3,320,162; 3,312,618; 3,318,809; 3,471,403; 3,488,284; 3,595,790; and 3,629,109. The disclosures of these patents are hereby incorporated in this present specification for their disclosures in this regard as well as for their disclosure of specific suitable basic metal salts.

In the context of this invention, phenols are considered organic acids. Thus, overbased salts of phenols (generally known as phenates) are also useful in making (B-1) of this invention are well known to those skilled in the art. The phenols from which these phenates are formed are of the general formula:

$$(R^*)_g(Ar^*)—(XH)_f \quad \text{(VII)}$$

wherein R*, g, Ar*, X and f have the same meaning and preferences are described hereinabove with reference to Formula III. The same examples described with respect to Formula III also apply.

A commonly available class of phenates are those made from phenols of the general formula:

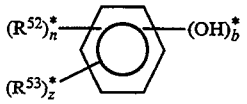

(VIII)

wherein a* is an integer of 1–3, b* is of 1 or 2, z* is 0 or 1, $R^{52}$ in Formula VIII is a hydrocarbyl-based substituent having an average of from 4 to about 400 aliphatic carbon atoms and $R^{53}$ is selected from the group consisting of lower hydrocarbyl, lower alkoxyl, nitro, amino, cyano and halo groups.

One particular class of phenates for use in this invention are the overbased, Group IIA metal sulfurized phenates made by sulfurizing a phenol as described hereinabove with a sulfurizing agent such as sulfur, a sulfur halide, or sulfide or hydrosulfide salt. Techniques for making these sulfurized phenates are described in U.S. Pat. Nos. 2,680,096; 3,036,971; and 3,775,321 which are hereby incorporated by reference for their disclosures in this regard.

Other phenates that are useful are those that are made from phenols that have been linked through alkylene (e.g., methylene) bridges. These are made by reacting single or multi-ring phenols with aldehydes or ketones, typically, in the presence of an acid or basic catalyst. Such linked phenates as well as sulfurized phenates are described in detail in U.S. Pat. No. 3,350,038; particularly columns 6–8 thereof, which is hereby incorporated by reference for its disclosures in this regard.

Generally Group IIA overbased salts of the above-described carboxylic acids are typically useful in making (C-3) of this invention.

Component (C-3) may also be a borated complex of an overboard metal sulfonate, carboxylates or phenate. Borated complexes of this type may be prepared by heating the overboard metal sulfonate, carboxylate or phenate with boric acid at about 50°–100° C., the number of equivalents of boric acid being roughly equal to the number of equivalents of metal in the salt.

The method of preparing metal overbased compositions in this manner is illustrated by the following examples.

EXAMPLE (C-3)-1

A mixture consisting essentially of 480 parts of a sodium petrosulfonate (average molecular weight of about 480), 84 parts of water, and 520 parts of mineral oil is heated at 100° C. The mixture is then heated with 86 parts of a 76% aqueous solution of calcium chloride and 72 parts of lime (90% purity) at 100° C. for two hours, dehydrated by heating to a water content of less than about 0.5%, cooled to 50° C., mixed with 130 parts of methyl alcohol, and then blown with carbon dioxide at 50° C. until substantially neutral. The mixture is then heated to 150° C. to distill off methyl alcohol and water and the resulting oil solution of the basic calcium sulfonate filtered. The filtrate is found to have a calcium sulfate ash content of 16% and a metal ratio of 2.5. A mixture of 1305 parts of the above carbonated calcium petrosulfonate, 930 parts of mineral oil, 220 parts of methyl alcohol, 72 parts of isobutyl alcohol, and 38 parts of amyl alcohol is prepared, heated to 35° C., and subjected to the following operating cycle four times: mixing with 143 parts of 90% commercial calcium hydroxide (90% calcium hydroxide) and treating the mixture with carbon dioxide until it has a base number of 32–39. The resulting product is then heated to 155° C. during a period of nine hours to remove the alcohol and filtered at this temperature. The filtrate is characterized by a calcium sulfate ash content of about 40% and a metal ratio of about 12.2.

EXAMPLE (C-3)-2

A mineral oil solution of a basic, carbonated calcium complex is prepared by carbonating a mixture of an alkylated benzene sulfonic acid (molecular weight of 470) an alkylated calcium phenate, a mixture of lower alcohols (methanol, butanol, and pentanol) and excess lime (5.6 equivalents per equivalent of the acid). The solution has a sulfur content of 1.7%, a calcium content of 12.6% and a base number of 336. To 950 grams of the solution, there is added 50 grams of a polyisobutene (molecular weight of 1000)-substituted succinic anhydride (having a saponification number of 100) at 25° C. The mixture is stirred, heated to 150° C., held at that temperature for 0.5 hour, and filtered. The filtrate has a base number of 315 and contains 35.4% of mineral oil.

EXAMPLE (C-3)-3

To a solution of 790 parts (1 equivalent) of an alkylated benzenesulfonic acid and 71 parts of polybutenyl succinic anhydride (equivalent weight about 560) containing predominantly isobutene units in 176 parts of mineral oil is added 320 parts (8 equivalents) of sodium hydroxide and 640 pans (20 equivalents) of methanol.

The temperature of the mixture increases to 89° C. (reflux) over 10 minutes due to exotherming. During this period, the mixture is blown with carbon dioxide at 4 cfh. (cubic feet/hr.). Carbonation is continued for about 30 minutes as the temperature gradually decreases to 74° C. The methanol and other volatile materials are stripped from the carbonated mixture by blowing nitrogen through it at 2 cfh. while the temperature is slowly increased to 150° C. over 90 minutes. After stripping is completed, the remaining mixture is held at 155°–165° C. for about 30 minutes and filtered to yield an oil solution of the desired basic sodium sulfonate having a metal ratio of about 7.75. This solution contains 12.4% oil.

EXAMPLE (C-3)-4

To a mixture comprising 125 parts of low viscosity mineral oil and 66.5 parts of heptylphenol heated to about 38° C. there is added 3.5 parts of water. Thereafter, 16 parts of paraformaldehyde are added to the mixture at a uniform rate over 0.75 hour. Then 0.5 parts of hydrated lime are added and this mixture is heated to 80° C. over a 1 hour period. The reaction mixture thickens and the temperature rises to about 116° C. Then, 13.8 parts of hydrated lime are added over 0.75 hour while maintaining a temperature of about 800°–90° C. The material is then heated to about 140° C. for 6 to 7 hours at a reduced pressure of about 2–8 torr to remove substantially all water. An additional 40 parts of mineral oil are added to the reaction product and the resulting material is filtered. The filtrate is a concentrated oil solution (70% oil) of the substantially neutral calcium salt of the heptylphenol-formaldehyde condensation product. It is characterized by calcium content of about 2.2% and a sulfate ash content of 7.5%.

EXAMPLE (C-3)-5

A solution of 3192 parts (12 equivalents) of a polyisobutene-substituted phenol, wherein the polyisobutene substituent has a molecular weight of about 175, in 2400 parts of mineral is heated to 70° C. and 502 parts (12 equivalents) of solid sodium hydroxide is added. The material is blown with nitrogen at 162° C. under vacuum to remove volatiles and is then cooled to 125° C. and 465 parts (12 equivalents) of 40% aqueous formaldehyde is added. The mixture is heated to 146° C. under nitrogen, and volatiles are finally removed again under vacuum. Sulfur dichloride, 618 parts (6 equivalents), is then added over 4 hours. Water, 1000 parts, is added at 70° C. and the mixture is heated to reflux for 1 hour. All volatiles are then removed under vacuum at 155° C. and the residue is filtered at that temperature, with the addition of a filter aid material. The filtrate is the desired product (59% solution in mineral oil) containing 3.56% phenolic hydroxyl and 3.46% sulfur.

EXAMPLE (C-3)-6

To a mixture of 3192 parts (12 equivalents) of tetrapropenyl-substituted phenol, 2400 parts of mineral oil and 465 parts (6 equivalents) of 40% aqueous formaldehyde at 82° C., is added, over 45 minutes, 960 parts (12 equivalents) of 50% aqueous sodium hydroxide. Volatile materials are removed by stripping as in Example (C-3)-4, and to the residue is added 618 pans (12 equivalents) of sulfur dichloride over 3 hours. Toluene, 1000 parts, and 1000 parts of water are added and the mixture is heated under reflux for 2 hours. Volatile materials are then removed at 180° C. by blowing with nitrogen and the intermediate is filtered.

To 1950 parts (4 equivalents) of the intermediate thus obtained is added 135 parts of the polyisobutenyl succinic anhydride of Example (C-3)-2. The mixture is heated to 51° C., and 78 parts of acetic acid and 431 pans of methanol are added, followed by 325 parts (8.8 equivalents) of calcium hydroxide. The mixture is blown with carbon dioxide and is finally stripped with nitrogen blowing at 158° C. and filtered while hot, using a filter aid. The filtrate is a 68% solution in mineral oil of the desired product and contains 2.63% sulfur and 22.99% calcium sulfate ash.

EXAMPLE (C-3)-7

A reaction mixture comprising about 512 parts by weight of a mineral oil solution containing about 0.5 equivalent of a substantially neutral magnesium salt of an alkylated salicylic acid wherein the alkyl group has an average of about 18 aliphatic carbon atoms and about 30 parts by weight of an oil mixture containing about 0.037 equivalent of an alkylated benzenesulfonic acid together with about 15 parts by weight (about 0.65 equivalent) of a magnesium oxide and about 250 parts by weight of xylene is added to a flask and heated to a temperature of about 60° C. to 70° C. The reaction mass is subsequently heated to about 85° C. and approximately 60 parts by weight of water are added. The reaction mass is held at a reflux temperature of about 95° C. to 100° C. for about 1½ hours and subsequently stripped at a temperature of 155° C.–160° C., under a vacuum, and filtered. The filtrate comprises the basic carboxylic magnesium salt characterized by a sulfated ash content of 12.35% (ASTM D-874, IP 163), indicating that the salt contains 200% of the stoichiometrically equivalent amount of magnesium.

(C-4) Carboxylic Dispersant Composition

The composition of the present invention comprises (C-4) at least one carboxylic dispersant characterized by the presence within its molecular structure of (i) at least one polar group selected from acyl, acyloxy or hydrocarbyl-imidoyl groups, and (ii) at least one group in which a nitrogen or oxygen atom is attached directly to said group (i), and said nitrogen or oxygen atom also is attached to a hydrocarbyl group. The structures of the polar group (i), as defined by the International Union of Pure and Applied Chemistry, are as follows ($R^{53}$ representing a hydrocarbon or similar group):

Acyl: $R^{53}-\overset{\overset{\displaystyle O}{\|}}{C}-$

Acyloxy: $R^{53}-\overset{\overset{\displaystyle O}{\|}}{C}-O-$

Hydrocarbylimidoyl: $R^{53}-\overset{\overset{\displaystyle NR}{\|}}{C}-$

Group (ii) is preferably at least one group in which a nitrogen or oxygen atom is attached directly to said polar group, said nitrogen or oxygen atom also being attached to a hydrocarbon group or substituted hydrocarbon group, especially an amino, alkylamino-, polyalkylene-amino-, hydroxy- or alkyleneoxy-substituted hydrocarbon group. With respect to group (ii), the dispersants are conveniently classified as "nitrogen-bridged dispersants" and "oxygen-bridged dispersants"

wherein the atom attached directly to polar group (i) is nitrogen or oxygen, respectively.

Generally, the carboxylic dispersants can be prepared by the reaction of a hydrocarbon-substituted succinic acid-producing compound (herein sometimes referred to as the "succinic acylating agent") with at least about one-half equivalent, per equivalent of acid-producing compound, of an organic hydroxy compound, or an amine containing at least one hydrogen attached to a nitrogen group, or a mixture of said hydroxy compound and amine. The carboxylic dispersants (C-4) obtained in this manner are usually complex mixtures whose precise composition is not readily identifiable. The nitrogen-containing carboxylic dispersants are sometimes referred to herein as "acylated amines". The compositions obtained by reaction of the acylating agent and alcohols are sometimes referred to herein as "carboxylic ester" dispersants. The carboxylic dispersants (C-4) are either oil-soluble, or they are soluble in the oil-containing lubricating and functional fluids of this invention.

The soluble nitrogen-containing carboxylic dispersants useful as component (C-4) in the compositions of the present invention are known in the art and have been described in many U.S. patents including

| |
|---|
| 3,172,892 |
| 3,219,666 |
| 3,272,746 |
| 3,316,177 |
| 3,341,542 |
| 3,444,170 |
| 3,454,607 |
| 3,541,012 |
| 3,630,904 |
| 3,787,374 |
| 4,234,435 |

The carboxylic ester dispersants useful as (C-4) also have been described in the prior art. Examples of patents describing such dispersants include U.S. Pat. Nos. 3,381,022; 3,522,179; 3,542,678; 3,957,855; and 4,034,038. Carboxylic dispersants prepared by reaction of acylating agents with alcohols and amines or amino alcohols are described in, for example, U.S. Pat. Nos. 3,576,743 and 3,632,511.

The above U.S. patents are expressly incorporated herein by reference for their teaching of the preparation of carboxylic dispersants useful as component (C-4).

In general, a convenient route for the preparation of the nitrogen-containing carboxylic dispersants (C-4) comprises the reaction of a hydrocarbon-substituted succinic acid-producing compound ("carboxylic acid acylating agent") with an amine containing at least one hydrogen attached to a nitrogen atom (i.e., H-N<). The hydrocarbon-substituted succinic acid-producing compounds include the succinic acids, anhydrides, halides and esters. The number of carbon atoms in the hydrocarbon substituent on the succinic acid-producing compound may vary over a wide range provided that the nitrogen-containing composition (C-4) is soluble in the lubricating compositions of the present invention. Thus, the hydrocarbon substituent generally will contain an average of at least about 30 aliphatic carbon atoms and preferably will contain an average of at least about 50 aliphatic carbon atoms. In addition to the oil-solubility considerations, the lower limit on the average number of carbon atoms in the substituent also is based upon the effectiveness of such compounds in the lubricating oil compositions of the present invention. The hydrocarbyl substituent of the succinic compound may contain polar groups as indicated above, and, providing that the polar groups are not present in proportion sufficiently large to significantly alter the hydrocarbon character of the substituent.

The sources of the substantially hydrocarbon substituent include principally the high molecular weight substantially saturated petroleum fractions and substantially saturated olefin polymers, particularly polymers of mono-olefins having from 2 to 30 carbon atoms. The especially useful polymers are the polymers of 1-mono-olefins such as ethylene, propene, 1-butene, isobutene, 1-hexene, 1-octene, 2-methyl-1-heptene, 3-cyclohexyl-1-butene, and 2-methyl-5-propyl-1-hexene. Polymers of medial olefins, i.e., olefins in which the olefinic linkage is not at the terminal position, likewise are useful. They are illustrated by 2-butene, 2-pentene, and 4-octene.

Also useful are the interpolymers of the olefins such as those illustrated above with other interpolymerizable olefinic substances such as aromatic olefins, cyclic olefins, and polyolefins. Such interpolymers include, for example, those prepared by polymerizing isobutene with styrerie; isobutene with butadiene; propene with isoprene, ethylene with piperylene; isobutene with chloroprene; isobutene with p-methyl styrene; 1-hexene with 1,3-hexadiene; 1-octene with 1-hexene; 1-heptene with 1-pentene; 3-methyl-1-butene with 1-octerie; 3,3-dimethyl-1-pentene with 1-hexene; isobutene with styrerie and piperylene; etc.

The relative proportions of the mono-olefins to the other monomers in the interpolymers influence the stability and oil-solubility of the final products derived from such interpolymers. Thus, for reasons of oil-solubility and stability the interpolymers contemplated for use in this invention should be substantially aliphatic and substantially saturated, i.e., they should contain at least about 80%, preferably at least about 95%, on a weight basis of units derived from the aliphatic mono-olefins and no more than about 5% of olefinic linkages based on the total number of carbon-to-carbon covalent linkages. In most instances, the percentage of olefinic linkages should be less than about 2% of the total number of carbon-to-carbon covalent linkages.

Specific examples of such interpolymers include copolymer of 95% (by weight) of isobutene with 5% of styrene; terpolymer of 98% of isobutene with 1% of piperylene and 1% of chloroprene; terpolymer of 95% of isobutene with 2% of 1-butene and 3% of 1-hexene, terpolymer of 80% of isobutene with 20% of 1-pentene and 20% of 1-octene; copolymer of 60% of 1-hexene and 20% of 1-heptene; terpolymer of 90% of isobutene with 2% of cyclohexene and 8% of propene; and copolymer of 80% of ethylene and 20% of propene.

Another source of the substantially hydrocarbon group comprises saturated aliphatic hydrocarbons such as highly refined high molecular weight white oils or synthetic alkanes such as are obtained by hydrogenation of high molecular weight olefin polymers illustrated above or high molecular weight olefin polymers illustrated above or high molecular weight olefinic substances.

The use of olefin polymers having molecular weights (Mn) of about 700–10,000 is preferred. Higher molecular weight olefin polymers having molecular weights (Mn) from about 10,000 to about 100,000 or higher have been found to impart also viscosity index improving properties to the final products of this invention. The use of such higher molecular weight olefin polymers often is desirable. Preferably the substituent is derived from a polyolefin characterized by an Mn value of about 700 to about 10,000, and an Mw/Mn value of 1.0 to about 4.0.

In preparing the substituted succinic acylating agents of this invention, one or more of the above-described polyalkenes is reacted with one or more acidic reactants selected from the group consisting of maleic or fumaric reactants such as acids or anhydrides. Ordinarily the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acid-producing compounds useful in the present invention. The especially preferred reactants are maleic acid, maleic anhydride, and mixtures of these. Due to availability and ease of reaction, maleic anhydride will usually be employed.

For convenience and brevity, the term "maleic reactant" is often used hereinafter. When used, it should be understood that the term is generic to acidic reactants selected from maleic and fumaric reactants including a mixture of such reactants. Also, the term "succinic acylating agents" is used herein to represent the substituted succinic acid-producing compounds.

One procedure for preparing the substituted succinic acylating agents useful in this invention is illustrated, in part, in U.S. Pat. No. 3,219,666 which is expressly incorporated herein by reference for its teachings in regard to preparing succinic acylating agents. This procedure is conveniently designated as the "two-step procedure". It involves first chlorinating the polyalkene until there is an average of at least about one chloro group for each molecular weight of polyalkene. (For purposes of this invention, the molecular weight of the polyalkene is the weight corresponding to the Mn value.) Chlorination involves merely contacting the polyalkene with chlorine gas until the desired amount of chlorine is incorporated into the chlorinated polyalkene. Chlorination is generally carried out at a temperature of about 75° C. to about 125° C. If a diluent is used in the chlorination procedure, it should be one which is not itself readily subject to further chlorination. Poly- and perchlorinated and/or fiuorinated alkanes and benzenes are examples of suitable diluents.

The second step in the two-step chlorination procedure, for purposes of this invention, is to react the chlorinated polyalkene with the maleic reactant at a temperature usually within the range of about 100° C. to about 200° C. The mole ratio of chlorinated polyalkene to maleic reactant is usually about 1:1. (For purposes of this invention, a mole of chlorinated polyalkene is that weight of chlorinated polyalkene corresponding to the Mn value of the unchlorinated polyalkene.) However, a stoichiometric excess of maleic reactant can be used, for example, a mole ratio of 1:2. If an average of more than about one chloro group per molecule of polyalkene is introduced during the chlorination step, then more than one mole of maleic reactant can react per molecule of chlorinated polyalkene. Because of such situations, it is better to describe the ratio of chlorinated polyalkene to maleic reactant in terms of equivalents. (An equivalent weight of chlorinated polyalkene, for purposes of this invention, is the weight corresponding to the Mn value divided by the average number of chloro groups per molecule of chlorinated polyalkene while the equivalent weight of a maleic reactant is its molecular weight.) Thus, the ratio of chlorinated polyalkene to maleic reactant will normally be such as to provide about one equivalent of maleic reactant for each mole of chlorinated polyalkene up to about one equivalent of maleic reactant for each equivalent of chlorinated polyalkene with the understanding that it is normally desirable to provide an excess of maleic reactant; for example, an excess of about 5% to about 25% by weight. Unreacted excess maleic reactant may be stripped from the reaction product, usually under vacuum, or reacted during a further stage of the process as explained below.

The resulting polyalkene-substituted succinic acylating agent is, optionally, again chlorinated if the desired number of succinic groups are not present in the product. If there is present, at the time of this subsequent chlorination, any excess maleic reactant from the second step, the excess will react as additional chlorine is introduced during the subsequent chlorination. Otherwise, additional maleic reactant is introduced during and/or subsequent to the additional chlorination step. This technique can be repeated until the total number of succinic groups per equivalent weight of substituent groups reaches the desired level.

Another procedure for preparing substituted succinic acid acylating agents useful in this invention utilizes a process described in U.S. Pat. No. 3,912,764 and U.K. Patent 1,440,219, both of which are expressly incorporated herein by reference for their teachings in regard to that process. According to that process, the polyalkene and the maleic reactant are first reacted by heating them together in a "direct alkylation" procedure. When the direct alkylation step is completed, chlorine is introduced into the reaction mixture to promote reaction of the remaining unreacted maleic reactants. According to the patents, 0.3 to 2 or more moles of maleic anhydride are used in the reaction for each mole of olefin polymer; i.e., polyalkylene. The direct alkylation step is conducted at temperatures of 180°-250° C. During the chlorine-introducing stage, a temperature of 160°-225° C. is employed. In utilizing this process to prepare the substituted succinic acylating agents of this invention, it would be necessary to use sufficient maleic reactant and chlorine to incorporate at least 1.3 succinic groups into the final product for each equivalent weight of polyalkene.

Another process for preparing the substituted succinic acylating agents of this invention is the so-called "one-step" process. This process is described in U.S. Pat. Nos. 3,215,707 and 3,231,587. Both are expressly incorporated herein by reference from their teachings in regard to that process.

Basically, the one-step process involves preparing a mixture of the polyalkene and the maleic reactant containing the necessary amounts of both to provide the desired substituted succinic acylating agents of this invention. This means that there must be at least one mole of maleic reactant for each mole of polyalkene in order that there can be at least one succinic group for each equivalent weight of substituent groups. Chlorine is then introduced into the mixture, usually by passing chlorine gas through the mixture with agitation, while maintaining a temperature of at least about 140° C.

A variation of this process involves adding additional maleic reactant during or subsequent to the chlorine introduction but, for reasons explained in U.S. Pat. Nos. 3,215,707 and 3,231,587, this variation is presently not as preferred as the situation where all the polyalkene and all the maleic reactant are first mixed before the introduction of chlorine.

Usually, where the polyalkene is sufficiently fluid at 140° and above, there is no need to utilize an additional substantially inert, normally liquid solvent/diluent in the one-step process. However, as explained hereinbefore, if a solvent/diluent is employed, it is preferably one that resists chlorination. Again, the poly- and perchlorinated and/or -fluorinated alkanes, cycloalkanes, and benzenes can be used for this purpose.

Chlorine may be introduced continuously or intermittently during the one-step process. The rate of introduction of the chlorine is not critical although, for maximum utilization of the chlorine, the rate should be about the same as the rate of consumption of chlorine in the course of the reaction. When the introduction rate of chlorine exceeds the rate of consumption, chlorine is evolved from the reaction mixture. It is often advantageous to use a closed system, including superatmospheric pressure, in order to prevent loss of chlorine so as to maximize chlorine utilization.

The minimum temperature at which the reaction in the one-step process takes place at a reasonable rate is about 140° C. Thus, the minimum temperature at which the process is normally carried out is in the neighborhood of 140° C. the preferred temperature range is usually between about 160°-220° C. Higher temperatures such as 250° C. or even higher may be used but usually with little advantage. In fact, temperatures in excess of 220° C. are often disadvantageous with respect to preparing the particular acylated succinic compositions of this invention because they tend to "crack" the polyalkenes (that is, reduce their molecular weight by thermal degradation) and/or decompose the maleic reactant. For this reason, maximum temperatures of about 200°-210° C. are normally not exceeded. The upper limit of the useful temperature in the one-step process is determined primarily by the decomposition point of the components in the reaction mixture including the reactants and the desired products. The decomposition point is that temperature at which there is sufficient decomposition of any reactant or product such as to interfere with the production of the desired products.

In the one-step process, the molar ratio of maleic reactant to chlorine is such that there is at least about one mole of chlorine for each mole of maleic reactant to be incorporated into the product. Moreover, for practical reasons, a slight excess, usually in the neighborhood of about 5% to about 30% by weight of chlorine, is utilized in order to offset any loss of chlorine from the reaction mixture. Larger amounts of excess chlorine may be used but do not appear to produce any beneficial results.

The molar ratio of polyalkene to maleic reactant preferably is such that there is at least about one mole of maleic reactant for each mole of polyalkene. This is necessary in order that there can be at least 1.0 succinic group per equivalent weight of substituent group in the product. Preferably, however, an excess of maleic reactant is used. Thus, ordinarily about 5% to about 25% excess of maleic reactant will be used relative to that amount necessary to provide the desired number of succinic groups in the product.

The amines which are reacted with the succinic acid-producing compounds to form the nitrogen-containing compositions (C-4) may be monoamines and polyamines. The monoamines and polyamines must be characterized by the presence within their structure of at least one H-H< group. Therefore, they have at least one primary (i.e., $H_2N$-) or secondary amino (i.e., 1 H-N<) group. The amines can be aliphatic, cycloaliphatic, aromatic, or heterocyclic, including aliphatic-substituted cycloaliphatic, aliphatic-substituted aromatic, aliphatic-substituted heterocyclic, cycloaliphatic-substituted aliphatic, cycloaliphatic substituted aromatic, cycloaliphatic-substituted heterocyclic, aromatic-substituted aliphatic, aromatic-substituted cycloaliphatic, aromatic-substituted heterocyclic-substituted alicyclic, and heterocyclic-substituted aromatic amines and may be saturated or unsaturated. The amines may also contain non-hydrocarbon substituents or groups as long as these groups do not significantly interfere with the reaction of the amines with the acylating reagents of this invention. Such non-hydrocarbon substituents or groups include lower alkoxy, lower alkyl mercapto, nitro, interrupting groups such as —O— and —S— (e.g., as in such groups as $—CH_2CH_2—X—CH_2CH_2—$ where X is —O— or —S—). In general, the amine of (C-4) may be characterized by the formula $$R^{39}R^{40}NH$$

wherein $R^{39}$ and $R^{40}$ are each independently hydrogen or hydrocarbon, amino-substituted hydrocarbon, hydroxy-substituted hydrocarbon, alkoxy-substituted hydrocarbon, amino, carbamyl, thiocarbamyl, guanyl and acylhnidoyl groups provided that only one of $R^{39}$ and $R^{40}$ may be hydrogen.

With the exception of the branched polyalkylene polyamine, the polyoxyalkylene polyamines, and the high molecular weight hydrocarbyl-substituted amines described more fully hereafter, the amines ordinarily contain less than about 40 carbon atoms in total and usually not more than about 20 carbon atoms in total.

Aliphatic monoamines include mono-aliphatic and di-aliphatic substituted mines wherein the aliphatic groups can be saturated or unsaturated and straight or branched chain. Thus, they are primary or secondary aliphatic amines. Such amines include, for example, mono- and di-alkyl-substituted amines, mono- and di-alkenyl-substituted amines, and amines having one N-alkenyl substituent and one N-alkyl substituent and the like. The total number of carbon atoms in these aliphatic monoamines will, as mentioned before, normally not exceed about 40 and usually not exceed about 20 carbon atoms. Specific examples of such monoamines include ethylamine, diethylamine, n-butylamine, di-n-butylamine, allylamine, isobutylamine, cocoamine, stearylamine, laurylamine, methyllaurylamine, oleyl-amine, N-methyl-octylamine, dodecylamine, octadecylramine, and the like. Examples of cycloaliphatic-substituted aliphatic amines, aromatic-substituted aliphatic amines, and heterocyclic-substituted aliphatic amines, include 2-(cyclohexyl)-ethylamine, benzylamine, phenethylamine, and 3-(furylpropyl) amine.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclo-hexylamine, dicyclohexylamines, and the like. Examples of aliphatic-substituted, aromatic-substituted, and heterocyclic-substituted cycloaliphatic monoamines include propyl-substituted cyclohexylamines, phenyl-substituted cyclopentylamines, and pyranyl-substituted cyclohexylamine.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di-(paramethyl-phenyl)amine, naphthylamine, N-N-dibutyl aniline, and the like. Examples of aliphatic-substituted, cycloaliphatic-substituted, and heterocyclic-substituted aromatic monoamines are para-ethoxyaniline, para-dodecylaniline, cyclohexyl-substituted naphthylamine, and thienyl-substituted aniline.

The polyamines from which (C-4) is derived include principally alkylene amines conforming for the most part to the formula

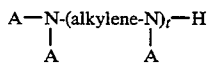

wherein t is an integer preferably less than about 10, A is a hydrogen group or a substantially hydrocarbon group preferably having up to about 30 carbon atoms, and the alkylene group is preferably a lower alkylene group having less than about 8 carbon atoms. The alkylene amines include principally methylene amines, ethylene amines, hexylene amines, heptylene amines, octylene amines, other polymethylene amines. They are exemplified specifically by: ethylene diamine, triethylene tetramine, propylene diamine, decamethylene diamine, octamethylene diamine, di(heptamethylene) triamine, tripropylene tetramine, tetraethylene pentamine, trimethylene diamine, pentaethylene hexamine, di(-trimethylene) triamine. Higher homologues such as are obtained by condensing two or more of the above-illustrated alkylene amines likewise are useful.

The ethylene amines are especially useful. They are described in some detail under the heading "Ethylene Amines" in Encyclopedia of Chemical Technology, Kirk and Othmer, Vol. 5, pp. 898–905, Interscience Publishers, New York (1950). Such compounds are prepared most conveniently by the reaction of an alkylene chloride with ammonia. The reaction results in the production of somewhat complex mixtures of alkylene amines, including cyclic condensation products such as piperazines. These mixtures find use in the process of this invention. On the other hand, quite satisfactory products may be obtained also by the use of pure alkylene amines. An especially useful alkylene amine for reasons of economy as well as effectiveness of the products derived therefrom is a mixture of ethylene amines prepared by the reaction of ethylene chloride and ammonia and having a composition which corresponds to that of tetraethylene pentamine.

Hydroxyalkyl-substituted alkylene amines, i.e., alkylene amines having one or more hydroxyalkyl substituents on the nitrogen atoms, likewise are contemplated for use herein. The hydroxyalkyl-substituted alkylene amines are preferably those in which the alkyl group is a lower alkyl group, i.e., having less than about 6 carbon atoms. Examples of such amines include N-(2-hydroxyethyl)ethylene diamine, N,N'-bis(2-hydroxy-ethyl)-ethylene diamine, 1-(2-hydroxyethyl)piperazine, monohydroxypropyl)piperazine, di-hydroxypropyl-substituted tetraethylene pentamine, N-(3-hydroxypropyl)-tetra-methylene diamine, and 2-heptadecyl-1-(2-hydroxyethyl)-imidazoline.

Higher homologues such as are obtained by condensation of the above illustrated alkylene amines or hydroxy alkyl-substituted alkylene amines through amino radicals or through hydroxy radicals are likewise useful. It will be appreciated that condensation through amino radicals results in a high amine accompanied with removal of ammonia and that condensation through the hydroxy radicals results in products containing ether linkages accompanied with removal of water.

Heterocyclic mono- and polyamines can also be used in making the nitrogen-containing compositions (C-4). As used herein, the terminology "heterocyclic mono- and polyamine(s)" is intended to describe those heterocyclic amines containing at least one primary secondary amino group and at least one nitrogen as a heteroatom in the heterocyclic ring. However, as long as there is present in the heterocyclic mono- and polyamines at least one primary or secondary amino group, the hetero-N atom in the ring can be a tertiary amino nitrogen; that is, one that does not have hydrogen attached directly to the ring nitrogen. Heterocyclic amines can be saturated or unsaturated and can contain various substituents such as nitro, alkoxy, alkyl mercapto, alkyl, alkenyl, aryl, alkaryl, or aralkyl substituents. Generally, the total number of carbon atoms in the substituents will not exceed about 20. Heterocyclic amines can contain hetero atoms other than nitrogen, especially oxygen and sulfur. Obviously they can contain more than one nitrogen hetero atom. The 5- and 6-membered heterocyclic rings are preferred.

Among the suitable heterocyclics are aziridines, azetidines, azolidines, tetra- and di-hydro pydridines, pyrroles, indoles, piperidines, imidazoles, di- and tetrahydroimidazoles, piperazines, isoindoles, purines, morpholines, thiomorpholines, N-aminoalkyhnorpholines, N-aminoalkylthiomorpholines, N-aminoalkylpiperazines, N,N'-di-aminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminiopropylmorpholine, N-aminoethylpiperazine, and N,N'-diaminoethylpiperazine.

The nitrogen-containing composition (C-4) obtained by reaction of the succinic acid-producing compounds and the amines described above may be amine salts, amides, imides, imidazolines as well as mixtures thereof. To prepare the nitrogen-containing composition (C-4), one or more of the succinic acid-producing compounds and one or more of the amines are heated, optionally in the presence of a normally liquid, substantially inert organic liquid solvent/diluent at an elevated temperature generally in the range of from about 80° C. up to the decomposition point of the mixture or the product. Normally, temperatures in the range of about 100° C. up to about 300° C. are utilized provided that 300° C. does not exceed the decomposition point.

The succinic acid-producing compound and the amine are reacted in amounts sufficient to provide at least about one-half equivalent, per equivalent of acid-producing compound, of the amine. Generally, the maximum amount of amine present will be about 2 moles of amine per equivalent of succinic acid-producing compound. For the purposes of this invention, an equivalent of the amine is that amount of the amine corresponding to the total weight of amine divided by the total number of nitrogen atoms present. Thus, octyl amine has an equivalent weight equal to its molecular weight; ethylene diamine has an equivalent weight equal to one-half its molecular weight; and aminoethyl piperazine has an equivalent weight equal to one-third its molecular weight. The number of equivalents of succinic acid-producing compound will vary with the number of succinic groups present therein, and generally, there are two equivalents of acylating reagent for each succinic group in the acylating reagents. Conventional techniques may be used to determine the number of carboxyl functions (e.g., acid number, saponification number) and, thus, the number of equivalents of acylating reagent available to react with amine. Additional details and examples of the procedures for preparing the nitrogen-containing compositions of the present invention by reaction of succinic acid-producing compounds and amines are included in, for example, U.S. Pat. Nos. 3,172,892; 3,219,666; 3,272,746; and 4,234,435, the disclosures of which are hereby incorporated by reference.

Oxygen-bridged dispersants comprise the esters of the above-described carboxylic acids, as described (for example) in the aforementioned U.S. Pat. Nos. 3,381,022 and 3,542,678. As such, they contain acyl or occasionally, acylimidoyl groups. (An oxygen-bridged dispersant containing an acyloxy group as the polar group would be a peroxide, which is unlikely to be stable under all conditions of use of the compositions of this invention.) These esters are preferably prepared by conventional methods, usually the reaction (frequently in the presence of an acidic catalyst) of the carboxylic acid-producing compound with an aromatic compound such as a phenol or naphthol. The preferred hydroxy compounds are alcohols containing up to about 40 aliphatic carbon atoms. These may be monohydric alcohols such as methanol, ethanol, isooctanol, dodecanol, cyclohexanol, neopentyl alcohol, monomethyl ester of ethylene glycol and the like, or polyhydric alcohols including ethylene glycol, diethylene glycol, dipropylene glycol, tetramethylene glycol, pentaerythritol, tris(-hydroxymethyl)aminomethane (THAM), glycerol and the like. Carbohydrates (e.g., sugars, starches, cellulose) are also suitable as are partially esterified derivatives of polyhydric alcohols having at least three hydroxy groups.

The reaction is usually effected at a temperature above about 100° C. and typically at 150°-300° C. The esters may be neutral or acidic, or may contain unesterified hydroxy groups, according as the ratio or equivalents of acid-producing compound to hydroxy compound is equal to, greater than or less than 1:1.

As will be apparent, the oxygen-bridged dispersants are normally substantially neutral or acidic. They are among the preferred ester dispersants for the purposes of this invention.

It is possible to prepare mixed oxygen- and nitrogen-bridged dispersants by reacting the acylating agent simultaneously or, preferably, sequentially with nitrogen-containing and hydroxy reagents may be between about 10:1 and 1:10, on an equivalent weight basis. The methods of preparation of the mixed oxygen- and nitrogen-bridged dispersants are generally the stone as for the individual dispersants described, except that two sources of group (ii) are used. As previously noted, substantially neutral or acidic dispersants are preferred, and a typical method of producing mixed oxygen- and nitrogen-bridged dispersants of this type (which are especially preferred) is to react the acylating agent with the hydroxy reagent first and subsequently react the intermediate thus obtained with a suitable nitrogen-containing reagent in an amount to afford a substantially neutral or acid product.

The following example is illustrative of the process for preparing the carboxylic dispersant compositions useful in this invention:

EXAMPLE (C-4)-1

A polyisobutenyl succinic anhydride is prepared by the reaction of a chlorinated polyisobutylene with maleic anhydride at 200° C. The polyisobutenyl group has an average molecular weight of 850 and the resulting alkenyl succinic anhydride is found to have an acid number of 113 (corresponding to an equivalent weight of 500). To a mixture of 500 grams (1 equivalent) of this polyisobutenyl succinic anhydride and 160 grams of toluene there is added at room temperature 35 grams ( 1 equivalent) of diethylene triamine. The addition is made portionwise throughout a period of 15 minutes, and an initial exothermic reaction caused the temperature to rise to 50° C. The mixture then is heated and a water-toluene azeotrope distilled from the mixture. When no more water distills, the mixture is heated to 150° C. at reduced pressure to remove the toluene. The residue is diluted with 350 grams of mineral oil and this solution is found to have a nitrogen content of 1.6%.

(C-5) The Nitrogen-Containing Organic Composition

A nitrogen-containing organic composition may be utilized comprising (a) an acylated, nitrogen containing compound having a substituent of at least 10 aliphatic carbon atoms made by reacting a carboxylic acylating agent with at least one amino compound containing at least one —NH group, said acylating agent being linked to said amino compound through an imido, amido, amidine or acyloxy ammonium linkage, and (b) at least one amino phenol of the general formula

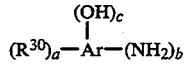

wherein $R^{30}$ is a substantially saturated, hydrocarbon-based substituent of at least 10 aliphatic carbon atoms; a, b and c are each independently an integer of one up to three times the number of aromatic nuclei present in Ar with the proviso that the sum of a, b and c does not exceed the unsaturated valences of Ar; and Ar is an aromatic moiety having 0-3 optional substituents selected from the group consisting of lower alkyl, lower alkoxyl, nitro, halo or combinations of two or more of said substituents.

Within the nitrogen-containing organic composition, the weight ratio of (a):(b) is from (50-95):(50-5), preferably ( 50–75) :(50–25) and most preferably from (50–60):(50–40).

A number of acylated, nitrogen-containing compounds having a substituent $R^{30}$ of at least 10 aliphatic carbon atoms and made by reacting a carboxylic acid acylating agent with an amino compound are known to those skilled in the art. In such compositions the acylating agent is linked to the amino compound through an imidazoline imido, amido, amidine or acyloxy ammonium linkage. The substituent of 10 aliphatic carbon atoms, preferably 30 aliphatic carbon atoms, may be in either the carboxylic acid acylating agent derived portion of the molecule or in the amino compound derived portion of the molecule. Preferably, however, it is in the acylating agent portion. The acylating agent can vary from formic acid and its acylating derivatives to acylating agents having high molecular weight aliphatic substituents of up to 5,000, 10,000 or 20,000 carbon atoms. The amino compounds can vary from ammonia itself to amines having aliphatic substituents of up to about 30 carbon atoms. A more detailed discussion of $R^{3°}$ occurs later in this specification.

A typical class of acylated amino compounds useful in making the compositions of this invention are those made by reacting an acylating agent having an aliphatic substituent of at least 10 carbon atoms and a nitrogen compound characterized by the presence of at least one -NH group. Typically, the acylating agent will be a mono- or polycarboxylic acid (or reactive equivalent thereof) such as a substituted succinic or propionic acid and the amino compound will be a polyamine or mixture of polyamines, most typically, a mixture of ethylene polyamines. The aliphatic substituent $R^{30}$ in such acylating agents is often of at least about 50 and up to about 400 carbon atoms. The aliphatic substituted $R^{30}$ is derived from homopolymerized or interpolymerized $C_{2-10}$ 1-olefins or mixtures of both. Usually $R^{30}$ is derived from ethylene, propylene, butylene and mixtures thereof. Typically, it is derived from polymerized isobutene. Exemplary of amino compounds useful in making these acylated compounds are the following:

(1) polyalkylene polyamines of the general formula $$R^{41}-\underset{\underset{R^{41}}{|}}{N}\left(U-\underset{\underset{R^{41}}{|}}{N}\right)_n R^{41} \qquad \text{Formula IX}$$

wherein each $R^{41}$ is independently a hydrogen atom, a lower alkyl group, a lower hydroxy alkyl group or a $C_{1-12}$ hydrocarbon-based group, with the proviso that at least one $R^{41}$ is a hydrogen atom, n is a whole number of 1 to 10 and U is a $C_{2-10}$ alkylene group, (2) heterocyclic-substituted polyamines of the formula $$R^{41}-\underset{\underset{R^{41}}{|}}{N}\left(U-\underset{\underset{R^{41}}{|}}{N}\right)_m\left(U-N\right)_{m'} U_2Y \qquad \text{Formula X}$$

wherein $R^{41}$ and U are as defined hereinabove, m is 0 or a whole number of 1 to 10, m' is a whole number of 1 to 10 and Y is an oxygen or divalent sulfur atom or a N-$R^{41}$ group and (3) aromatic polyamines of the general formula $$Ar(NR^{41}{}_2)_y \qquad \text{Formula XI}$$

wherein Ar is an aromatic nucleus of 6 to about 20 carbon atoms, each $R^{41}$ is as defined hereinabove and y is 2 to about 8. Specific examples of the polyalkylene polyamines (1) are ethylene diamine, tetra(ethylene)-pentamine, tri(trimethylene)determine, 1,2-propylene diamine, etc. Specific examples of the heterocyclic-substituted polyamines (2) are N-2-aminoethyl piperazine, N-2 and N-3 amino propyl morpholine, N-3-(dimethyl amino) propyl piperazine, etc. Specific examples of the aromatic polyamines (3) are the various isomeric phenylene diamines, the various isomeric naphthylene diamines, etc.

Many patents have described useful acylated nitrogen compounds including U.S. Pat. Nos. 3,172,892; 3,219,666; 3,272,746; 3,310,492; 3,341,542; 3,444,170; 3,455,831;3,455832; 3,576,743; 3,630,904; 3,632,511; and 3,804,763. A typical acylated nitrogen-containing compound of this class is that made by reacting a poly(isobutene)-substituted succinic anhydride acylating agent (e.g., anhydride, acid, ester, etc.) wherein the poly(isobutene) substituent has between about 50 to about 400 carbon atoms with a mixture of ethylene polyamines having 3 to about 7 amino nitrogen atoms per ethylene polyamine and about 1 to about 6 ethylene units made from condensation of ammonia with ethylene chloride. In view of the extensive disclosure of this type of acylated amino compound, further discussion of their nature and method of preparation is not needed here. Instead, the above-noted U.S. Patents are hereby incorporated by reference for their disclosure of acylated amino compounds and their method of preparation. Another type of acylated nitrogen compound belonging to this class is that made by reacting the aforedescribed alkylene amines with the aforedescribed substituted succinic acids or anhydrides and aliphatic mono-carboxylic acids having from 2 to about 22 carbon atoms. In these types of acylated nitrogen compounds, the mole ratio of succinic acid to mono-carboxylic acid ranges from about 1:0.1 to about 1:1. Typical of the mono-carboxylic acid are formic acid, acetic acid, dodecanoic acid, butanoic acid, oleic acid, stearic acid, the commercial mixture of stearic acid isomers known as isostearic acid, tolyl acid, etc. Such materials are more fully described in U.S. Pat. Nos. 3,216,936 and 3,250,715 which are hereby incorporated by reference for their disclosures in this regard.

Still another type of acylated nitrogen compound is the product of the reaction of a fatty monocarboxylic acid of about 12–30 carbon atoms and the aforedescribed alkylene amines, typically, ethylene, propylene or trimethylene polyamines containing 2 to 8 amino groups and mixtures thereof. The fatty monocarboxylic acids are generally mixtures of straight and branched chain fatty carboxylic acids containing 12–30 carbon atoms. A widely used type of acylated nitrogen compound is made by reacting the aforedescribed alkylene polyamines with a mixture of fatty acids having from 5 to about 30 mole percent straight chain acid and about 70 to about 95 percent mole branched chain fatty acids. Among the commercially available mixtures are those known widely in the trade as isostearic acid. These mixtures are produced as a by-product from the dimerization of unsaturated fatty acids as described in U.S. Pat. Nos. 2,812,342 and 3,260,671.

The branched chain fatty acids can also include phenyl and cyclohexyl stearic acid and the chlorostearic acids. Branched chain fatty carboxylic acid-/alkylene polyamine products have been described extensively in the art. See for example, U.S. Pat. Nos. 3,110,673; 3,251,853; 3,326,801; 3,337,459; 3,405,064;

3,429,674; 3,468,639; 3,857,791. These patents are hereby incorporated by reference for their disclosure of fatty acid/polyamine condensates and their use in lubricating oil formulations.

The aromatic moiety, Ar, of the amino phenol can be a single aromatic nucleus such as a benzene nucleus, a pyridine nucleus, a thiophene nucleus, a 1,2,3,4-tetrahydronaphthalene nucleus, etc., or a polynuclear aromatic moiety. Such polynuclear moieties can be of the fused type; that is, wherein at least one aromatic nucleus is fused at two points to another nucleus such as found in naphthalene, anthracene, the azanaphthalenes, etc. Alternatively, such polynuclear aromatic moieties can be of the linked type wherein at least two nuclei (either mono- or polynuclear) are linked through bridging linkages to each other. Such bridging linkages can be chosen from the group consisting of carbon-to-carbon single bonds, ether linkages, keto linkages, sulfide linkages, polysulfide linkages of 2 to 6 sulfur atoms, sulfonyl linkages, sulfonyl linkages, methylene linkages, alkylene linkages, di-(lower alkyl)methylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in Ar between aromatic nuclei. For example, a fluorene nucleus has two benzene nuclei linked by both a methylene linkage and a covalent bond. Such a nucleus may be considered to have 3 nuclei but only two of them are aromatic. Normally, however, Ar will contain only carbon atoms in the aromatic nuclei per se (plus any lower alkyl or alkoxy substituent present).

The number of aromatic nuclei, fused, linked or both, in Ar can play a role in determining the integer values of a, b and c of the amino phenol. For example, when Ar contains a single aromatic nucleus, a, b and c are each independently 1 to 4. When Ar contains two aromatic nuclei, a, b and c can each be an integer of 1 to 8, that is, up to three times the number of aromatic nuclei present (in naphthalene, 2). With a tri-nuclear Ar moiety, a, b and c can each be an integer of 1 to 12. For example, when Ar is a biphenyl or a naphthyl moiety, a, b and c can each independently be an integer of 1 to 8. The values of a, b and c are obviously limited by the fact that their sum cannot exceed the total unsatisfied valences of Ar.

The single ring aromatic nucleus which can be the Ar moiety can be represented by the general formula $$ar(Q)_m$$

wherein ar represents a single ring aromatic nucleus (e.g., benzene) of 4 to 10 carbons, each Q independently represents a lower alkyl group, lower alkoxy group, nitro group, or halogen atom, and m is 0 to 3. As used in this specification and appended claims, "lower" refers to groups having 7 or less carbon atoms such as lower alkyl and lower alkoxyl groups. Halogen atoms include fluorine, chlorine, bromine and iodine atoms; usually, the halogen atoms are fluorine and chlorine atoms.

Specific examples of single ring Ar moieties are the following:

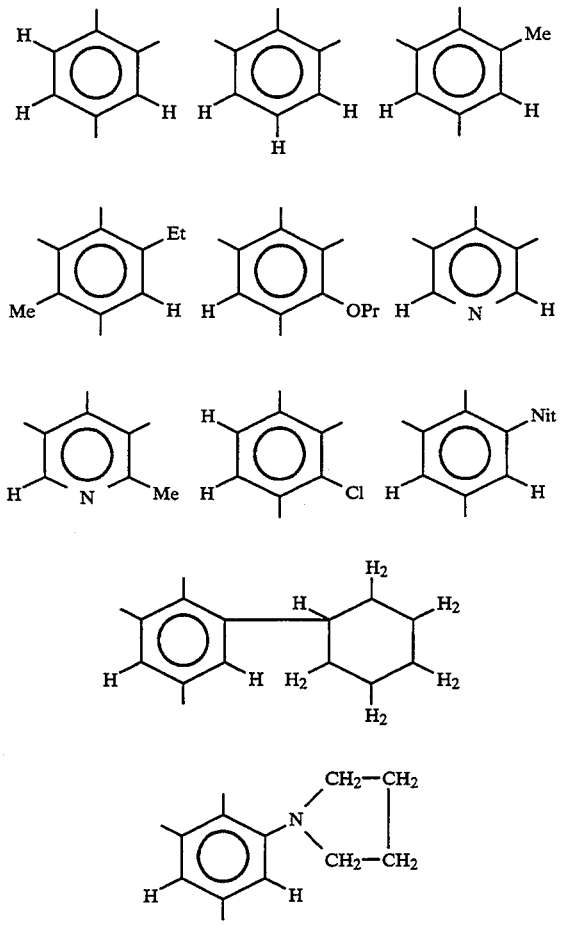

etc. wherein Me is methyl, Et is ethyl, Pr is n-propyl, and Nit is nitro.

When Ar is a polynuclear fused-ring aromatic moiety, it can be represented by the general formula $$\widehat{ar(ar)_{m'}}(Q)_{mm'}$$

wherein ar, Q and m are as defined hereinabove, m' is 1 to 4 and represent a pair of fusing bonds fusing two rings so as to make two carbon atoms part of the rings of each of two adjacent rings. Specific examples of fused ring aromatic moieties Ar are: etc.

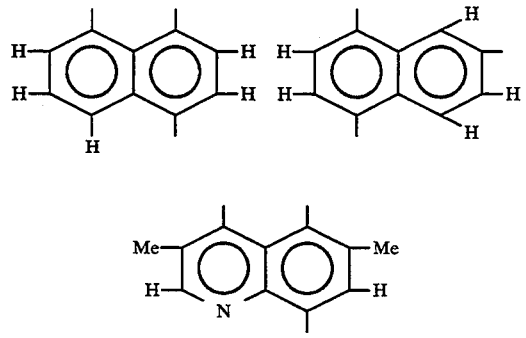

-continued

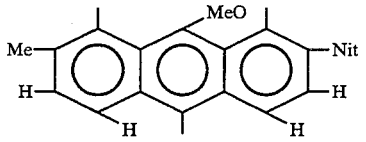

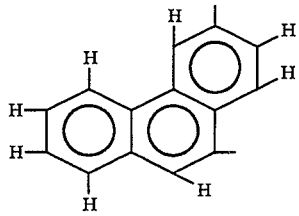

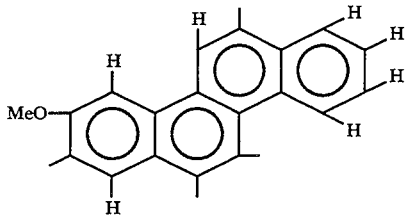

When the aromatic moiety Ar is a linked polynuclear aromatic moiety it can be represented by the general formula $$ar(Lng\text{-}ar)_w(Q)_{mw}$$

wherein w is an integer of 1 to about 20, ar is as described above with the proviso that there are at least 3 unsatisfied (i.e., free) valences in the total of ar groups, Q and m are as defined hereinbefore, and each Lng is a bridging linkage individually chosen from the group consisting of carbon-to-carbon single bonds, ether linkages (e.g. —O—), keto linkages (e.g., $$-\overset{\overset{O}{\|}}{C}-),$$

sulfide linkages (e.g., —S—), polysulfide linkages of 2 to 6 sulfur atoms (e.g., $—S_{2.6}—$), sulfonyl linkages (e.g., -S(O)-), sulfonyl linkages (e.g., $—S(O)_2—$), lower alkylene linkages (e.g., $$-CH_2-,\quad -CH_2-CH_2-,\quad -CH-\underset{\underset{R^0}{|}}{CH}-,\quad \text{etc.),}$$

di(lower alkyl)-methylene linkages (e.g., CR″2-), lower alkylene ether linkages $$-CH_2O-,\quad -CH_2O-CH_2-CH_2-CH_2O,$$

$$-CH_2CH_2OCH_2CH_2-,\quad -CH_2\underset{\underset{R^0}{|}}{C}HOCH_2\underset{\underset{R^0}{|}}{C}H-,$$

$$-CH_2\underset{\underset{R^0}{|}}{C}HO\underset{\underset{R^0}{|}}{C}HCH_2-,$$

etc.), lower alkylene sulfide linkages (e.g., wherein one or more —O—'s in the lower alkylene ether linkages is replaced with an —S—atom), lower alkylene polysulfide linkages (e.g., wherein one or more —O—'s is replaced with a $—S_{2-6}$ group), amino linkages (e.g., $$-\underset{\underset{H}{|}}{N}-,\quad -\underset{\underset{R^0}{|}}{N}-,\quad -CH_2N,\quad -CH_2NCH_2-,\quad -alk-N-$$

where alk is lower alkylene, etc.), polyamino linkages (e.g., $—N(alkN)_{1-10}$, where the unsatisfied free N valences are taken up with H atoms or R° groups), and mixtures of such bridging linkages (each R° being a lower alkyl group). It is also possible that one or more of the ar groups in the above-linked aromatic moiety can be replaced by fused nuclei such as $ar(ar)_m$.

Specific examples of linked moieties are:

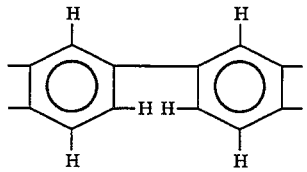

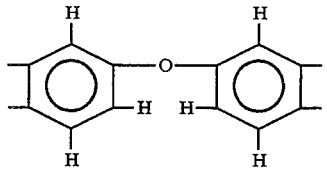

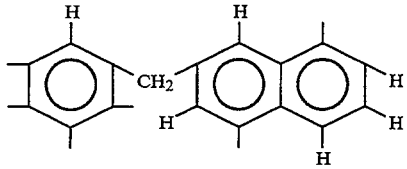

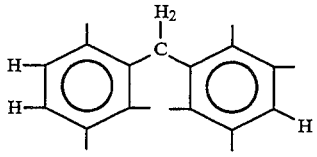

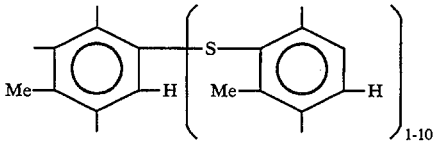

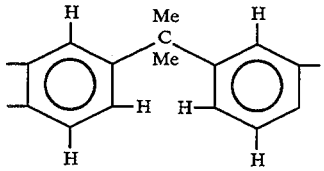

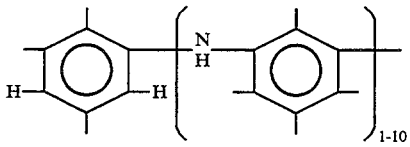

Usually all these Ar moieties are unsubstituted except for the R, —OH and $—NH_2$ groups (and any bridging groups). For such reasons as cost, availability, performance, etc., the Ar moiety is normally a benzene nucleus, lower alkylene bridged benzene nucleus, or a naphthalene nucleus. Thus, a typical Ar moiety is a benzene or naphthalene nucleus having 3 to 5 unsatisfied valences, so that one or two of said valences may be satisfied by a hydroxyl group with the remaining unsatisfied valences being, insofar as possible, either ortho or para to a hydroxyl group. Preferably, Ar is a benzene nucleus having at least 3 unsatisfied valences so that one can be satisfied by a hydroxyl group with the remaining 2 or 3 being either ortho or para to the hydroxyl group.

The Substantially Saturated Hydrocarbon-based Group $R^{30}$

The amino phenols of the present invention contain, directly bonded to the aromatic moiety Ar, a substantially saturated monovalent hydrocarbon-based group $R^{30}$ of at least about 10 aliphatic carbon atoms. This $R^{30}$ group can have up to about 400 aliphatic carbon atoms. More than one such group can be present, but usually, no more than 2 or 3 such groups are present for each aromatic nucleus in the aromatic moiety Ar. The total number of $R^{30}$ groups present is indicated by the value for "a" in Formula II. Usually, the hydrocarbon-based group has at least about 30, more typically, at least about 50 aliphatic carbon atoms and up to about 750, more typically, up to about 300 aliphatic carbon atoms.

Generally, the hydrocarbon-based groups $R^{30}$ are made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-monoolefins such as homopolymers of ethylene. The R groups can also be derived from the halogenated (e.g., chlorinated or brominated) analogs of such homo- or interpolymers. The $R^{30}$ groups can, however, be made from other sources, such as monomeric high molecular weight alkenes (e.g., 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly(ethylene) greases) and other sources known to those skilled in the art. Any unsaturation in the $R^{30}$ groups may be reduced or eliminated by hydrogenation according to procedures known in the art before the nitration step described hereafter.

As used herein, the term "hydrocarbon-based" denotes a group having a carbon atom directly attached to the remainder of the molecule and having a predominantly hydrocarbon character within the context of this invention. Therefore, hydrocarbon-based groups can contain up to one non-hydrocarbon radical for every ten carbon atoms provided this non-hydrocarbon radical does not significantly alter the predominantly hydrocarbon character of the group. Those skilled in the art will be aware of such radicals, which include, for example, hydroxyl, halo (especially chloro and fluoro), alkoxyl, alkyl mercapto, alkyl sulfoxy, etc. Usually, however, the hydrocarbon-based groups R are purely hydrocarbyl and contain no such non-hydrocarbyl radicals. The hydrocarbon-based groups $R^{30}$ are substantially saturated. By substantially saturated it is meant that the group contains no more than one carbon-to-carbon unsaturated bond for every ten carbon-to-carbon single bonds present. Usually, they contain no more than one carbon-to-carbon non-aromatic unsaturated bond for every 50 carbon-to-carbon bonds present.

The hydrocarbon-based groups of the amino phenols of this invention are also substantially aliphatic in nature, that is, they contain no more than one nonaliphatic moiety (cycloalkyl, cycloalkenyl or aromatic) group of six or less carbon atoms for every ten carbon atoms in the R group. Usually, however, the $R^{30}$ groups contain no more than one such non-aliphatic group for every fifty carbon atoms, and in many cases, they contain no such non-aliphatic groups at all; that is, the typical R groups are purely aliphatic. Typically, these purely aliphatic $R^{30}$ groups are alkyl or alkenyl groups. Specific examples of the substantially saturated hydrocarbon-based $R^{30}$ groups are the following:

- a tetra(propylene) group
- a tri(isobutene) group
- a tetracontanyl group
- a henpentacontanyl group
- a mixture of poly(ethylene/propylene) groups of about 35 to about 70 carbon atoms
- a mixture of the oxidatively or mechanically degraded
- poly(ethylene/propylene) groups of about 35 to about 70 carbon atoms
- a mixture of poly(propylene/1-hexene) groups of about 80 to about 150 carbon atoms
- a mixture of poly(isobutene) groups having between 20 and 32 carbon atoms
- a mixture of poly(isobutene) groups having an average of 50 to 75 carbon atoms A preferred source of the group $R^{30}$ are poly(isobutene)s obtained by polymerization of a $C_4$ refinery stream having a butene content of 35 to 75 weight percent and isobutene content of 15 to 60 weight percent in the presence of a Lewis acid catalyst such as aluminum trichloride or boron trifluoride. These polybutenes contain predominantly (greater than 80% of total repeating units) isobutene repeating units of the configuration

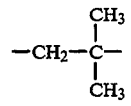

The attachment of the hydrocarbon-based group $R^{30}$ to the aromatic moiety Ar of the amino phenols of this invention can be accomplished by a number of techniques well known to those skilled in the art. One particularly suitable technique is the Friedel-Crafts reaction, wherein an olefin (e.g., a polymer containing an olefinic bond), or halogenated or hydrohalogenated analog thereof, is reacted with a phenol. The reaction occurs in the presence of a Lewis acid catalyst (e.g., boron trifluoride and its complexes with ethers, phenols, hydrogen fluoride, etc., aluminum chloride, aluminum bromide, zinc dichloride, etc.). Methods and conditions for carrying out such reactions are well known to those skilled in the art. See, for example, the discussion in the article entitled, "Alkylation of Phenols" in "Kirk-Othmer Encyclopedia of Chemical Technology", Second Edition, Vol. 1, pages 894–895, Interscience Publishers, a division of John Wiley and Company, N.Y., 1963. Other equally appropriate and convenient techniques for attaching the hydrocarbon-based group $R^{30}$ to the aromatic moiety Ar will occur readily to those skilled in the art.

As will be appreciated from inspection of the amino phenol formula, it contains at least one of each of the following substituents: a hydroxyl group, a $R^{30}$ group as defined above, and a primary amine group, —NH2. Each of the foregoing groups must be attached to a carbon atom which is a part of an aromatic nucleus in the Ar moiety. They need not, however, each be attached to the same aromatic ring if more than one aromatic nucleus is present in the Ar moiety.

In a preferred embodiment, the amino phenols contain one each of the foregoing substituents (i.e., a, b and c are each 1 ) and but a single aromatic ring, most preferably benzene. This preferred class of amino phenols can be represented by the formula

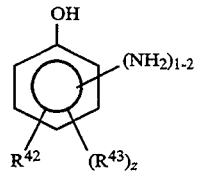

Formula XII wherein the $R^{42}$ group is a substantially saturated hydrocarbon-based group of about 30 to about 400 aliphatic carbon atoms located ortho or para to the hydroxyl group, $R^{43}$ is a lower alkyl, lower alkoxyl, nitro group or halogen atom and z is O or 1. Usually z is 0 and $R^{42}$ is a substantially saturated, purely hydrocarbyl aliphatic group. Often it is an alkyl or alkenyl group para to the —OH substituent. Often there is but one amino group, —$NH_2$ in these preferred amino phenols but there can be two.

In a still more preferred embodiment, the amino phenol is of the formula

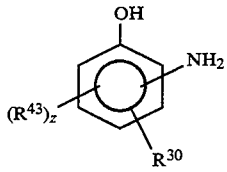

Formula XIII wherein $R^{30}$ is derived from homopolymerized or interpolymerized $C_{2-10}$ 1-olefins and has an average of from about 30 to about 400 aliphatic carbon atoms and $R^{43}$ and z are as defined above. Usually $R^{30}$ is derived from ethylene, propylene, butylene and mixtures thereof. Typically, it is derived from polymerized isobutene. Often $R^{30}$ has at least about 50 aliphatic carbon atoms and z is zero.

The amino phenols can be prepared by a number of synthetic routes. These routes can vary in the type reactions used and the sequence in which they are employed. For example, an aromatic hydrocarbon, such as benzene, can be alkylated with alkylating agent such as a polymeric olefin to form an alkylated aromatic intermediate. This intermediate can then be nitrated, for example, to form polynitro intermediate. The polynitro intermediate can in turn be reduced to a diamine, which can then be diazotized and reacted with water to convert one of the amino groups into a hydroxyl group and provide the desired amino phenol. Alternatively, one of the nitro groups in the polynitro intermediate can be converted to a hydroxyl group through fusion with caustic to provide a hydroxynitro alkylated aromatic which can then be reduced to provide the desired amino phenol.

Another useful route to the amino phenols involves the alkylation of a phenol with an olefinic alkylating agent to form an alkylated phenol. This alkylated phenol can then be nitrated to form an intermediate nitro phenol which can be converted to the desired amino phenols by reducing at least some of the nitro groups to amino groups.

Techniques for alkylating phenols are well known to those skilled in the art as the above-noted article in Kirk-Othmer "Encyclopedia of Chemical Technology" demonstrates. Techniques for nitrating phenols are also known. See, for example, in Kirk-Othmer "Encyclopedia of Chemical Technology", Second Edition, Vol. 13, the article entitled "Nitrophenols", page 888 et seq., as well as the treatises "Aromatic Substitution; Nitration and Halogenation" by P. B. D. De La Mare and J. H. Ridd, N.Y., Academic Press, 1959; "Nitration and Aromatic Reactivity" by J. G. Hogget, London, Cambridge University Press, 1961; and "The Chemistry of the Nitro and Nitroso Groups", Henry Feuer, Editor, Interscience Publishers, N.Y., 1969.

Aromatic hydroxy compounds can be nitrated with nitric acid, mixtures of nitric acid with acids such as sulfuric acid or boron trifluoride, nitrogen tetraoxide, nitronium tetrafluoroborates and acyl nitrates. Generally, nitric acid of a concentration of, for example, about 30–90% is a convenient nitrating reagent. Substantially inert liquid diluents and solvents such as acetic or butyric acid can aid in carrying out the reaction by improving reagent contact. Conditions and concentrations for nitrating hydroxy aromatic compounds are also well known in the art. For example, the reaction can be carded out at temperatures of about −15° C. to about 150° C. Usually nitration is conveniently carried out between about 25°–75° C.

Generally, depending on the particular nitrating agent about 0.5–4 moles of nitrating agent is used for every mole of aromatic nucleus present in the hydroxy aromatic intermediate to be nitrated. If more than one aromatic nucleus is present in the Ar moiety, the amount of nitrating agent can be increased proportionately according to the number of such nuclei present. For example, a mole of naphthalene-based aromatic intermediate has, for purposes of this invention, the equivalent of two "single ring" aromatic nuclei so that about 1–4 moles of nitrating agent would generally be used. When nitric acid is used as a nitrating agent usually about 1.0 to about 3.0 moles per mole of aromatic nucleus is used. Up to about a 5-molar excess of nitrating agent (per "single ring" aromatic nucleus) may be used when it is desired to drive the reaction forward or carry it out rapidly.

Nitration of a hydroxy aromatic intermediate generally takes 0.25 to 24 hours, though it may be convenient to react the nitration mixture for longer periods, such as 96 hours.

Reduction of aromatic nitro compounds to the corresponding amines is also well known. See, for example, the article entitled "Amination by Reduction" in Kirk-Othmer "Encyclopedia of Chemical Technology", Second Edition, Vol. 2, pages 76–99. Generally, such reductions can be carried out with, for example, hydrogen, carbon monoxide or hydrazine, (or mixtures of same) in the presence of metallic catalysts such as palladium, platinum and its oxides, nickel, copper chromite, etc. Co-catalysts such as alkali or alkaline earth metal hydroxides or amines (including amino phenols) can be used in these catalyzed reductions.

Reduction can also be accomplished through the use of reducing metals in the presence of acids, such as hydrochloric acid. Typical reducing metals are zinc, iron and tin; salts of these metals can also be used.

Nitro groups can also be reduced in the Zinin reaction, which is discussed in "Organic Reactions", Vol. 20, John Wiley & Sons N.Y., 1973, page 455 et seq. Generally, the Zinin reaction involves reduction of a nitro group with divalent negative sulfur compounds, such as alkali metal sulfides, polysulfides and hydrosulfides.

The nitro groups can be reduced by electrolytic action; see, for example, the "Amination by Reduction" article, referred to above.

Typically the amino phenols are obtained by reduction of nitro phenols with hydrogen in the presence of a metallic catalyst such as discussed above. This reduction is generally carried out at temperatures of about 15°–250° C., typically, about 50°–150° C., and hydrogen pressures of about 0–2000 psig, typically, about 50–250 psig. The reaction time for reduction usually varies between about 0.5–50 hours. Substantially inert liquid diluents and solvents, such as ethanol, cyclohexane, etc., can be used to facilitate the reaction. The amino phenol product is obtained by well-known techniques such as distillation, filtration, extraction, and so forth.

The reduction is carried out until at least about 50%, usually about 80%, of the nitro groups present in the nitro intermediate mixture are converted to amino groups. The typical route to the amino phenols just described can be summarized as (I) nitrating with at least one nitrating agent at least one compound of the formula Formula XIV wherein $R^{30}$ is a substantially saturated hydrocarbon-based group of at least 10 aliphatic carbon atoms; a and c are each independently an integer of 1 up to three times the number of aromatic nuclei present in Ar' with the proviso that the sum of a, b and c does not exceed the unsatisfied valences of Ar'; and Ar' is an aromatic moiety having 0 to 3 optional substituents selected from the group consisting of lower alkyl, lower alkoxyl, nitro, and halo, or combinations of two or more optional substituents, with the provisos that (a) Ar' has at least one hydrogen atom directly bonded to a carbon atom which is part of an aromatic nucleus, and (b) when Ar' is a benzene having only one hydroxyl and one R substituent, the R substituent is ortho or para to said hydroxyl substituent, to form a first reaction mixture containing a nitro intermediate, and (II) reducing at least about 50% of the nitro groups in said first reaction mixture to amino groups.

Usually this means reducing at least about 50% of the nitro groups to amino groups in a compound or mixture of compounds of the formula

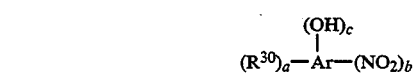

Formula XV wherein $R^{30}$ is a substantially saturated hydrocarbon-based substituent of at least 10 aliphatic carbon atoms; a, b and c are each independently an integer of 1 up to three times the number of aromatic nuclei present in Ar with the proviso that the sum of a, b and c does not exceed the unsatisfied valences of Ar; and Ar is an aromatic moiety having 0 to 3 optional substituents selected from the group consisting of lower alkyl, lower alkoxyl, halo, or combinations of two or more of said optional substituents; with the proviso that when Ar is a benzene nucleus having only one hydroxyl and one R substituent, the $R^{30}$ substituent is ortho or para to said hydroxyl substituent.

The following specific illustrative examples describe how to make the nitrogen-containing organic compositions. In these examples, as well as in this specification and the appended claims, all percentages, parts and ratios are by weight, unless otherwise expressly stated to the contrary. Temperatures are in degrees centigrade (°C.) unless expressly stated to the contrary.

EXAMPLE (C-5)-1A

A mixture of 4578 parts of a polyisobutene-substituted phenol prepared by boron trifluoride-phenol catalyzed alkylation of phenol with a polyisobutene having a number average molecular weight of approximately 1000 (vapor phase osmometry), 3052 parts of diluent mineral oil and 725 parts of textile spirits is heated to 60° to achieve homogenity. After cooling to 30°, 319.5 parts of 16 molar nitric acid in 600 parts of water is added to the mixture. Cooling is necessary to keep the mixture's temperature below 40°. After the reaction mixture is stirred for an additional two hours, an aliquot of 3,710 parts is transferred to a second reaction vessel. This second portion is treated with an additional 127.8 parts of 16 molar nitric acid in 130 parts of water at 25°–30°. The :reaction mixture is stirred for 1.5 hours and then stripped to 220°/30 tor. Filtration provides an oil solution of the desired intermediate (IA).

EXAMPLE (C-5)-1B

A mixture of 810 parts of the oil solution of the (IA) intermediate described in Example 1A, 405 parts of isopropyl alcohol and 405 parts of toluene is charged to an appropriately sized autoclave. Platinum oxide catalyst (0.81 part) is added and the autoclave evacuated and purged with nitrogen four times to remove any residual air. Hydrogen is fed to the autoclave at a pressure of 29–55 psig while the content is stirred and heated to 27°–92° for a total of thirteen hours. Residual excess hydrogen is removed from the reaction mixture by evacuation and purging with nitrogen four times. The reaction mixture is then filtered through diatomaceous earth and the filtrate stripped to provide an oil solution of the desired amino phenol. This solution contains 0.578% nitrogen.

EXAMPLE (C-5)-2

A mixture of 906 parts of an oil solution of an alkyl phenyl sulfonic acid (having an average molecular weight of 450, vapor phase osmometry), 564 parts mineral oil, 600 parts toluene, 98.7 parts magnesium oxide and 120 parts water is blown with carbon dioxide at a temperature of 78°–85° for seven hours at a rate of about 3 cubic feet of carbon dioxide per hour. The reaction mixture is constantly agitated throughout the carbonation. After carbonation, the reaction mixture is stripped to 165°/20 tor and the residue filtered. The filtrate is an oil solution of the desired overbased magnesium sulfonate having a metal ratio of about 3.

EXAMPLE (C-5)-3

A polyisobutenyl succinic anhydride is prepared by reacting a chlorinated poly(isobutene) (having an average chlorine content of 4.3% and an average of 82 carbon atoms) with maleic anhydride at about 200°. The resulting polyisobutenyl succinic anhydride has a saponification number of 90. To a mixture of 1,246 parts of this succinic anhydride and 1000 parts of toluene there is added at 25° 76.6 parts of barium oxide. The mixture is heated to 115° C. and 125 parts of water is added drop-wise over a period of one hour. The mixture is then allowed to reflux at 150° C. until all the barium oxide is reacted. Stripping and filtration provides a filtrate having a barium content of 4.71%.

EXAMPLE (C-5)-4

A mixture of 1500 parts of chlorinated poly(isobutene) (of molecular weight of about 950 and having a chlorine content of 5.6%), 285 parts of an alkylene polyamine having an average-composition corresponding stoichiometrically to tetraethylene pentamine and 1200 parts of benzene is heated to reflux. The mixture's temperature is then slowly increased over a 4-hour period to 170° while benzene is removed. The cooled mixture is diluted with an equal volume of mixed hexanes and absolute ethanol (1:1). This mixture is heated to reflux and a ⅓ volume of 10% aqueous sodium carbonate is added to it. After stirring, the mixture is allowed to cool and the phases separated. The organic phase is washed with water and stripped to provide the desired polyisobutenyl polyamine having a nitrogen content of 4.5%.

EXAMPLE (C-5)-5

A mixture of 140 parts of toluene and 400 parts of a polyisobutenyl succinic anhydride (prepared from the poly(isobutene) having a molecular weight of about 850, vapor phase osmometry) having a saponification number of 109 and 63.6 parts of an ethylene amine mixture having an average composition corresponding in stoichiometry to tetraethylene pentamine, is heated to 150° C. while the water/toluene azeotrope is removed. The reaction mixture is then heated to 150° C. under reduced pressure until toluene ceases to distill. The residual acylated polyamine has a nitrogen content of 4.7%.

EXAMPLE (C-5)-6

To 1,133 parts of commercial diethylene triamine heated at 110°-150° is slowly added 6820 parts of isostearic acid over a period of two hours. The mixture is held at 150° for one hour and then heated to 180° over an additional hour. Finally, the mixture is heated to 205° over 0.5 hour; throughout this heating, the mixture is blown with nitrogen to remove volatiles. The mixture is held at 205°- 230° for a total of 11.5 hours and then stripped at 230°/20 torr to provide the desired acylated polyamine as a residue containing 6.2% nitrogen.

(C-6) The Zinc Salt

A zinc salt of the formula

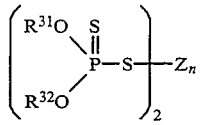

wherein $R^{31}$ and $R^{32}$ are independently hydrocarbyl groups containing from about 3 to about 20 carbon atoms are readily obtainable by the reaction of phosphorus pentasulfide ($P_2S_5$) and an alcohol or phenol to form an O,O-dihydrocarbyl phosphorodithioic acid corresponding to the formula

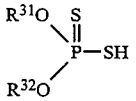

The reaction involves mixing at a temperature of about 20° C. to about 200° C., four moles of an alcohol or a phenol with one mole of phosphorus pentasulfide. Hydrogen sulfide is liberated in this reaction. The acid is then reacted with zinc oxide to form the zinc salt.

The $R^{31}$ ad $R^{32}$ groups are independently hydrocarbyl groups that are preferably free from acetylenic and usually also from ethylenic unsaturation and have from about 3 to about 20 carbon atoms, preferably 3 to about 16 carbon atoms and most preferably 3 to about 12 carbon atoms.

EXAMPLE (C-6)-1

A reaction vessel is charged with 804 parts of a mixture of 6.5 moles of isobutyl alcohol and 3.5 moles of mixed primary amyl alcohols (65% w n-amyl and 35% w 2-methyl-1-butanol). Phosphorus pentasulfide (555 parts, 2.5 moles) is added to the vessel while maintaining the reaction temperature between about 104°-107° C. After all of the phosphorus pentasulfide is added, the mixture is heated for ann additional period to insure completion of the reaction and filtered. The filtrate is the desired phosphorodithioic acid which contains about 11.2% phosphorus and 22.0% sulfur.

A reaction vessel is charged with 448 parts of zinc oxide ( 11 equivalents) and 467 parts of the above alcohol mixture. The above phosphorodithioic acid (3030 parts, 10.5 equivalents) is added at a rate to maintain the reaction temperature at about 45°-50° C. The addition is completed in 3.5 hours whereupon the temperature of the mixture is raised to 75° C. for 45 minutes. After cooling to about 50° C., an additional 61 parts of zinc oxide ( 1.5 equivalents) are added, and this mixture is heated to 75° C. for 2.5 hours. After cooling to ambient temperature, the mixture is stripped to 124° C. at 12 mm. pressure. The residue is filtered twice through diatomaceous earth, and the filtrate is the desired zinc salt containing 22.2% sulfur (theory, 22.0), 10.4% phosphorus (theory, 10.6) and 10.6% zinc (theory, 11.1).

EXAMPLE (C-6)-2

The procedure of Example (C-6)-1 is essentially followed except that 2-methylpentyl alcohol is used in place of the isobutyl alcohol and amnyl alcohols. The product obtained has 8.5% phosphorus, 17.6% sulfur and 9.25% zinc.

(C-7) The Sulfurized Composition

Within the purview of this invention, two different sulfurized compositions are envisaged and have utility. The first sulfurized composition, is a sulfurized olefin prepared by reacting an olefin/sulfur halide complex by contacting the complex with a protic solvent in the presence of metal ions at a temperature in the range of 40° C. to 120° C. and thereby removing halogens from the sulfurized complex and providing a dehalogenated sulfurized olefin; and isolating the sulfurized olefin. The preparation of the first sulfurized composition generally involves reacting an olefin with a sulfur halide to obtain an alkyl/sulfur halide complex, a sulfochlorination reaction. This complex is contacted with metal ions and a protic solvent. The metal ions are in the form of $Na_2S$/-NaSH which is obtained as an effluent of process streams from hydrocarbons, additional $Na_2S$ and NaOH. The $Na_2S$/NaSH may also be in the form of a fresh solution, that is, not recycled. The protic solvent is water and an alcohol of 4 carbon atoms or less. Preferably, the alcohol is isopropyl alcohol. The reaction with the metal ions and protic solvent represents a sulfurization-dechlorination reaction. The metal ions are present in an aqueous solution. The metal ions solution is prepared by blending an aqueous $Na_2S$ solution with the $Na_2S$/NaSH process streams. Water and aqueous NaOH are added as necessary to adjust the $Na_2S$ and NaOH concentration to a range of 18–21% $Na_2S$ and 2–5% NaOH. A sulfurized product is obtained which is substantially free of any halide, i.e. the product obtained has had enough of the halide removed so that it is useful as a lubricant additive.

A wide variety of olefinic substances may be charged to the initial sulfochlorination reaction including hydrocarbon olefins having a single double bond with terminal or internal double bonds and containing from about 2 to 50 or more, preferably 2 to 8 carbon atoms per molecule in either straight, branched chain or cyclic compounds, and these may be exemplified by ethylene, propylene, butene-1, cis and trans butene-2, isobutylene, diisobutylene, triisobutylene, pentenes, cyclopentene, cyclohexene, the octenes, decene-1, etc. In general, $C_{3-6}$ olefins or mixtures thereof are desirable for preparing sulfurized products for use as extreme pressure additives as the combined sulfur content of the product decreases with increasing carbon content yet its miscibility with oil is lower for propylene and ethylene derivatives.

Isobutylene is particularly preferred as the sole olefinic reactant, but it may be employed, desirably in major proportion, in mixtures containing one or more other olefins; moreover, the charge may contain substantial proportions of saturated aliphatic hydrocarbons as exemplified by methane, ethane, propane, butanes, pentanes, etc. Such alkanes are preferably present in minor proportion in most instances to avoid unnecessary dilution of the reaction, since they neither react nor remain in the products but are expelled in the off-gases or by subsequent distillation. However, mixed charges can substantially improve the economics of the present process since such streams are of lower value than a stream of relatively pure isobutylene.

The other reactant in the preparation of the first sulfurized composition is the sulfurizing agent. This agent may be selected from compounds such as sulfur monochloride ($S_2Cl_2$); sulfur dichloride; and $S_3Cl_2$ as well as the corresponding but more expensive sulfur bromides. The sulfurizing agent may be employed in an amount which will provide the desired quantity of sulfur. The amount of sulfurization desired will vary depending on the end use of the product and can be determined by one of ordinary skill in the art. The molar ratio of olefin to sulfur halide will vary depending on the amount of sulfurization desired in the end product and the amount of olefinic unsaturation. The molar ratio of sulfur halide to olefin could vary from 1:(1–20). When the olefin to be sulfurized contains a single double bond, one mole of the olefin can be reacted with 0.5 moles or less of $S_2Cl_2$ (sulfur monochloride). The olefin is generally added in excess with respect to the amount of the sulfur being added so that all of the sulfur halide will be reacted and any unreacted olefin can remain as unreacted diluent oil or can be removed and recycled.

An olefin or mixture of olefins and a sulfur halide or mixture of sulfur halides are sufficiently reacted to form an olefin/sulfur halide complex.

After the sulfurization-dechlorination reaction, the reaction mixture is allowed to stand and separate into an aqueous layer and another liquid layer containing the desired organic sulfide product. The product is usually dried by heating at moderately elevated temperatures under subatmospheric pressure, and its clarity may often be improved by filtering the dried product through a bed of bauxite, clay or diatomaceous earth particles.

The following example is provided so as to provide those of ordinary skill in the art with a complete disclosure and description of how to make the first sulfurized composition.

EXAMPLE (C-7)-1

Added to a three-liter, four-necked flask are 1100 grams (8.15 moles) of sulfur monochloride. While stirring at room temperature 952 grams (17 moles) of isobutylene are added below the surface. The reaction is exothermic and the addition rate of isobutylene controls the reaction temperature. The temperature is allowed to reach a maximum of 50° C. and obtained is a sulfochlorination reaction product.

A blend of 1800 grams of 18% $Na_2S$ solution is obtained from process streams. To this blend is added 238 grams 50% aqueous NaOH, 525 grams water and 415 grams isopropyl alcohol to prepare a reagent for use in the sulfurization-dechlorination reaction. To this reagent is added 1000 grams of the sulfochlorination reaction product in about 1.5 hours. One hour after the addition is completed, the contents are permitted to settle and the liquid layer is drawn off and discarded. The organic layer is stripped to 120° C. and 100 mm Hg to remove any volatiles. Analyses: % sulfur 43.5, % chlorine 0.2.

Table I outlines other olefins and sulfur chlorides that can be utilized in preparing the first sulfurized composition. The procedure is essentially the same as in Example (C-7)-1. In all the examples, the metal ion reagent is prepared according to Example (C-7)-1.

TABLE I

| Example | Olefin | Sulfur Chloride | Mole Ratio of Olefin:SCl |
|---|---|---|---|
| (C-7)-2 | n-butene | $SCl_2$ | 2.3:1 |
| (C-7)-3 | propene | $S_2Cl_2$ | 2.5:1 |
| (C-7)-4 | n-pentene | $S_2Cl_2$ | 2.2:1 |
| (C-7)-5 | n-butene/ isobutylene 1:1 weight | $S_2Cl_2$ | 2.5:1 |

TABLE I-continued

| Example | Olefin | Sulfur Chloride | Mole Ratio of Olefin:SCl |
|---|---|---|---|
| (C-7)-6 | isobutylene/ 2-pentene 1:1 weight | $S_2Cl_2$ | 2.2:1 |
| (C-7)-7 | isobutylene 2-pentene 3:2 weight | $S_2Cl_2$ | 2.2:1 |
| (C-7)-8 | isobutylene/ propene 6:1 weight | $S_2Cl_2$ | 2.3:1 |
| (C-7)-9 | n-pentene/ 2-pentene 1:1 weight | $S_2Cl_2$ | 2.2:1 |
| (C-7)-10 | 2-pentene/ propene 3:2 weight | $S_2Cl_2$ | 2.2:1 |

The second sulfurized composition is an oil-soluble sulfur-containing material which comprises the reaction product of sulfur and a Dieis-Alder adduct. The Dieis-Alder adducts are a well-known, art-recognized class of compounds prepared by the diene synthesis or Dieis-Alder reaction. A summary of the prior art relating to this class of compounds is found in the Russian monograph, *Dienovyi Sintes,* Izdatelstwo Akademii Nauk SSSR, 1963 by A. S. Onischenko. (Translated into the English language by L. Mandel as A. S. Onischenko, *Diene Synthesis,* N.Y., Daniel Davey and Co., Inc., 1964) This monograph and references cited therein are incorporated by reference into the present specification. Basically, the diene synthesis (Dieis-Alder reaction) involves the reaction of at least one conjugated diene, >C=C−C=C<, with at least one ethylenically or acetylenically unsaturated compound, >C=C<, these latter compounds being known as dienophiles. The reaction can be represented as follows:

Reaction 1:

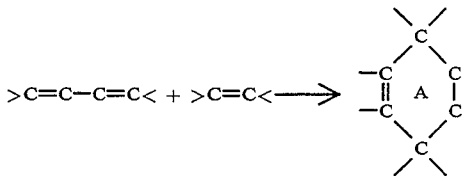

Reaction 2:

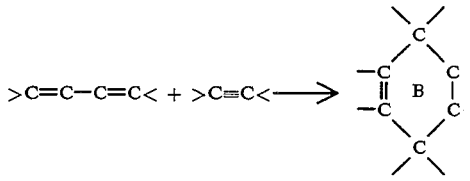

The products, A and B are commonly referred to as Dieis-Alder adducts. It is these adducts which are used as starting materials for the preparation of the second sulfurized composition.

Representative examples of such 1,3-dienes include aliphatic conjugated diolefins or dienes of the formula

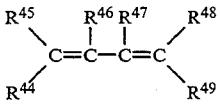

(XVI)

wherein $R^{44}$ through $R^{49}$ are each independently selected from the group consisting of hydrogen, alkyl, halo, alkoxy, alkenyl, alkenyloxy, carboxy, cyano, amino, alkylamino, dialkylamino, phenyl, and phenyl-substituted with 1 to 3 substituents corresponding to $R^{44}$ through $R^{49}$ with the proviso that a pair of R's on adjacent carbons do not form an additional double bond in the diene. Preferably not more than three of the R variables are other than hydrogen and at least one is hydrogen. Normally the total carbon content of the diene will not exceed 20. In one preferred aspect of the invention, adducts are used where $R^{46}$ and $R^{47}$ are both hydrogen and at least one of the remaining R variables is also hydrogen. Preferably, the carbon content of these R variables when other than hydrogen is 7 or less. In this most preferred class, those dienes where $R^{44}$, $R^{45}$, $R^{48}$, and R ®are hydrogen, chloro, or lower alkyl are especially useful. Specific examples of the R variables include the following groups: methyl, ethyl, phenyl, HOOC-, N=C-, $CH_{30}$-, $CH_3COO$-, $CH_3CH_2O$-, $CH_3C(O)$-, HC(O)-, Cl, Br, tert-butyl, $CF_3$, tolyl, etc. Piperylene, isoprene, methylisoprene, chloroprene, and 1,3-butadiene are among the preferred dienes for use in preparing the Dieis-Alder adducts.

In addition to these linear 1,3-conjugated dienes, cyclic dienes are also useful as reactants in the formation of the Dieis-Alder adducts. Examples of these cyclic dienes are the cyclopentadienes, fulvenes, 1,3-cyclohexadienes, 1,3-cycloheptadienes, 1,3,5-cycloheptatrienes, cyclooctatetraene, and 1,3,5-cyclonoatrienes. Various substituted derivatives of these compounds enter into the diene synthesis.

The dienophiles suitable for reacting with the above dienes to form the adducts used as reactants can be represented by the formula

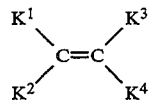

(XVII)

wherein the K variables are the same as the R variables in Formula above with the proviso that a pair of K's may from an additional carbon-to-carbon bond, i.e., $K^1$-(=C-$K^3$, but do not necessarily do so.

A preferred class of dienophiles are those wherein at least one of the K variables is selected from the class of electron-accepting groups such as formyl, cyano, nitro, carboxy, carbohydrocarbyloxy, hydrocarbylcarbonyl, hydrocarbylsulfonyl, carbamyl, acylcarbanyl, N-acyl-N-hydrocarbylcarbamyl, N-hydrocarbylcarbamyl, and N,N-dihydrocarbylcarbamyl. Those K variables which are not electron-accepting groups are hydrogen, hydrocarbyl, or substituted-hydrocarbyl groups. Usually the hydrocarbyl ad substituted hydrocarbyl groups will not contain more than 10 atoms each.

The hydrocarbyl groups present as N-hydrocarbyl substituents are preferably alkyl of 1 to 30 carbons and especially 1 to 10 carbons. Representative of this class of dienophiles are the following: nitroalkenes, e.g., 1-nitrobutene-1,1-nitropentene-1,3-methyl-1-nitro-butene-1,1-nitroheptene-1,1-nitrooctene-1,4-ethoxy-1-nitrobutene-1;alpha, beta-ethylenically unsaturated aliphatic carboxylic acid esters, e.g., alkylacrylates and alpha-methyl alkylacrylates (i.e., alkyl methacrylates) such as butylacrylate and butylmethacrylate, decyl acrylate and decylmethacrylate, di-(n-butyl)-maleate, di-(t-butyl-maleate); acrylonitrile, methacrylonitrile, beta-nitrostyrene, methylvinyl-sulfone, acrolein, acrylic acid; alpha, beta-ethylenically unsaturated aliphatic carboxylic acid amides, e.g., acrylamide, N,N-dibutylacrylamide, methacrylamide, N-dodecylmethacrylamide, N-pentyl-crotonamide; crotonaldehyde, crotonic acid, beta, beta-dimethyldivinylketone, methyl-vinylketone, N-vinylpyrrolidone, alkenylhalides, and the like.

One preferred class of dienophiles are those wherein at least one, but not more than two of K variables is -C(O)O-$R^0$ where $R^0$ is the residue of a saturated aliphatic alcohol of up to about 40 carbon atoms; e.g., for example at least one K is carbohydrocarbyloxy such as carboethoxy, carbobutoxy, etc., the aliphatic alcohol from which —$R^0$ is derived can be a mono or polyhydric alcohol such as alkyleneglycols, alkanols, aminoalkanols, alkoxy-substituted alkanols, ethanol, ethoxy ethanol, propanol, beta-diethylaminoethanol, dodecyl alcohol, diethylene glycol, tripropylene glycol, tetrabutylene glycol, hexanol, octanol, isooctyl alcohol, and the like. In this especially preferred class of dienophiles, not more than two K variables will be -C(O)-O-R° groups and the remaining K variables will be hydrogen or lower alkyl, e.g.; methyl, ethyl, propyl, isopropyl, and the like.

Specific examples of dienophiles of the type discussed above are those wherein at least one of the K variables is one of the following groups: hydrogen, methyl, ethyl, phenyl, HOOC-, HC(O)-, $CH_2$=CH-, HC=C, $CH_3C(O)$)-, $ClCH_2$-, $HOCH_2$-, alpha-pyridyl, -$NO_2$, Cl, Br, propyl, iso-butyl, etc.

In addition to the ethylenically unsaturated dienophiles, there are many useful acetylenically unsaturated dienophiles such as propiolaldehyde, methylethynylketone, propylethynylketone, propenylethynylketone, propiolic acid, propiolic acid nitrile, ethylopropiolate, tetrolic acid, propargylaldehyde, acetylenedicarboxylic acid, the dimethyl ester of acetylenedicarboxylic acid, dibenzoylacetylene, and the like.

Cyclic dienophiles include cyclopentenedione, coumarin, 3-cyanocourmarin, dimethyl maleic anhydride, 3, 6-endomethylenecyclohexenedicarboxylic acid, etc. With the exception of the unsaturated dicarboxylic anhydrides derived from linear dicarboxylic acids (e.g., maleic anhydride, methyhnaleic anhydride, chloromaleic anhydride), this class of cyclic dienophiles are limited in commercial usefulness due to their limited availability and other economic considerations.

The reaction products of these dienes and dienophiles correspond to the general formulae

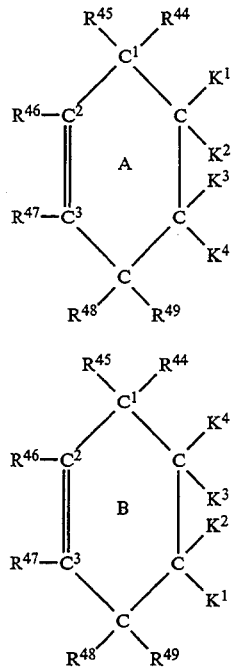

(XVIII)

wherein $R^{44}$ through $R^{49}$ and $K^1$ through $K^4$ are as defined hereinbefore. If the dienophile moiety entering into the reaction is acetylenic rather than ethylenic, two of the K variables, one from each carbon, form another carbon-to-carbon double bond. Where the diene and/or the dienophile is itself cyclic, the adduct obviously will be bicyclic, tricyclic, fused, etc., as exemplified below:

Reaction 3:

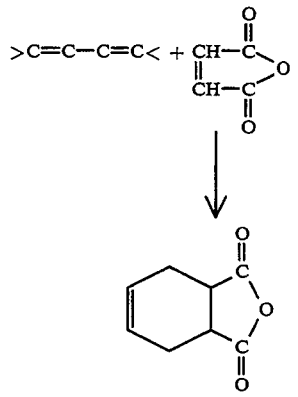

Reaction 4:

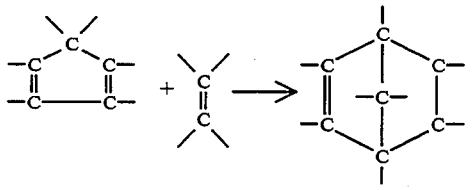

Normally, the adducts involve the reaction of equimolar amounts of diene and dienophile. However, if the dienophile has more than one ethylenic linkage, it is possible for additional diene to react if present in the reaction mixture.

The adducts and processes of preparing the adducts are further exemplified by the following examples. Unless otherwise indicated in these examples and in other parts of this specification, as well as in the appended claims, all parts and percentages are by weight.

EXAMPLE A

A mixture comprising 400 parts of toluene and 66.7 parts of aluminum chloride is charged to a two-liter flask fitted with a stirrer, nitrogen inlet tube, and a solid carbon dioxide-cooled reflux condenser. A second mixture comprising 640 parts (5 moles) of butyl acrylate and 240.8 parts of toluene is added to the $AlCl_3$ slurry while maintaining the temperature within the range of 37°-58° C. over a 0.25hour period. Thereafter, 313 pans (5.8 moles) of butadiene is added to the slurry over a 2.75-hour period while maintaining the temperature of the reaction mass at 50°-61° C. by means of external cooling. The reaction mass is blown with nitrogen for about 0.33 hour and then transferred to a four-liter separatory funnel and washed with a solution of 150 pans of concentrated hydrochloric acid in 1100 parts of water. Thereafter, the product is subjected to two additional water washings using 1000 parts of water for each wash. The washed reaction product is subsequently distilled to remove unreacted butyl acrylate and toluene. The residue of this first distillation step is subjected to further distillation at a pressure of 9-10 millimeters of mercury whereupon 785 pans of the desired product is collected over the temperature of 105°-115° C.

EXAMPLE B

The adduct of isoprene and acrylonitrile is prepared by mixing 136 pans of isoprene, 106 parts of acrylonitrile, and 0.5 parts of hydroquinone (polymerization inhibitor) in a rocking autoclave and thereafter heating for 16 hours at a temperature within the range of 130°-140° C. The autoclave is vented and the contents decanted thereby producing 240 parts of a light yellow liquid. This liquid is stripped at a temperature of 90° C. and a pressure of 10 millimeters of mercury thereby yielding the desired liquid product as the residue.

EXAMPLE C

Using the procedure of Example B, 136 parts of isoprene, 172 pans of methyl acrylate, and 0.9 part of hydroquinone are converted to the isoprenemethyl acrylate adduct.

EXAMPLE D

Following the procedure of Example B, 104 parts of liquified butadiene, 166 parts of methyl acrylate, and 1 part of hydroquinone are charged to the rocking autoclave and heated to 130°-135° for 14 hours. The product is subsequently decanted and stripped yielding 237 parts of the adduct.

EXAMPLE E

The adduct of isoprene and methyl methacrylate is prepared by reacting 745 parts of isoprene with 1095 pans of methyl methacrylate in the presence of 5.4 parts of hydroquinone in the rocking autoclave following the procedure of Example B above. 1490 parts of the adduct is recovered.

EXAMPLE F

The adduct of butadiene and dibutyl maleate (810 parts) is prepared by reacting 915 parts of dibutyl maleate, 216 parts of liquified butadiene, and 3.4 parts of hydroquinone in the rocking autoclave according to the technique of Example B.

EXAMPLE G

A reaction mixture comprising 378 parts of butadiene, 778 parts of N-vinylpyrrolidone, and 3.5 pans of hydroquinone is added to a rocking autoclave previously chilled to −35° C. The autoclave is then heated to a temperature of 130°-140° C. for about 15 hours. After venting, decanting, and stripping the reaction mass, 75 parts of the desired adduct are obtained.

EXAMPLE H

Following the technique of Example B, 270 parts of liquified butadiene, 1060 parts of isodecyl acrylate, and 4 parts of hydroquinone are reacted in the rocking autoclave at a temperature of 130°-140° C. for about 11 hours. After decanting the stripping, 1136 parts of the adduct are recovered.

EXAMPLE I

Following the same general procedure of Example A, 132 parts (2 moles) of cyclopentadiene, 256 parts (2 moles) of butyl acrylate, and 12.8 pans of aluminum chloride are reacted to produce the desired adduct. The butyl acrylate and the aluminum chloride are first added to a two-liter flask fitted with stirrer and reflux condenser. While heating reaction mass to a temperature within the range of 59°-52° C., the cyclopentadiene is added to the flask over a 0.5-hour period. Thereafter the reaction mass is heated for about 7.5 hours at a temperature of 95°-1000 C. The product is washed with a solution containing 400 parts of water and 100 parts of concentrated hydrochloric acid and the aqueous layer is discarded. Thereafter, 1500 parts of benzene are added to the reaction mass and the benzene solution is washed with 300 parts of water and the aqueous phase removed. The benzene is removed by distillation and the residue stripped at 0.2 parts of mercury to recover the adduct as a distillate.

EXAMPLE J

Following the technique of Example B, the adduct of butadiene and allyl chloride is prepared using two moles of each reactant.

EXAMPLE K

One-hundred thirty-nine pans (1 mole) of the adduct of butadiene and methyl acrylate is transesterified with 158 parts (1 mole) of decyl alcohol. The reactants are added to a reaction flask and 3 parts of sodium methoxide are added. Thereafter, the reaction mixture is heated at a temperature of 190°-200° C. for a period of 7 hours. The reaction mass is washed with a 10% sodium hydroxide solution and then 250 parts of naphtha is added. The naphtha solution is washed with water. At the completion of the washing, 150 parts of toluene are added and the reaction mass is stripped at 150° C. under pressure of 28 parts of mercury. A dark-brown fluid product (225 pans) is recovered. This product is fractionated under reduced pressure resulting in the recovery of 178 pans of the product boiling in the range of 130°-133° C. at a pressure of 0.45 to 0.6 pans of mercury.

EXAMPLE L

The general procedure of Example A is repeated except that only 270 pans (5 moles) of butadiene is included in the reaction mixture.

The second sulfurized compositions are readily prepared by heating a mixture of sulfur and at least one of the Dieis-Alder adducts of the types discussed hereinabove at a temperature within the range of from about 100° C. to just below the decomposition temperature of the Dieis-Alder adducts. Temperatures within the range of about 100° to about 200° C. will normally be used. This reaction results in a mixture of products, some of which have been identified. In the compounds of know structure, the sulfur reacts with the substituted unsaturated cycloaliphatic reactants at a double bond in the nucleus of the unsaturated reactant.

The molar ratio of sulfur to Dieis-Alder adduct used in the preparation of the sulfur-containing composition is from about 1:2 up to about 4:1. Generally, the molar ratio of sulfur to Dieis-Alder adduct will be from about 1:1 to about 4:1 and preferably about 2:1 to about 4:1 based on the presence of one ethylenically unsaturated bond in the cycloaliphatic nucleus. If there additional unsaturated bonds in the cycloaliphatic nucleus, the ratio of sulfur may be increased.

The reaction can be conducted in the presence of suitable inert organic solvents such as mineral oils, alkanes of 7 to 18 carbons, etc., although no solvent is generally necessary. After completion of the reaction, the reaction mass can be filtered and/or subjected to other conventional purification techniques. There is no need to separate the various sulfur-containing products as they can be employed in the form of a reaction mixture comprising the compounds of known and unknown structure.

As hydrogen sulfide is an undesirable contaminant, it is advantageous to employ standard procedures for assisting in the removal of the H2S from the products. Blowing with steam, alcohols, air, or nitrogen gas assists in the removal of H2S as does heating at reduced pressures with or without the blowing.

When the Dieis-Alder adduct is of the type represented by Formula XVIII (A) or (B), the sulfur-containing products of known structure correspond to the following generic formulae:

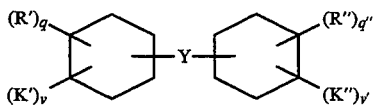

(XIX)

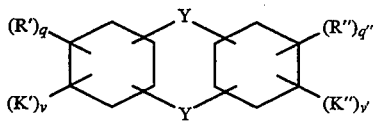

(XX)

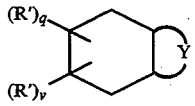

(XXI)

wherein R' and R'' are the same as $R^{44}$ through $R^{49}$ above and K' and K'' are the same as $K^1$ through $K^4$ above. Y is a divalent sulfur group. The variables q and q'' are zero or a positive whole number of 1 to 6 while v and v' are zero or positive whole number of 1 to 4, at least one of R', R'', K', and K'' in each compound being other than hydrogen or a saturated aliphatic hydrocarbon group. Generally not more than five of the R and K variables on each ring are other than hydrogen. Preferably, at least one K variable in each compound will be an electron accepting group of the type discussed supra. The preferred class of substituents discussed hereinbefore with regard to the various "K" and "R" variables on the intermediates for making the Dieis-Alder adducts and the adducts themselves obviously applies to the final products prepared from the intermediates.

An especially preferred class of the second sulfurized composition within the ambit of Formulae XIX-XXI is the therein at least one of the K variables is an electron accepting group from the class consisting of $$-\overset{\overset{W''}{\|}}{C}-R^{54},\ -\overset{\overset{O}{\|}}{\underset{\underset{O}{\|}}{S}}-R^{54},\ -C{\equiv}N,\ \text{and}\ -NO_2$$

wherein W'' is oxygen or divalent sulfur, and $R^{54}$ is hydrogen, halo, alkyl of 1 to 30 carbons, alkenyl of 1 to 30 carbons, hydroxy, alkoxy, of 1 to 30 carbons, alkenoxy of 1 to 30 carbons, amino, alkylamino and dialkylmnine wherein the alkyl groups contain from 1 to 30 carbons and preferably 1 to 10 carbons. Preferably, W'' is oxygen. When $R^{54}$ is halo, chloro is preferred. Particularly useful are those compounds wherein the R's are hydrogen or lower alkyl and one K variable is carboalkoxy of up to 31 carbon atoms, the remaining K groups being hydrogen, lower alkyl, or another electron accepting group. Within this latter group, those wherein the carboalkoxy group is carbo-n-butoxy produce excellent results as lubricant additives.

It is sometimes advantageous to incorporate materials useful as sulfurization catalysts in the reaction mixture. These materials may be acidic, basic or neutral, Useful neutral and acidic materials, include acidified clays such as "Super Filtrol", p-toluenesulfonic acid, dialkylphosphoro-dithioic acids, phosphorus sulfides such as phosphorus pentasulfide and phosphites such as triaryl phosphites (e.g., triphenyl phosphite).

The basic materials may be inorganic oxides and salts such as sodium hydroxide, calcium oxide and sodium sulfide. The most desirable basic catalysts, however, are nitrogen bases including ammonia and amines. The amines include primary, secondary and tertiary hydrocarbyl amines wherein the hydrocarbyl radicals are alkyl, aryl, aralkyl, alkaryl or the like and contain about 1–20 carbon atoms. Suitable amines include aniline, benzylamine, dibenzylamine, dodecylamine, naphthylamine, tallow amines, N-ethyl-dipropylamine, N-phenylbenzylamine, N,N-diethylbutylamine, m-toluidine and 2,3-xylidine. Also useful are heterocyclic amines such as pyrrolidine, N-methylpyrrolidine, piperidine, pyridine and quinoline.

The preferred basic catalysts include ammonia and primary, secondary, or tertiary alkylamines having about 1–8 carbon atoms in the alkyl radicals. Representative amines of this type are methylamine, dimethylamine, trimethylamine, ethylamine, diethylamine, triethylamine, di-n-butylamine, tri-n-butylamine, tri-sec-hexylamine and tri-n-octylamine. Mixtures of these amines can be used, as well as mixtures of ammonia and amines.

When a catalyst is used, the amount is generally about 0.05–2.0% of the weight of the adduct.

The following examples illustrate the preparation of the second sulfurized composition.

EXAMPLE (C-7)-11

To 255 parts (1.65 moles) of the isoprene methacrylate adduct of Example C heated to a temperature of 110°–120° C., there are added 53 parts (1.65 moles) of sulfur flowers over a 45-minute period. The heating is continued for 4.5 hours at a temperature in the range of 130°–160° C. After cooling to room temperature, the reaction mixture is filtered through a medium sintered glass funnel. The filtrate consists of 301 parts of the desired second sulfurized composition.

EXAMPLE (C-7)-12

A reaction mixture comprising 1175 parts (6 moles) of the Dieis-Alder adduct of butyl acrylate and isoprene and 192 parts (6 moles) of sulfur flowers is heated for 0.5 hour at 108°–110° C. and then to 155°–165° C. for 6 hours while bubbling nitrogen gas through the reaction mixture at 0.25 to 0.5 standard cubic feet per hour. At the end of the heating period, the reaction mixture is allowed to cool and filtered at room temperature. Thereafter, the product is permitted to stand for 24 hours and refiltered. The filtrate is the desired second sulfurized composition.

EXAMPLE (C-7)-13

Sulfur (4.5 moles) and the adduct of isoprene-methyl methacrylate (4.5 moles) are mixed at room temperature and heated for one hour at 100° C. while blowing nitrogen through the reaction mass at 0.25–0.5 standard cubic feet per hour. Subsequently the reaction temperature is raised to 150°–155° C. for 6 hours while maintaining the nitrogen blowing. After heating, the reaction mass is permitted to stand for several hours while cooling to room temperature and is thereafter filtered. The filtrate consists of 842 parts of the desired second sulfurized composition.

EXAMPLE (C-7)-14

A one-liter flask fitted with a stirrer, reflux, condenser, and nitrogen inlet line is charged with 256 parts ( 1 mole) of the adduct of butadiene and isodecyl acrylate, and 51 grams ( 1.6 moles) of sulfur flowers and then heated for 12 hours at a temperature, stand for 21 hours, and filtered at room temperature to produce the desired second sulfurized composition as the filtrate.

EXAMPLE (C-7)-15

A mixture of 1703 parts (9.4 moles) of a butyl acrylate-butadiene adduct prepared as in Example L, 280 parts (8.8 moles) of sulfur and 17 parts of triphenyl phosphite is prepared in a reaction vessel and heated gradually over 2 hours to a temperature of about 185° C. while stirring and sweeping with nitrogen. The reaction is exothermic near 160°–170° C., and the mixture is maintained at about 185° C. for 3 hours. The mixture is cooled to 90° C. over a period of 2 hours and filtered using a filter aid. The filtrate is the desired second sulfurized composition containing 14.0% sulfur.

EXAMPLE (C-7)-16

The procedure of Example (C-7)-15 is repeated except that the triphenyl phosphite is omitted from the reaction mixture.

EXAMPLE (C-7)-17

The procedure of Example (C-7)-15 is repeated except that the triphenyl phosphite is replaced by 2.0 parts of triamyl amine as sulfurization catalyst.

EXAMPLE (C-7)-18

A mixture of 547 parts of a butyl acrylatebutadiene adduct prepared as in Example L and 5.5 parts of triphenyl phosphite is prepared in a reaction vessel and heated with stirring to a temperature of about 50° C. whereupon 94 parts of sulfur are added over a period of 30 minutes. The mixture is heated to 150° C. in 3 hours while sweeping with nitrogen. The mixture then is heated to about 185° C. in approximately one hour. The reaction is exothermic and the temperature is maintained at about 185° C. by using a cold water jacket for a period of about 5 hours. At this time, the contents of the reaction vessel are cooled to 85° C. and 33 parts of mineral oil are added. The mixture is filtered at this temperature, and the filtrate is the desired second sulfurized composition wherein the sulfur to adduct ratio is 0.98/1.

EXAMPLE (C-7)-19

The general procedure of Example (C-7)-18 with the exception that the triphenyl phosphite is not included in the reaction mixture.

EXAMPLE (C-7)-20

A mixture of 500 parts (2.7 moles) of a butyl acrylate-butadiene adduct prepared as in Example L and 109 parts (3.43 moles) of sulfur is prepared and heated to 180° C. and maintained at a temperature of about 180°–190° C. for about 6.5 hours. The mixture is cooled while sweeping with a nitrogen gas to remove hydrogen sulfide odor. The reaction mixture is filtered and the filtrate is the desired second sulfurized composition containing 15.8% sulfur.

EXAMPLE (C-7)-21

A mixture of 728 parts (4.0 moles) of a butyl acrylate-butadiene adduct prepared as in Example L, 218 parts (6.8 moles) of sulfur, and 7 parts of triphenyl phosphite is prepared and heated with stirring to a temperature of about 181 ° C. over a period of 1.3 hours. The mixture is maintained under a nitrogen purge at a temperature of 181°–187° C. for 3 hours. After allowing the material to cool to about 85° C. over a period of 1.4 hours, the mixture is filtered using a filter aid, and the filtrate is the desired second sulfurized composition containing 23.1% sulfur.

It has been found that, if the second sulfurized composition is treated with an aqueous solution of sodium sulfide containing from 5% to about 75% by weight Na2S, the treated product may exhibit less of a tendency to darken freshly polished copper metal.

Treatment involves the mixing together the second sulfurized composition and the sodium sulfide solution for a period of time sufficient for any unreacted sulfur to be scavenged, usually a period of a few minutes to several hours depending on the amount of unreacted sulfur, the quantity and the concentration of the sodium sulfide solution. The temperature is not critical but normally will be in the range of about 20° C. to about 100° C. After the treatment, the resulting aqueous phase is separated from the organic phase by conventional techniques, i.e., decantation, etc. Other alkali metal sulfides, M2Sx where M is an alkali metal and x is 1, 2, or 3 may be used to scavenge unreacted sulfur but those where x is greater than 1 are not nearly as effective. Sodium sulfide solutions are preferred for reasons of economy and effectiveness. This procedure is described in more detail in U.S. Pat. No. 3,498,915.

It has also been determined that treatment of the second sulfurized composition with solid, insoluble acidic materials such as acidified clays or acidic resins and thereafter filtering the sulfurized reaction mass improves the product with respect to its color and solubility characteristics. Such treatment comprises thoroughly mixing the reaction mixture with from about 0.1% to about 10% by weight of the solid acidic material at a temperature of about 25°-150° C. and subsequently filtering the product.

In order to remove the last traces of impurities from the second sulfurized composition reaction mixture, particularly when the adduct employed was prepared using a Lewis acid catalyst, (e.g., $AlCl_3$) it is sometimes desirable to add an organic inert solvent to the liquid reaction product and, after thorough mixing, to refilter the material. Subsequently the solvent is stripped from the second sulfurized composition. Suitable solvents include solvents of the type mentioned hereinabove such as benzene, toluene, the higher alkanes, etc. A particularly useful class of solvents are the textile spirits.

In addition, other conventional purification techniques can be advantageously employed in purifying sulfurized products used in this invention. For example, commercial filter aids can be added to the materials prior to filtration to increase the efficiency of the filtration. Filtering through diatomaceous earth is particularly useful where the use contemplated requires the removal of substantially all solid materials. However, such expedients are well known to those skilled in the art and require no elaborate discussion herein.

(C-8) The Viscosity Index Improver

Viscosity Index or "V.I." is an arbitrary number which indicates the resistance of a lubricant to viscosity change with temperature. The Dean and Davis viscosity index calculated from the observed viscosities of a lubricant at 40° C. and 100° C. gives V.I. values ranging from 0 or negative values to values of 200 or more. The higher its V.I. value, the greater the resistance of a lubricant to thicken at low temperatures and thin out at high temperatures.

An ideal lubricant for most purposes would possess the same viscosity at all temperatures. All lubricants depart from this ideal, some more than others. For example, lubricating oils derived from highly paraffinic crudes have higher V.I. values than lubricating oils derived from highly naphthenic crudes. This difference was used, in fact, to fix the limits of 0 to 100 on the Dean and Davis scale, these values having been assigned, respectively, to a poor naphthene-base oil and a good paraffin-base oil. The operational advantages offered by a lubricant having a high V.I. include principally less friction due to viscous "drag" at low temperatures as well as reduced lubricant loss and lower wear at high temperatures.

V.I. improvers are chemicals which are added to lubricating oils to make them conform more closely to the ideal lubricant defined above. Although a few non-polymeric substances such as metallic soaps exhibit V.I. improving properties, all commercially important V.I. improvers are oil-soluble organic polymers. Suitable polymers exert a greater thickening effect on oil at high temperatures than they do at lower temperatures. The end result of such selective thickening is that the oil suffers less viscosity change with changing temperature, i.e., its V.I. is raised. It has been proposed that selective thickening occurs because the polymer molecule assumes a compact, curled form in a poor solvent such as cold oil and an uncurled, high surface area form in a better solvent such as hot oil. In the latter form, it is more highly solvated and exerts its maximum thickening effect on the oil.

Commercial V.I. improvers belong to the following families of polymers:

(I) Polyisobutenes
(II) Polymethacrylates, i.e., copolymers of various chain length alkyl methacrylates
(III) Vinyl acetate—fumaric acid ester copolymers
(IV) Polyacrylates, i.e., copolymers of various chain length alkyl acrylates (C-9) The Aromatic Amine Component (C-9) is at least one aromatic amine of the formula

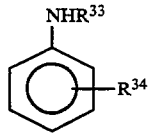

wherein $R^{33}$ is

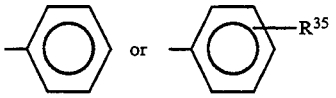

$R^{35}$ and $R^{34}$ and $R^{35}$ are independently a hydrogen or an alkyl group containing from 1 up to 24 carbon atoms. Preferably $R^{33}$ is

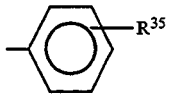

$R^{35}$ and $R^{34}$ and $R^{35}$ are alkyl groups containing from 4 up to $R^{33}$ is about 18 carbon atoms. In a particularly advantageous embodiment, component (C) comprises an alkylated diphenylamine such as nonylateddiphenylamine of the formula

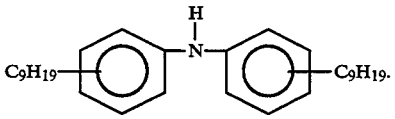

The compositions of this invention, components (A) and (B) or components (A), (B) and (C) may further contain (D) at least one oil selected from the group consisting of (1) synthetic ester base oil comprising the reaction of a monocarboxylic acid of the formula $R^{36}COOH$ dicarboxylic acid of the formula

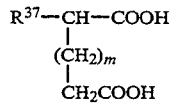

with an alcohol of the formula $R^{38}(OH)_n$ wherein $R^{36}$ is a hydrocarbyl group containing from about 4 to about 24 carbon atoms, $R^{37}$ is hydrogen or a hydrocarbyl group containing from about 4 to about 50 carbon atoms, $R^{38}$ is a hydrocarbyl group containing from 1 to about 24 carbon atoms, m is an integer of from 0 to about 6 and n is an integer of from 1 to about 6;

(2) a mineral oil;

(3) a polyalphaolefin and (4) a vegetable oil.

(D-1 ) The Synthetic Ester Base Oil

The synthetic ester base oil comprises the reaction of a monocarboxylic acid of the formula $R_{36}COOH$ or a dicarboxylic acid of the formula

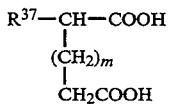

with an alcohol of the formula $R^{38}(OH)_n$ wherein $R^{36}$ is a hydrocarbyl group containing from about 4 to about 24 carbon atoms, $R^{37}$ is hydrogen or a hydrocarbyl group containing from about 4 to about 50 carbon atoms, $R^{38}$ is a hydrocarbyl group containing from 1 to about 24 carbon atoms, m is an integer of from 0 to about 6 and n is an integer of from 1 to about 6.

Useful monocarboxylic acids are the isomeric carboxylic acids of pentanoic, hexanoic, octanoic, nonanoic, decanoic, undecanoic and dodecanoic acids. When $R^{37}$ is hydrogen, useful dicarboxylic acids are succinic acid, maleic acid, azelaic acid, suberic acid, sebacic acid, fumaric acid and adipic acid. When $R^{37}$ is a hydrocarbyl group containing from 4 to about 50 carbon atoms, the useful dicarboxylic acids are alkyl succinic acids and alkenyl succinic acids. Alcohols that may be employed are methyl alcohol, ethyl alcohol, butyl alcohol, the isomeric pentyl alcohols, the isomeric hexyl alcohols, dodecyl alcohol, 2-ethylhexyl alcohol, ethylene glycol, diethylene glycol, propylene glycol, neopentyl glycol, pentaerythritol, dipentaerythritol, trimetholol propane, bistrimetholol propane, etc. Specific examples of these esters include dibutyl adipate, di(2-ethyhexyl) sebacate, di-n-hexyl fumarate, dioctyl sebacate, diisooctyl azelate, diisodecyl azelate, dioctylphthalate, didecyl phthalate, dieicosyl sebacate, the 2-ethylhexyl diester of linoleic acid dimer, the complex ester formed by reacting one mole of sebacic acid with two moles tetraethylene glycol and two moles of 2-ethylhexanoic acid, the ester formed by reacting one mole of adipic acid with 2 moles of a 9 carbon alcohol derived from the oxo process of a 1-butene dimer and the like.

A non-exhaustive list of companies that produce synthetic esters and their trade names are BASF as Glissofiuid, Ciba-Geigy as Reolube, JCI as Emkarote, Oleofina as Radialube and the Emery Group of Henkel Corporation as Emery 2964, 2911, 2960, 2976, 2935, 2971, 2930 and 2957.

(D-2) The Mineral Oil

The mineral oils having utility are mineral lubricating oils such as liquid petroleum oils and solvent-treated or acid-treated mineral lubricating oils of the paraffinic, naphthenic or mixed paraffinic-naphthenic types. Also useful are petroleum distillates such as VM&P naphtha and Stoddard solvent. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)benzenes, etc.); polyphenyls (e.g.,. biphenyls, terphenyls, alkylated polyphenyls, etc.); alkylated diphenyl ethers and alkylated diphenyl sulfides and the derivatives, analogs and homologs thereof and the like.

Unrefined, refined and rerefined oils, (as well as mixtures of two or more of any of these) can also be used in the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

(D-3) The Polyalpha Olefins

Polyalpha olefins such as alkylene oxide polymers and interpolymers and derivatives thereof where the terminal hydroxyl groups have been modified by esterification, etherification, etc., constitute another class of oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$ Oxo acid diester of tetraethyleneglycol.

(D-4) The Vegetable Oils

Vegetable oils having utility in this invention are those vegetable oils obtained without genetic modification, i.e., their monounsaturation content (as oleic acid) is below 60 percent. Vegetable oils having utility are canola oil, peanut oil, palm oil, corn oil, soybean oil, sunflower oil, cottonseed oil, safflower oil and coconut oil.

The compositions of the present invention comprising components (A) and (B) or (A), (B) and (C) or (A), (B) and (D) or (A), (B), (C) and (D) are useful as industrial lubricants.

When the composition comprises components (A) and (B), the (A):(B) weight ratio is generally from 75:25 to 99.9:0.1, preferably from 80:20to 99.5:0.5 and most preferably from 85:15 to 99: 1.

When the composition comprises components (A), (B) and (C) or (D), the following states the ranges of these components in parts by weight

| Component | Generally | Preferred | Most Preferred |
|---|---|---|---|
| (A) | 50–90 | 60–90 | 70–85 |

-continued

| Component | Generally | Preferred | Most Preferred |
|---|---|---|---|
| (B) | 0.1–20 | 0.1–10 | .05–5 |
| (C) or (D) | 1–60 | 1–40 | 1–20 |

When the composition comprises components (A), (B), (C) and (D), the following states the ranges of these components in parts by weight

| Component | Generally | Preferred | Most Preferred |
|---|---|---|---|
| (A) | 40–90 | 60–90 | 70–85 |
| (B) | 0.1–20 | 0.1–10 | 0.5–5 |
| (C) | 0.1–25 | 0.1–20 | 0.5–15 |
| (D) | 1–60 | 5–50 | 10–40 |

It is understood that other components besides (A), (B), (C) and (D) may be present within the composition of this invention.

The components of this invention are blended together according to the above ranges to effect solution. The following Table I outlines examples so as to provide those of ordinary skill in the art with a complete disclosure and description on how to make the composition of this invention and is not intended to limit the scope of what the inventors regard as their invention. All parts are by weight.

TABLE I

| EXAMPLE | COMPONENTS (A) | (B) | (C) | (D) | POUR POINT °C. | FREEZE POINT °C. | BROOKFIELD VISCOSITY CPS |
|---|---|---|---|---|---|---|---|
| 1 | 100 PARTS SUNYL 80 | | | | −12 | −14.6 | SOLID |
| 2 | 98 PARTS SUNYL 80 | 2 PARTS ACRYLOID 1267 | | | −27 | −28.0 | SOLID |
| 3 | 98 PARTS SUNYL 80 | 2 PARTS ACRYLOID 5089 | | | −27 | −27.4 | 9400 |
| 4 | 99.5 PARTS SUNYL 80 | 0.5 PARTS EXAMPLE (B-1) | | | −27 | −27.2 | 35,000 |
| 5 | 99 PARTS SUNYL 80 | 1 PARTS EXAMPLE (B-1) | | | −24 | −26.7 | 28,100 |
| 6 | 78.4 PARTS SUNYL 80 | 2 PARTS ACRYLOID 1267 | | 19.6 PARTS GLISSOFLUID A-9 | −30 | −32.0 | 5720 |
| 7 | 78.4 PARTS SUNYL 80 | 2 PARTS VISCOPLEX 0-410 | | 19.6 PARTS EMERY 2964 | −30 | −32.1 | 3800 |
| 8 | 66.4 PARTS SUNYL 80 | 2 PARTS TLA ® 233 | 7.45 PARTS EXAMPLE (C)(5)-1B 7.55 PARTS EXAMPLE (C)(5)-6 | 16.6 PARTS STODDARD SOLVENT | −27 | −28.1 | 5770 |
| 9 | 67.6 PARTS SUNYL 80 | 0.5 PARTS EXAMPLE (B-1) | 7.45 PARTS EXAMPLE (C)(5)-1B 7.55 PARTS EXAMPLE (C)(5)-6 | 16.9 PARTS STODDARD SOLVENT | −30 | −32.9 | 1470 |
| 10 | 66.4 PARTS SUNYL 80 | 2 PARTS ACRYLOID 1267 | 10.95 PARTS EXAMPLE (C)(5)-1B 1.28 PARTS EXAMPLE (C)(5)-6 0.22 PARTS NONYLATED DIPHENYL AMINE 2.55 PARTS EXAMPLE (C-4)-1 | 16.6 PARTS GLISSOFLUID A-9 | −36 | −38.5 | 3120 |
| 11 | 100 PARTS RS80 | | | | −21 | −21.9 | SOLID |
| 12 | 98 PARTS RS80 | 2 PARTS TLA 233 | | | −27 | −28.9 | 7500 |
| 13 | 98 PARTS | 2 PARTS | | | −30 | −30.6 | 2200 |

TABLE I-continued

| EXAMPLE | COMPONENTS (A) | (B) | (C) | (D) | POUR POINT °C. | FREEZE POINT °C. | BROOKFIELD VISCOSITY CPS |
|---|---|---|---|---|---|---|---|
| | RS80 | VISCOPLEX 10-930 | | | | | |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A composition, comprising;

(A) at least one vegetable or synthetic triglyceride oil of the formula

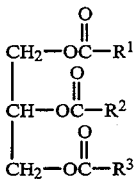

wherein $R^1$, $R^2$ and $R^3$ are aliphatic hydrocarbyl groups having at least 60 percent monounsaturated character and containing from about 6 to about 24 carbon atoms and further wherein an oleic acid moiety:linoleic acid moiety is from about 2 up to about 90 and (B) at least one pour point depressant.

2. The composition of claim 1 wherein the triglyceride is a vegetable oil triglyceride comprising high oleic safflower oil, high oleic corn oil, high oleic rapeseed oil, high oleic sunflower oil, high oleic soybean oil, high oleic cottonseed oil, high oleic lesquerella oil, high oleic meadowfoam oil and high oleic palm olein.

3. The composition of claim 2 wherein the vegetable oil triglyceride is an ester of at least one straight chain fatty acid and glycerol wherein the fatty acid contains from about 8 to about 22 carbon atoms.

4. The composition of claim 3 wherein the triglyceride is at least 70 percent monounsaturated.

5. The composition of claim 4 wherein the triglyceride is at least 80 percent monounsaturated.

6. The composition of claim 5 wherein the monounsaturated fatty acid is oleic acid.

7. The composition of claim 1 wherein the pour point depressant is a mixed ester characterized by low-temperature modifying properties of a carboxy-containing interpolymer, said interpolymer having a reduced specific viscosity of from about 0.05 to about 2 and being derived from at least two monomers, one of said monomers being a low molecular weight aliphatic olefin, styrene or a substituted styrene wherein the substituent is a hydrocarbyl group containing from 1 up to about 18 carbon atoms, and the other of said monomers being an alpha, beta-unsaturated aliphatic acid, anhydride or ester thereof, said ester being substantially free of titratable acidity and being characterized by the presence within its polymeric structure of at least one of each of three pendant polar groups which are derived from the carboxy groups of said ester:

(A) a relatively high molecular weight carboxylic ester group, said carboxylic ester group having at least 8 aliphatic carbon atoms in the ester radical, (B) a relatively low molecular weight carboxylic ester group having no more than 7 aliphatic carbon atoms in the ester radical, wherein the molar ratio of (A):(B) is (1–20):1, and optionally (C) a carbonyl-amino group derived from an amino compound having one primary or secondary amino group, wherein the molar ratio of (A):(B):(C) is (50–100):(5–50):(0.1–15).

8. The composition of claim 7 wherein said mixed ester is characterized by low-temperature modifying properties of a carboxy-containing interpolymer, said interpolymer having a reduced specific viscosity of from about 0.05 to about 2 and being derived from at least two monomers, the one being ethylene, propylene, isobutene, styrene or substituted styrene wherein the substituent is a hydrocarbyl group containing from 1 up to about 18 carbon atoms and the other of said monomers being maleic acid or anhydride, itaconic acid or anhydride or acrylic acid or ester, said ester being substantially free of titratable acidity and being characterized by the presence within its polymeric structure of at least one of each of three pendant polar groups which are derived from the carboxy groups of said ester:

(A) a relatively high molecular weight carboxylic ester group, said carboxylic ester group having at least 8 aliphatic carbon atoms in the ester radical, (B) a relatively low molecular weight carboxylic ester group having no more than 7 aliphatic carbon atoms in the ester radical, wherein the molar ratio of (A):(B) is (1–20):1, and optionally (C) a carbonyl-amino group derived from an amino compound having one primary or secondary amino radical, wherein the molar ratio of (A):(B):(C) is (50–100): (5–50):(0.1–15).

9. The composition of claim 7 wherein the molar ratio of (A):(B) is (1–10):1.

10. The composition of claim 7 wherein the molar ratio of (A):(B):(C) is (70–85):(15–30):(3–4).

11. The composition of claim 7 wherein the interpolymer is a styrene-maleic anhydride interpolymer having a reduced specific viscosity of from about 0.1 to about 1.

12. The composition of claim 7 wherein the relatively high molecular weight carboxylic ester group of (A) has from 8 to 24 aliphatic carbon atoms, the relatively low molecular weight carboxylic ester group of (B) has from 3 to 5 carbon atoms and the carbonyl-amino group of (C) is derived from a primary-aminoalkyl-substituted tertiary amine.

13. The composition of claim 7 wherein the carboxy-containing interpolymer is a terpolymer of one molar proportion of styrene, one molar proportion of maleic anhydride, and less than about 0.3 molar proportion of a vinyl monomer.

14. The composition of claim 7 wherein said low molecular weight aliphatic olefin of said nitrogen-containing ester is selected from the group consisting of ethylene, propylene or isobutene.

15. The composition of claim 1 wherein the pour point depressant is an acrylate polymer of the formula

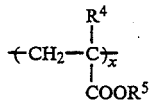

wherein $R^4$ is hydrogen or a lower alkyl group containing from 1 to about 4 carbon atoms, $R^5$ is a mixture of alkyl, cycloalkyl or aromatic groups containing from about 4 to about 24 carbon atoms, and x is an integer providing a weight average molecular weight (Mw) to the acrylate polymer of about 5000 to about 1,000,000.

16. The composition of claim 15 wherein $R^4$ is a methyl group.

17. The composition of claim 15 wherein the molecular weight of the polymer is from about 50,000 to about 500,000.

18. The composition of claim 1 wherein the pour point depressant is a methylene linked aromatic compound that is a mixture of compounds having the general structural formula $$Ar-(R^6)-[-Ar'(R^7)]_nAr''$$

wherein the Ar, Ar' and Ar'' are independently an aromatic moiety containing 1 to 3 aromatic rings and the mixture includes compounds wherein moieties are present with 0 substituents, 1 substituent, 2 substituents and 3 substituents, $R^6$ and $R^7$ are independently an alkylene containing about 1 to 100 carbon atoms, and n is 0 to 1000 wherein the methylene linked aromatic compound is produced by a process comprising the steps of;

(a) providing aromatic compounds containing 1 to 3 aromatic rings which compounds are substituted with 0.to 3 substituents, the compounds being precursors for aromatic moieties Ar, Ar' and Ar'' in a reactor;

(b) adding a FRIEDEL-CRAFTS or Lewis Acid catalyst to the reactor;

(c) adding a chlorinate hydrocarbon to the reactor;

(d) adding an olefin to the reactor and (e) adding $CH_2Cl_2$ to the reactor wherein step (e) is carried out prior to or concurrently with at least one step of (a)-(d).

19. The mixture as claimed in claim 18 wherein compounds are present in the mixture wherein the aromatic moieties are naphthalene, the olefin contains about 16 to 18 carbon atoms and the chlorinated hydrocarbon contains about 20 to 26 carbon atoms.

20. The mixture as claimed in claim 18 including compounds having a molecular weight ranging from about 300 to about 10,000.

21. The mixture as claimed in claim 18 including compounds having a molecular weight ranging from about 300 to about 300,000.

22. The composition of claim 1 wherein the pour point depressant is a nitrogen containing polyacrylate ester prepared by reacting an acrylate ester of the formula

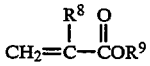

wherein $R^8$ is hydrogen or an alkyl group containing from 1 to about 4 carbon atoms and $R^9$ is an alkyl, cycloalkyl or aromatic group containing from 4 to about 24 carbon atoms with a nitrogen-containing compound at from 0.001-1.0 moles of the nitrogen containing compound for each mole of the acrylate ester.

23. The composition of claim 22 wherein the nitrogen-containing compound is selected from the group consisting of 4-vinylpyridine, 2-vinylpyridine, 2-N-morpholinoethyl methacrylate, N,N-dimethylaminoethyl methacrylate and N,N-dimethylaminopropyl methacrylate.

24. The composition of claim 1 further comprising (C) a performance additive selected from the group consisting of (1) at least one alkyl phenol of the formula

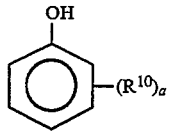

wherein $R^{10}$ is an alkyl group containing from 1 up to about 24 carbon atoms and a is an integer of from 1 up to 5, and optionally (2) a metal deactivator selected from the group consisting of (a) a benzotriazole of the formula

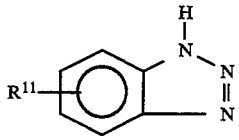

wherein $R^{11}$ is hydrogen or an alkyl group of 1 up to about 24 carbon atoms, (b) a phosphatide of the formula

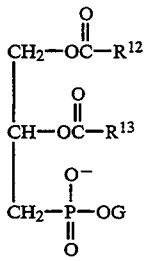

wherein $R^{12}$ and $R^{13}$ are aliphatic hydrocarbyl groups containing from 8 to about 24 carbon atoms, and G is selected from the group consisting of hydrogen,

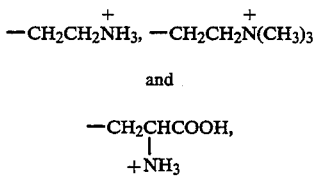

and (c) a carbamate of the formula

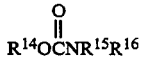

wherein $R^{14}$ is an allyl group containing from 1 to about 24 carbon atoms, phenyl or alkyl phenyl wherein the alkyl group contains from 1 to about 18 carbon atoms, $R^{15}$ and $R^{16}$ are hydrogen or an alkyl group containing from 1 to about 6 carbon atoms, with the proviso that $R^{15}$ and $R^{16}$ are not both hydrogen, (d) citric acid and derivatives of citric acid of the formula

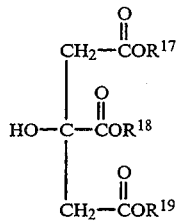

wherein $R^{17}$, $R^{18}$ and $R^{19}$ are independently hydrogen or aliphatic hydrocarbyl groups containing from 1 to about 12 carbon atoms, with the proviso that at least one of $R^{17}$, $R^{18}$ and $R^{19}$ is an aliphatic hydrocarbyl group, (e) a coupled phosphorus-containing amide of the formula

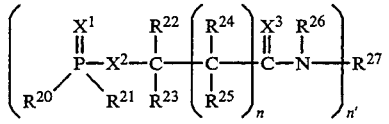

wherein $X^1$, $X^2$ and $X^3$, independently is oxygen or sulfur;

wherein $R^{20}$ and $R^{21}$, independently is a hydrocarbyl, a hydrocarbyl-based oxy, the hydrocarbyl portions of which contain 6 to about 22 carbon atoms, or a hydrocarbyl-based thio, having from 4 to about 34 carbon atoms;

wherein $R^{22}$, $R^{23}$, $R^{24}$ and $R^{25}$, independently is hydrogen, or an alkyl having from 1 to about 22 carbon atoms, or an aromatic, an alkyl-substituted aromatic or an aromatic-substituted alkyl having from 6 to about 34 atoms;

wherein n is zero or 1;

wherein n' is 2 or 3;

wherein $R^{26}$ is hydrogen; and when n' is 2, $R^{27}$ is selected from the group consisting of

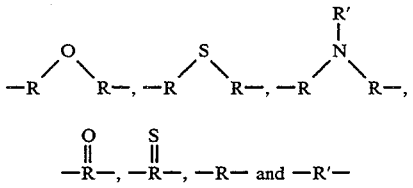

wherein R is an alkyl moiety, in the form of alkylene or alkylidene containing from 1 to 12 carbon atoms and R' is an alkyl moiety, alkylene, alkylidene or carboxyl containing 1 to 60 carbon atoms and when n' is 3, $R^{27}$ is

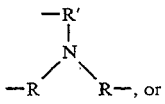

(f) a methylacrylate derivative formed by the reaction of equal molar amounts of a phosphorus acid of the formula

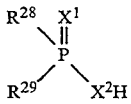

with methylacrylate wherein $X^1$ and $X^2$ are oxygen or sulfur and $R^{28}$ and $R^{29}$ are each independently a hydrocarbyl, a hydrocarbyl-based thio or preferably a hydrocarbyl-based oxy group wherein the hydrocarbyl portion contains from 1 to about 30 carbon atoms and remaining acidity is neutralized with 1 mole propylene oxide for each 20–25 moles of phosphorus acid;

(3) a metal overbased composition;

(4) a carboxylic dispersant composition:

(5) a nitrogen-containing organic composition comprising (a) an acylated, nitrogen containing compound having a substituent of at least 10 aliphatic carbon atoms made by reacting a carboxylic acylating agent with at least one amino compound containing at least one —NH group, said acylating agent being linked to said amino compound through an imido, ado, amidine or acyloxy ammonium linkage, and (b) at least one amino phenol of the general formula

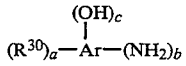

wherein $R^{30}$ is a substantially saturated, hydrocarbon-based substituent of at least 10 aliphatic carbon atoms; a, b and c are each independently an integer of one up to three times the number of aromatic nuclei present in Ar with the proviso that the sum of a, b and c does not exceed the unsaturated valences of Ar; and Ar is an aromatic moiety having 0–3 optional substituents selected from the group consisting of lower alkyl, lower alkoxyl, nitro, halo or combinations of two or more of said substituents, (6) a zinc salt of be formula

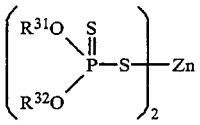

wherein $R^{31}$ and $R^{32}$ are independently hydrocarbyl groups containing from about 3 to about 20 carbon atoms, (7) a sulfurized composition wherein the sulfurized composition is a sulfurized olefin prepared by reacting an olefin/sulfur halide complex by contacting the complex with a protic solvent in the presence of metal ions at a temperature in the range of 40° C. to 120° C. and thereby removing halogens from the sulfurized complex and providing a dehalogenated sulfurized olefin; and isolating the sulfurized olefin, or the sulfurized composition comprises the reaction product of sulfur and a Diels-Alder adduct in a molar ratio of sulfur to adduct of from about 1:2 to about 4:1 wherein the adduct comprises at least one dienophile selected from the group consisting of alpha, beta ethylenically unsaturated aliphatic carboxylic acid esters, alpha, beta ethylenically unsaturated aliphatic carboxylic acid amides, and alpha, beta ethylenically unsaturated aliphatic halides with at least one aliphatic conjugated diene corresponding to the formula

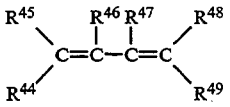

(XVI)

where $R^{44}$ through $R^{49}$ are each independently selected from the group consisting of hydrogen, alkyl, halo, alkoxy, alkenyl, alkenyloxy, carboxy, cyano, amino, alkylamino, dialkylamino, phenyl, and phenyl substituted with one to three substituents corresponding to $R^{44}$ through $R^{49}$;

(8) at least one viscosity index improver; and (9) at least one aromatic amine of the formula

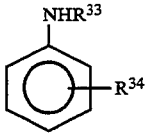

wherein $R^{33}$ is

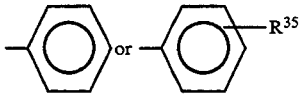

and $R^{34}$ and $R^{35}$ are independently a hydrogen or an alkyl group containing from 1 up to about 24 carbon atoms.

25. The composition of claim 24 wherein within (C)(1) a is 2 and $R^{10}$ contains from 1 up to about 8 carbon atoms.

26. The composition of claim 25 wherein the alkyl phenol is of the formula

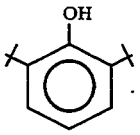

27. The composition of claim 24 wherein within (C)(2)(a) $R^{11}$ is hydrogen or an alkyl group containing from 1 up to about 8 carbon atoms.

28. The composition of claim 24 wherein within (C)(2)(a) $R^{11}$ is a methyl group.

29. The composition of claim 24 wherein within (C)(2)(f) $X^1$ and $X^2$ are sulfur and $R^{28}$ and $R^{29}$ are hydrocarbyl-based oxy groups wherein the hydrocarbyl group contains from 1 to 12 carbon atoms.

30. The composition of claim 24 wherein within (C)(3) the metal overbased composition is selected from the group consisting of (a) a metal overbased phenate derived from the reaction of an alkylated phenol wherein the alkyl group has at least 6 aliphatic carbon atoms optionally reacted with formaldehyde or a sulfurization agent or mixtures thereof, (b) a metal overbased sulfonate derived from an alkylated aryl sulfonic acid wherein the alkyl group has at least 15 aliphatic carbon atoms and (c) a metal overbased carboxylate derived from fatty acids having at least 8 aliphatic carbon atoms.

31. The composition of claim 30 wherein the metal is an alkali or alkaline earth metal.

32. The composition of claim 31 wherein the alkaline earth metal is calcium or magnesium.

33. The composition of claim 31 wherein the alkali metal is sodium.

34. The composition of claim 30 wherein the metal overbased composition is treated with a borating agent.

35. The composition of claim 24 wherein within (C)(4) the carboxylic dispersant composition comprises the reaction of a hydrocarbon substituted succinic acid-producing compound with at least about one-half equivalent, per equivalent of acid producing compound, of an organic hydroxy compound or an amine containing at least one hydrogen attached to a nitrogen atom, or a mixture of said hydroxy compound and amine.

36. The composition of claim 35 wherein within (C)(4) the succinic acid-producing compound contains an average of at least about 50 aliphatic carbon atoms in the substituent.

37. The composition of claim 35 wherein within (C)(4) the succinic acid producing compound is selected from the group consisting of succinic acids, anhydrides, esters and halides.

38. The composition of claim 35 wherein within (C)(4) the hydrocarbon substituent of the succinic acid producing compound is derived from a polyolefin having an Mn value within the range of from about 700 to about 10,000.

39. The composition of claim 35 wherein within (C)(4) the amine reacted with the succinic acid producing compound is characterized by the formula $$R^{39}R^{40}NH$$

wherein $R^{39}$ and $R^{40}$ are each independently hydrogen, or hydrocarbon, amino-substituted hydrocarbon, hydroxy-substituted hydrocarbon, alkoxy-substituted hydrocarbon, amino, carbamyl, thiocarbamyl, guanyl, and acylimidoyl groups provided that only one of $R^{39}$ and $R^{40}$ may be hydrogen.

40. The composition of claim 35 wherein within (C)(4) the amine reacted with the succinic acid producing compound is a polyamine.

41. The composition of claim 24 wherein within (C)(5)(a) the amino compound is an alkylene polyamine of the general formula

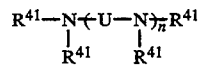

Formula IX wherein U is an alkylene group of 2 to 10 carbon atoms; each $R^{41}$ is independently a hydrogen atom, a lower alkyl group or a lower hydroxy alkyl group, with the proviso that at least one $R^{41}$ is a hydrogen atom, and n is 1 to 10.

42. The composition of claim 41 wherein within (C)(5)(a) the acylating agent is a mono- or polycarboxylic acid, or reactant equivalent thereof, containing an aliphatic hydrocarbyl substituent of at least about 30 carbon atoms.

43. The composition of claim 42 wherein within (C)(5)(a) the substituent is made from a homo- or interpolymer of a $C_{2-10}$ 1-monoolefin or mixtures thereof.

44. The composition of claim 43 wherein within (C)(5)(a) the homo- or interpolymer is of ethylene, propylene, 1-butene, 2-butene, isobutene or mixtures thereof.

45. The composition of claim 41 wherein within (C)(5)(a) the acylating agent is at least one mono-carboxylic acid, or reactant equivalent thereof, having from 12 to 30 carbon atoms.

46. The composition of claim 45 wherein within (C)(5)(a) the acylating agent is a mixture of fatty monocarboxylic acids, or reactant equivalent thereof, having straight and branched carbon chains.

47. The composition of claim 46 wherein within (C)(5)(a) the amino compound is an ethylene, propylene or trimethylene polyamine of at least 2 to about 8 amino groups or mixtures of such polyamines.

48. The composition of claim 24 wherein within (C)(5)(b) $R^{30}$ contains up to about 750 carbon atoms and there are no optional substituents attached to Ar.

49. The composition of claim 48 wherein within (C)(5)(b) $R^{30}$ is an alkyl or alkenyl group.

50. The composition of claim 24 wherein within (C)(5)(b) $R^{30}$ contains about 30 to about 750 aliphatic carbon atoms and is made from a homo- or interpolymer of $C_2$–$C_{10}$ olefins.

51. The composition of claim 50 wherein within (C)(5)(b) said olefins are selected from the group consisting of ethylene, propylene, butylene and mixtures thereof.

52. The composition of claim 24 wherein within (C)(5)(b) a, b and c are each 1, there are zero optional substituents attached to Ar, and Ar is a benzene nucleus.

53. The composition of claim 52 wherein within (C)(5)(b) $R^{30}$ is an alkyl or alkenyl group of at least about 30 carbon atoms and up to about 750 carbon atoms and is derived from a homo or interpolymer of $C_2$–$C_{10}$ 1-monoolefins.

54. The composition of claim 24 wherein within (C)(5)(b) the amino phenol is of the formula

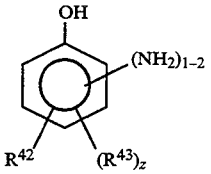

Formula XII wherein $R^{42}$ is a substantially saturated hydrocarbon-based substituent having an average of from about 30 to about 400 aliphatic carbon atoms, $R^{43}$ is a member selected from the group consisting of lower alkyl, lower alkoxy, nitro, and halo; and z is zero or one.

55. The composition of claim 54 wherein within (C)(5)(b) $R^{42}$ is a purely hydrocarbyl aliphatic group of at least about 50 carbon atoms and is made from a polymer or interpolymer of an olefin selected from the group consisting of $C_{2-10}$ 1-monoolefins and mixtures thereof.

56. The composition of claim 55 wherein within (C)(5)(b) z is zero.

57. The composition of claim 24 wherein within (C)(7) the olefin is an alkylene compound containing one double bond and 2 to 50 carbon atoms, and the sulfur halide is a sulfur chloride.

58. The composition of claim 24 wherein within (C)(7) the olefin is a mixture of olefins containing isobutene and the sulfur halide is selected from the group consisting of sulfur monochloride, sulfur dichloride and mixtures thereof; the protic solvent is selected from the group consisting of water, alcohols, carboxylic acids and combination thereof; and the metal ions are sodium sulfide/sodium hydrosulfide mixture derived from hydrocarbon purification process streams and sodium hydroxide.

59. The composition of claim 24 wherein within (C)(7) the sodium sulfide/sodium hydrosulfide mixture is derived from hydrocarbon purification process streams.

60. The composition of claim 24 wherein within (C)(7) the olefin contains one double bond and 2 to 50 carbon atoms and the sulfur halide is a sulfur chloride.

61. The composition of claim 60 wherein within (C)(7) the olefin is isobutene, the sulfur halide is sulfur monochloride, and the protic solvent is a water-isopropyl alcohol mixture.

62. The composition of claim 24 wherein within (C)(7) the molar ratio of sulfur to adduct is from about 2:1 to about 4:1.

63. The composition of claim 62 wherein within (C)(7) the diene is further characterized in that $R^{46}$ and $R^{47}$ are hydrogen and are $R^{44}$, $R^{45}$, $R^{48}$ and $R^{49}$ are each independently hydrogen, chloro, or lower alkyl.

64. The composition of claim 63 wherein within (C)(7) the dienophile is further characterized in that it contains at least one but not more than two $$-C(O)OR^{50}$$

where $R^{50}$ is the residue of a saturated aliphatic alcohol of up to about 40 carbon atoms.

65. The composition of claim 64 wherein within (C)(7) the diene is piperylene, isoprene, methylisoprene, chloroprene, or 1,3-butadiene.

66. The composition of claim 65 wherein within (C)(7) the dienophile is an ester of acrylic acid or methacrylic acid.

67. The composition of claim 65 wherein within (C)(7) the dienophile is an alkyl ester of acrylic acid or methacrylic acid containing at least 4 carbon atoms in the alkyl group.

68. The composition of claim 67 wherein within (C)(7) the diene is 1,3-butadiene.

69. The composition of claim 24 wherein within (C)(9) $R^{33}$ is

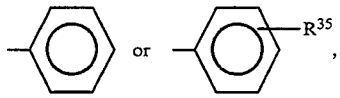

and $R^{34}$ and $R^{35}$ are alkyl groups containing from 4 to 18 carbon atoms.

70. The composition of claim 69 wherein within (C)(9) $R^{34}$ and $R^{35}$ are nonyl groups.

71. The composition of claim 1 further comprising (D) at least one oil selected from the group consisting of (1) synthetic ester base oil comprising the reaction of a monocarboxylic acid of the formula $R^{36}COOH$ or a dicarboxylic acid of the formula

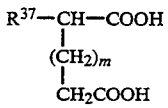

with an alcohol of the formula $R^{38}(OH)_n$ wherein $R^{36}$ is a hydrocarbyl group containing from about 4 to about 24 carbon atoms, $R^{37}$ is hydrogen or a hydrocarbyl group containing from about 4 to about 50 carbon atoms, $R^{38}$ is a hydrocarbyl group containing from 1 to about 24 carbon atoms, m is an integer of from 0 to about 6 and n is an integer of from 1 to about 6;

(2) a mineral oil;

(3) a polyalphaolefin and (4) a vegetable oil.

72. The composition of claim 24 further comprising (D) at least one oil selected from the group consisting of (1) synthetic ester base oil comprising the reaction of a monocarboxylic acid of the formula $R^{36}COOH$ or a dicarboxylic acid of the formula

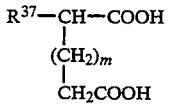

with an alcohol of the formula $R^{38}(OH)_n$ wherein $R^{36}$ is a hydrocarbyl group containing from about 4 to about 24 carbon atoms, $R^{37}$ is hydrogen or a hydrocarbyl group containing from about 4 to about 50 carbon atoms, $R^{38}$ is a hydrocarbyl group containing from 1 to about 24 carbon atoms, m is an integer of from 0 to about 6 and n is an integer of from 1 to about 6;

(2) a mineral oil;

(3) a polyalphaolefin and (4) a vegetable oil.

* * * * *